US011438992B2

(12) United States Patent
Mao et al.

(10) Patent No.: US 11,438,992 B2
(45) Date of Patent: Sep. 6, 2022

(54) NON-COMMON-GROUND BANDPASS FILTER CIRCUIT WITH ELECTROSTATIC DISCHARGE PROTECTION

(71) Applicant: iWave Technologies Co., Ltd., Kaohsiung (TW)

(72) Inventors: Shau-Gang Mao, Kaohsiung (TW); Chong-Yi Liou, Kaohsiung (TW); Wei-Ting Tsai, Kaohsiung (TW); Ting-Wei Wu, Kaohsiung (TW); Yu-Yao Chen, Kaohsiung (TW); Jin-Feng Neo, Kaohsiung (TW); Zheng-An Peng, Kaohsiung (TW); Tsu-Yu Lo, Kaohsiung (TW); Je-Yao Chang, Kaohsiung (TW); Chien-Bang Chen, Kaohsiung (TW); Shih-Ping Huang, Kaohsiung (TW)

(73) Assignee: iWave Technologies Co., Ltd., Kaohsiung (TW)

( * ) Notice: Subject to any disclaimer, the term of this patent is extended or adjusted under 35 U.S.C. 154(b) by 79 days.

(21) Appl. No.: 17/001,487

(22) Filed: Aug. 24, 2020

(65) Prior Publication Data

US 2021/0068239 A1 Mar. 4, 2021

Related U.S. Application Data

(60) Provisional application No. 62/892,693, filed on Aug. 28, 2019.

(51) Int. Cl.

| | |
|---|---|
| ***H01Q 1/48*** | (2006.01) |
| ***H05F 3/02*** | (2006.01) |
| ***H01Q 9/04*** | (2006.01) |

(52) U.S. Cl.
CPC ..... *H05F 3/02* (2013.01); *H01Q 1/48* (2013.01); *H01Q 9/045* (2013.01)

(58) Field of Classification Search
CPC ..... H01Q 1/48; H01Q 1/1243; H01Q 5/364; H01Q 5/378; H01Q 9/045; H01Q 9/42; H01Q 9/145
See application file for complete search history.

(56) References Cited

U.S. PATENT DOCUMENTS 9,093,977 B2 * 7/2015 Jin ..... H02H 9/04
2008/0303729 A1 * 12/2008 Milosavljevic ..... H01Q 9/0421 343/722

(Continued)

*Primary Examiner* — Tung X Le
(74) *Attorney, Agent, or Firm* — Birch, Stewart, Kolasch & Birch, LLP

(57) ABSTRACT

A non-common-ground bandpass filter circuit with electrostatic discharge (ESD) protection is disclosed. The non-common-ground bandpass filter circuit with ESD protection includes a non-common-ground plane, a dielectric substrate and a conductor. The conductor is disposed above the non-common-ground plane. The dielectric substrate is disposed between the conductor and the non-common-ground plane. The non-common-ground plane at least has a first ground region and a second ground region separated and insulated from each other. The first ground region corresponds to a first terminal of the conductor and the second ground region corresponds to a second terminal of the conductor. When an ESD event occurs on one of the first ground region and the second ground region, the other of the first ground region and the second ground region will not be damaged by the ESD event. The non-common-ground bandpass filter circuit also provides surge protection.

20 Claims, 51 Drawing Sheets

(56) References Cited

U.S. PATENT DOCUMENTS

| | | | | |
|---|---|---|---|---|
| 2011/0028191 | A1* | 2/2011 | Huang | H05K 1/0259<br>455/575.7 |
| 2011/0273360 | A1* | 11/2011 | Campero | H01Q 5/50<br>343/893 |
| 2017/0025762 | A1* | 1/2017 | Rahmat-Samii | H01Q 1/48 |
| 2020/0313299 | A1* | 10/2020 | Jia | H01Q 9/0457 |

* cited by examiner

NON-COMMON-GROUND BANDPASS FILTER CIRCUIT WITH ELECTROSTATIC DISCHARGE PROTECTION

CROSS REFERENCE TO RELATED APPLICATION

This non-provisional application claims the benefit under 35 U.S.C. § 119(e) to U.S. Provisional Application No. 62/892,693, filed on Aug. 28, 2019, which is hereby expressly incorporated by reference into the present application.

FIELD OF THE INVENTION

The invention relates to a bandpass filter circuit, and specifically to a non-common-ground bandpass filter circuit with electrostatic discharge (ESD) protection.

BACKGROUND OF THE INVENTION

Microstrip is a type of electrical transmission line which can be fabricated using printed circuit board technology, and is used to convey microwave-frequency signals. It consists of a conducting strip separated from a ground plane by a dielectric layer known as the substrate. Microwave components such as antennas, couplers, filters, power dividers etc. can be formed from microstrip, with the entire device existing as the pattern of metallization on the substrate. Microstrip is thus much less expensive than traditional waveguide technology, as well as being far lighter and more compact. The disadvantages of microstrip compared with waveguide are the generally lower power handling capacity and higher losses. Also, unlike waveguide, microstrip is not enclosed, and is therefore susceptible to cross-talk and unintentional radiation.

Please refer to FIG. 1A and FIG. 1B. FIG. 1A illustrates a schematic view of a conventional bandpass filter circuit and FIG. 1B illustrates simulation results of the conventional bandpass filter circuit shown in FIG. 1A.

As shown in FIG. 1A, in the conventional bandpass filter circuit 1, a conductor is disposed above a common-ground plane 10 to form a microstrip structure 12 and a dielectric substrate (e.g., a FR-4 substrate) is disposed between the microstrip structure 12 and the common-ground plane 10.

Please refer to FIG. 2. FIG. 2 illustrates a simulation circuit diagram of the conventional bandpass filter circuit 1 shown in FIG. 1A. As shown in FIG. 2, the microstrip cross junction MCROSO is coupled to the resistor Term through the microstrip line MLIN and coupled to the microstrip short-circuited stub MLSC; two microstrip cross junctions MCROSO are coupled through the microstrip line MLIN.

Please refer to FIG. 3. FIG. 3 illustrates a schematic view of the simulated S-parameters of the conventional bandpass filter circuit 1 shown in FIG. 1A. As shown in FIG. 3, m1 represents dB(S(4,3))=−0.308 at the frequency of 2.4 GHz; m2 represents dB(S(4,3))=−0.316 at the frequency of 2.5 GHz; m3 represents dB(S(4,3))=−0.650 at the frequency of 5.2 GHz; m4 represents dB(S(4,3))=−0.772 at the frequency of 5.801 GHz.

However, since the entire common-ground plane 10 in the conventional bandpass filter circuit 1 is electrically connected, as shown in the simulation results of FIG. 1B, when an electrostatic discharge (ESD) event occurs, the conventional bandpass filter circuit 1 fails to provide any ESD protection, so that the circuits coupled to the conventional bandpass filter circuit 1 will be damaged by the ESD event.

SUMMARY OF THE INVENTION

In light of the above, one of the objectives of the invention is to provide a non-common-ground bandpass filter circuit with electrostatic discharge (ESD) protection.

An embodiment of the invention is a non-common-ground bandpass filter circuit with ESD protection. In this embodiment, the non-common-ground bandpass filter circuit with ESD protection includes a non-common-ground plane, a dielectric substrate and a conductor. The conductor is disposed above the non-common-ground plane. The dielectric substrate is disposed between the conductor and the non-common-ground plane. The non-common-ground plane at least has a first ground region and a second ground region. The first ground region and the second ground region are separated and insulated from each other. The first ground region and the second ground region correspond to a first terminal and a second terminal of the conductor respectively.

In an embodiment of the invention, when an ESD event occurs on one of the first ground region and the second ground region, the other of the first ground region and the second ground region is not damaged by the ESD event, and the non-common-ground bandpass filter circuit also provides surge protection.

In an embodiment of the invention, shapes of the first ground region and the second ground region are complementary to each other.

In an embodiment of the invention, the non-common-ground plane has a defected ground structure (DGS) to form the first ground region and the second ground region separated and insulated from each other.

In an embodiment of the invention, the DGS includes a slot disposed on the non-common-ground plane.

In an embodiment of the invention, the slot has a linear shape or a polyline shape.

In an embodiment of the invention, the slot is disposed along a length direction of the non-common-ground plane.

In an embodiment of the invention, the slot is disposed along a width direction of the non-common-ground plane.

In an embodiment of the invention, some parts of the slot are disposed along a length direction of the non-common-ground plane and the other parts of the slot are disposed along a width direction of the non-common-ground plane.

In an embodiment of the invention, the DGS further includes at least one space disposed between the first ground region and the second ground region and connected to the slot.

In an embodiment of the invention, a width of the space is larger than a width of the slot.

In an embodiment of the invention, the non-common-ground plane has arbitrary geometry.

In an embodiment of the invention, a microstrip structure is formed by the conductor.

In an embodiment of the invention, the microstrip structure includes a microstrip transmission line, a first terminal and a second terminal of the microstrip transmission line are disposed above the first ground region and the second ground region respectively.

In an embodiment of the invention, the microstrip structure further includes at least one microstrip antenna electrically connected to the microstrip transmission line.

In an embodiment of the invention, the microstrip antenna has a first portion and a second portion electrically connected to each other.

In an embodiment of the invention, the first portion of the microstrip antenna is electrically connected to the microstrip transmission line and vertical to a length direction of the microstrip transmission line.

In an embodiment of the invention, the second portion of the microstrip antenna is electrically connected to the first portion and parallel to the length direction of the microstrip transmission line.

In an embodiment of the invention, a size of the non-common-ground plane is changed by adjusting a length of the first ground region or the second ground region.

In an embodiment of the invention, a size of the non-common-ground plane is changed by adjusting a width of the first ground region or the second ground region.

Compared to the prior art, the non-common-ground bandpass filter circuit with ESD protection of the invention has a non-common-ground plane including at least two ground regions separated and insulated from each other by a defect ground structure such as a slot or a space, so that when an ESD event occurs on one ground region, the other ground region(s) will not be damaged by the ESD event. Therefore, the non-common-ground bandpass filter circuit with ESD protection of the invention can provide better ESD protection function than the common-ground bandpass filter circuit of the prior art. In addition, the non-common-ground bandpass filter circuit of the invention can also provide good surge protection function.

To further learn the features and technical content of the invention, please refer to the following detailed descriptions and drawings related to the invention. However, the provided drawings are used only for providing reference and descriptions, and are not intended to limit the invention.

DETAILED DESCRIPTION OF THE PREFERRED EMBODIMENTS

An embodiment of the invention is a non-common-ground bandpass filter circuit with ESD protection. In this embodiment, the non-common-ground bandpass filter circuit with ESD protection can include a non-common-ground plane, a dielectric substrate and a conductor. The conductor is disposed above the non-common-ground plane to form a microstrip structure. The dielectric substrate is disposed between the conductor and the non-common-ground plane.

The non-common-ground plane at least has a first ground region and a second ground region separated and insulated from each other. The first ground region and the second ground region correspond to a first terminal and a second terminal of the conductor respectively. The shapes of the first ground region and the second ground region are complementary to each other. When an ESD event occurs on one of the first ground region and the second ground region, the other of the first ground region and the second ground region is not damaged by the ESD event.

Figure 4A:
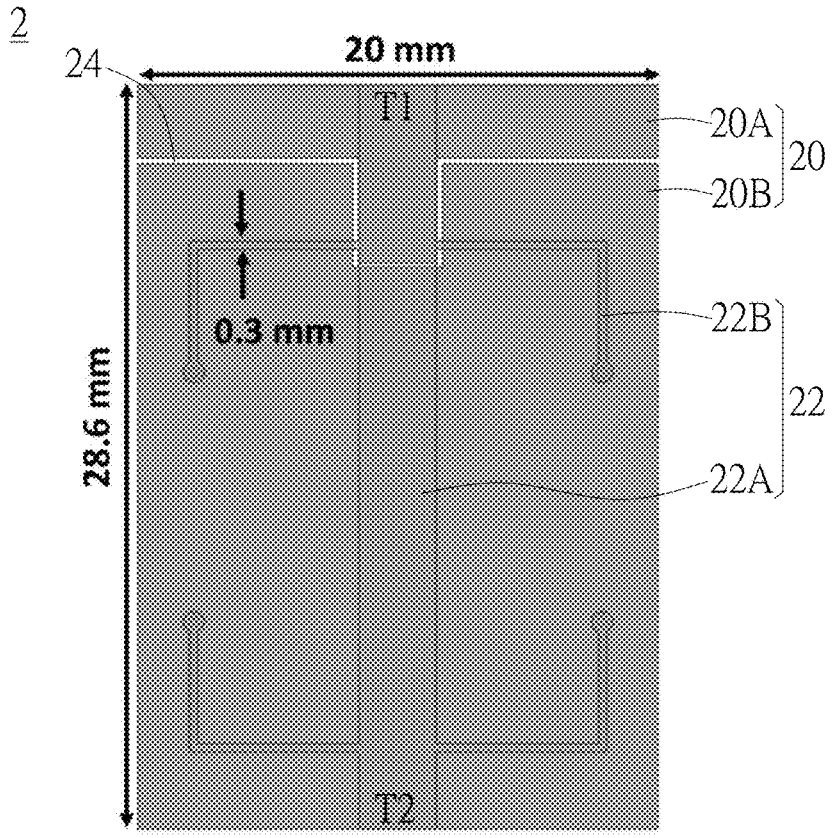
FIG. 4A illustrates a schematic view of a non-common-ground bandpass filter circuit with ESD protection in an embodiment of the invention.
Figure 4B:
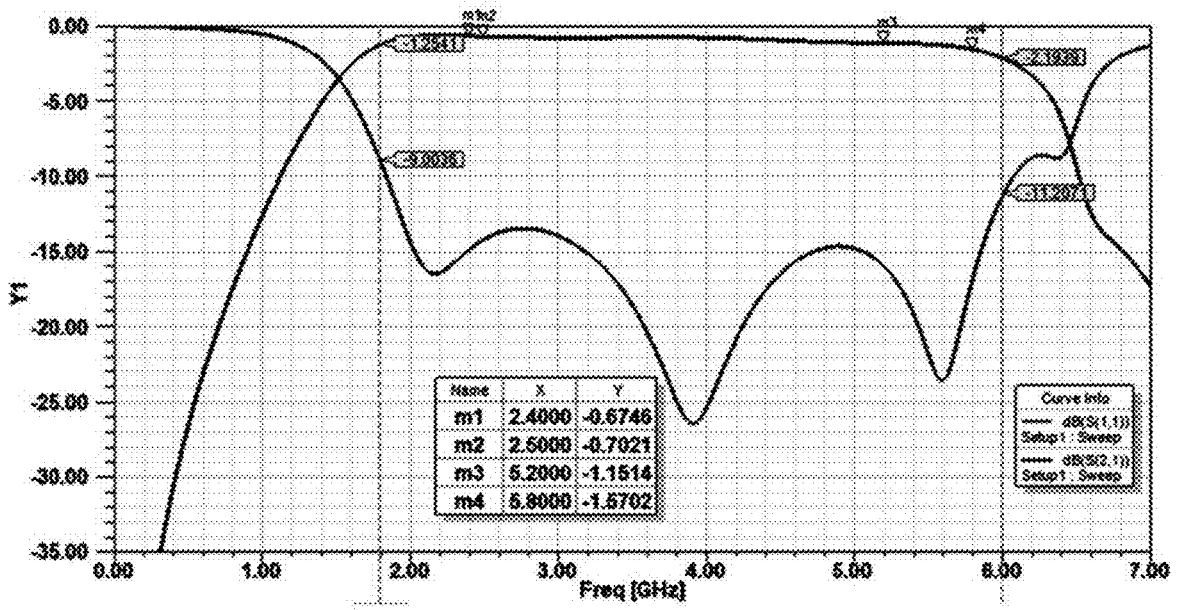
FIG. 4B illustrates simulation results of the non-common-ground bandpass filter circuit with ESD protection shown in FIG. 2A.
Figure 5A:
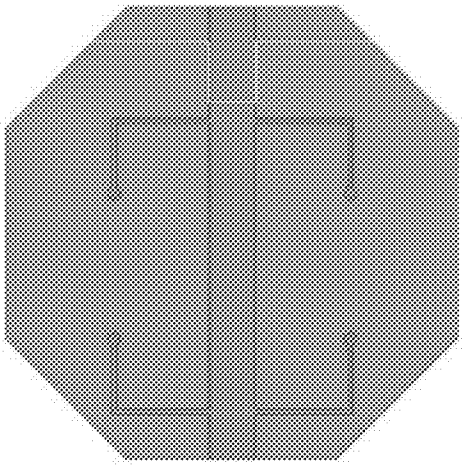
FIG. 5A to FIG. 5F illustrate different embodiments of the shapes of the separated first ground region and second ground region of the non-common-ground plane.
Figure 5B:
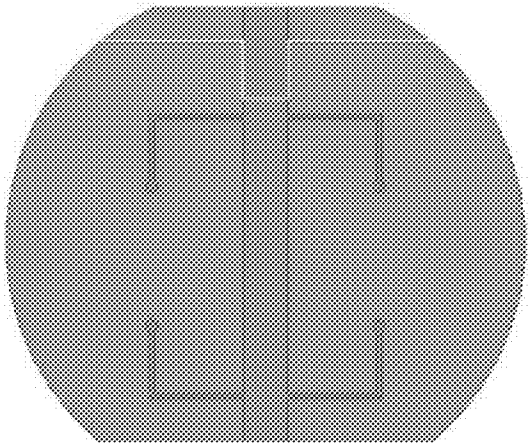
Figure 5C:
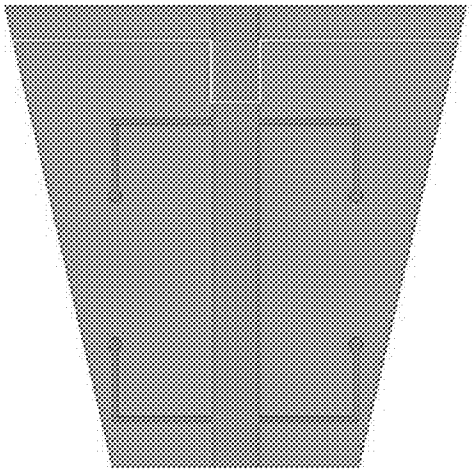
Figure 5D:
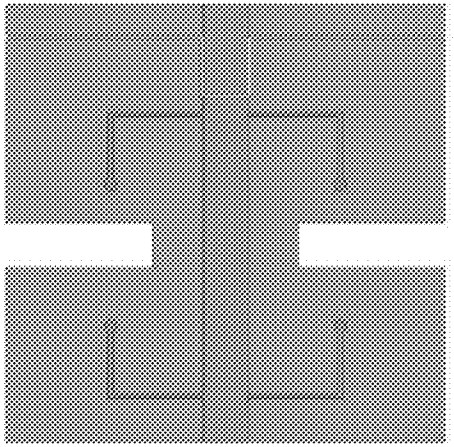
Figure 5E:
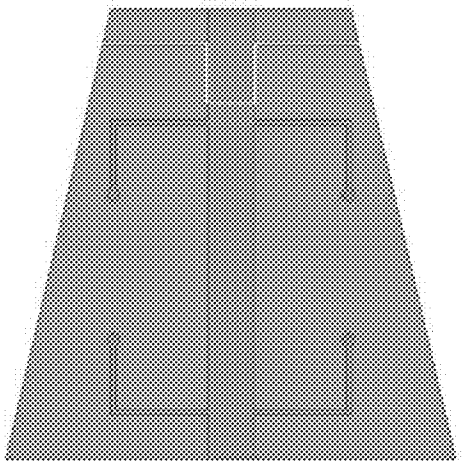
Figure 5F:
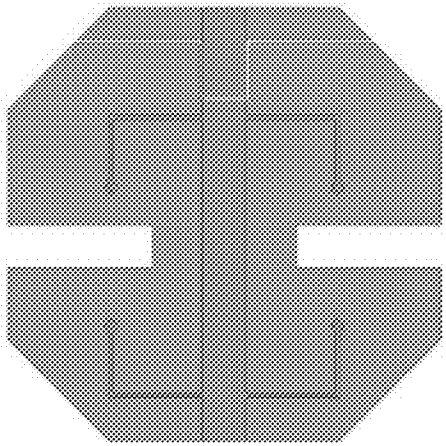

Please refer to FIG. 4A and FIG. 4B. FIG. 4A illustrates a schematic view of a non-common-ground bandpass filter circuit with ESD protection in an embodiment of the invention; FIG. 4B illustrates simulation results of the non-common-ground bandpass filter circuit with ESD protection shown in FIG. 4A.

As shown in FIG. 4A, in a non-common-ground bandpass filter circuit with ESD protection 2, a microstrip structure 22 including a microstrip transmission line 22A and microstrip antennas 22B is formed by a conductor disposed above the non-common-ground plane 20. The dielectric substrate (not shown) is disposed between the microstrip structure 22 and the non-common-ground plane 20. The microstrip antennas 22B can be coupled to the ground through the via, but not limited to this. In this embodiment, the length of the non-common-ground plane 20 is 28.6 mm and the width of the non-common-ground plane 20 is 20 mm, the size of the non-common-ground plane 20 is 28.6 mm*20 mm and the width of the microstrip antennas 22B is 0.3 mm, but not limited to this.

It should be noticed that the non-common-ground plane 20 has a first ground region 20A and a second ground region 20B. The first ground region 20A and the second ground region 20B are separated from each other by a narrow slot 24. And, the first ground region 20A and the second ground region 20B are insulated from each other.

It can be found that the shapes of the first ground region 20A and the second ground region 20B are complementary to each other. The first ground region 20A is disposed near the upper side of the non-common-ground plane 20 and the second ground region 20B is disposed near the lower side of the non-common-ground plane 20. The area of the first ground region 20A is smaller than the area of the second ground region 20B.

Since a first terminal T1 of the microstrip transmission line 22A is disposed above the upper side of the non-common-ground plane 20 and a second terminal T2 of the microstrip transmission line 22A is disposed above the lower side of the non-common-ground plane 20, it is believed that the first ground region 20A corresponds to the first terminal T1 of the microstrip transmission line 22A disposed above the upper side of the non-common-ground plane 20 and the second ground region 20B corresponds to the second terminal T2 of the microstrip transmission line 22A disposed above the lower side of the non-common-ground plane 20.

Since the first ground region 20A and the second ground region 20B of the non-common-ground plane 20 are separated and insulated from each other, when an ESD event occurs on one of the first ground region 20A and the second ground region 20B of the non-common-ground plane 20, the other of the first ground region 20A and the second ground region 20B of the non-common-ground plane 20 will not be damaged by the ESD event.

Figure 1A:
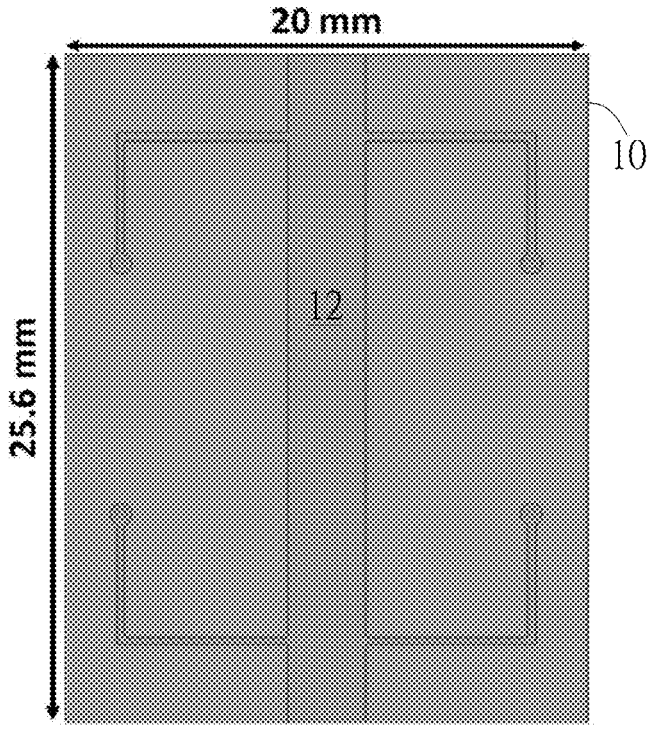
FIG. 1A (PRIOR ART)
FIG. 1A illustrates a schematic view of a conventional bandpass filter circuit.
Figure 1B:
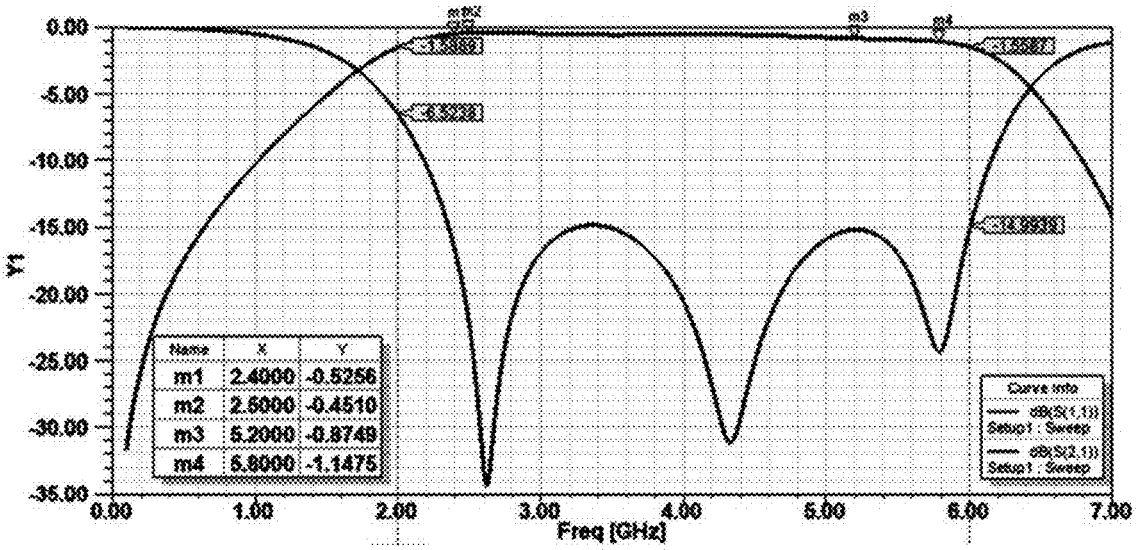
FIG. 1B (PRIOR ART)
FIG. 1B illustrates simulation results of the conventional bandpass filter circuit shown in FIG. 1A.
Figure 2:
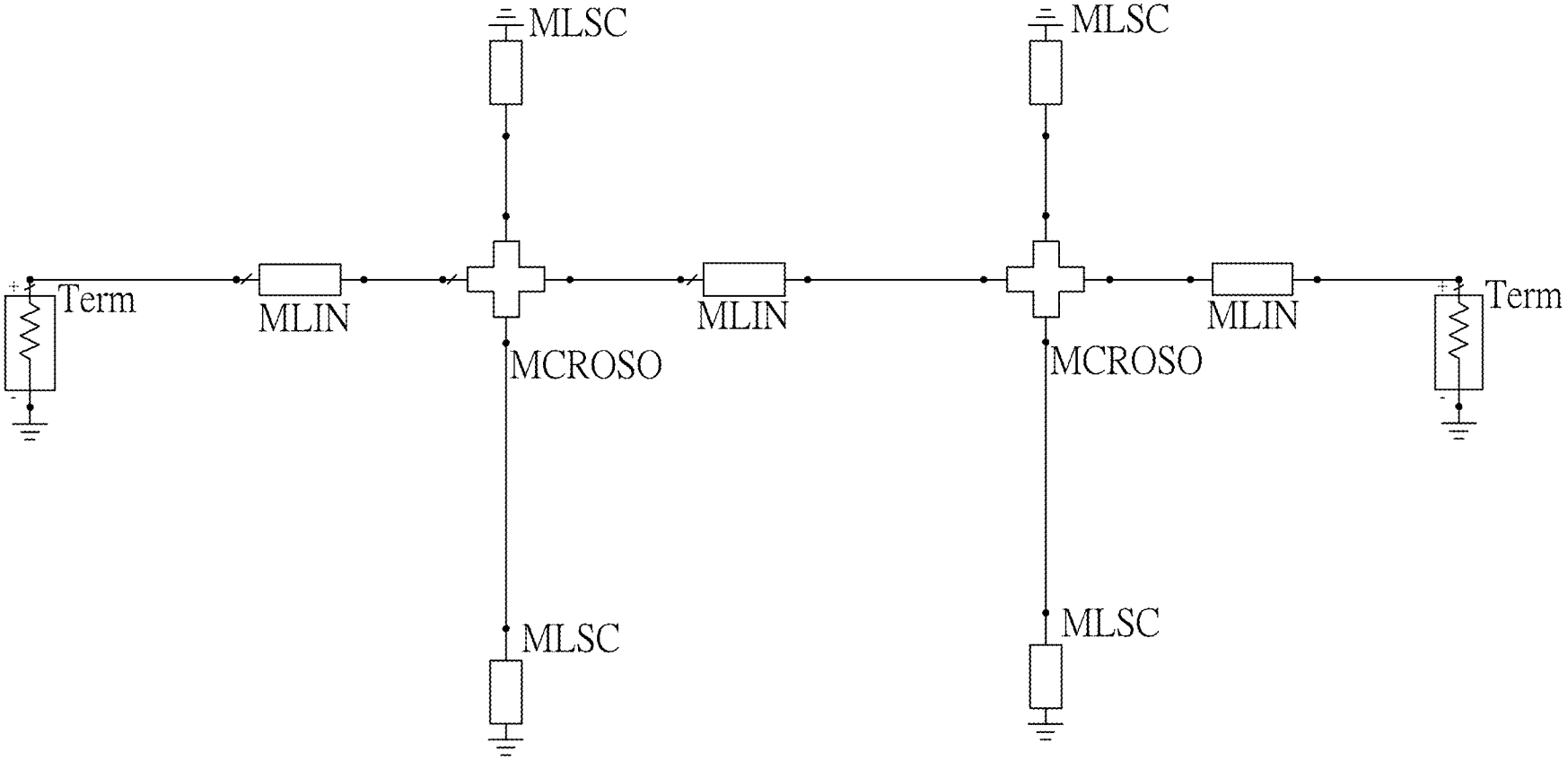
FIG. 2 (PRIOR ART)
FIG. 2 illustrates a simulation circuit diagram of the conventional bandpass filter circuit shown in FIG. 1A.
Figure 3:
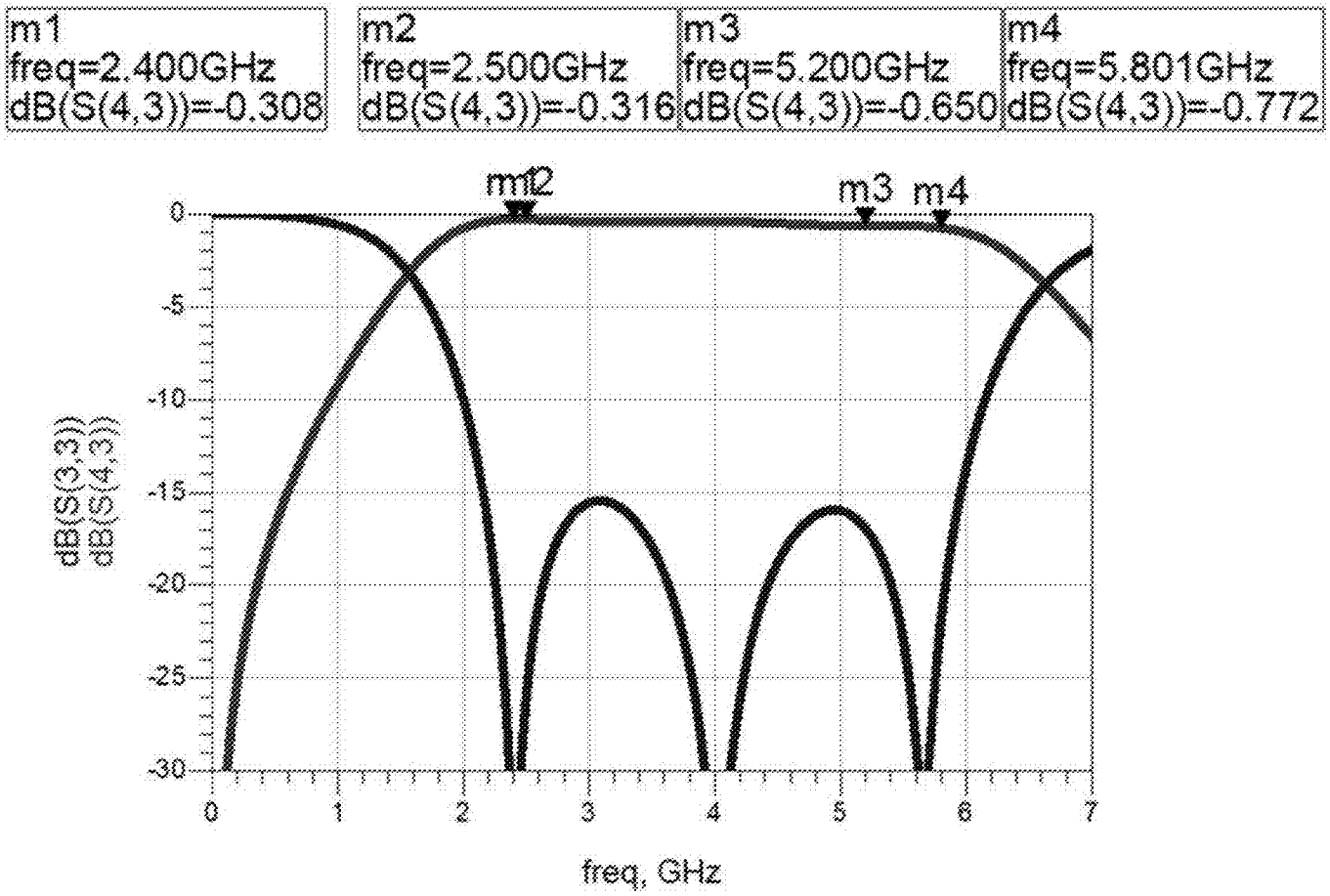
FIG. 3 (PRIOR ART)
FIG. 3 illustrates a schematic view of the simulated S-parameters of the conventional bandpass filter circuit shown in FIG. 1A.

After comparing the curve in FIG. 4B with the curve in FIG. 1B, it can be found that when the frequency is 2-3 GHz, the curve in FIG. 4B is not dropped so deep as the curve in FIG. 1B; that is to say, the drop of the curve caused by the ESD event in the conventional bandpass filter circuit 1 can be obviously improved by the non-common-ground bandpass filter circuit with ESD protection 2 shown in FIG. 4A.

Therefore, according to the simulation results of FIG. 4B, it can be said that the non-common-ground bandpass filter circuit with ESD protection 2 in this embodiment can provide well ESD protection for the circuits electrically connected to it, so that the non-common-ground bandpass filter circuit with ESD protection 2 of the invention can obviously improve the poor ESD protection of the conventional bandpass filter circuit 1 in the prior art.

Then, please refer to FIG. 5A to FIG. 5F. As shown in FIG. 5A to FIG. 5F, the non-common-ground plane can have arbitrary geometry without specific limitations; the shapes of the separated first ground region and second ground region of the non-common-ground plane are complementary to each other.

Figure 6A:
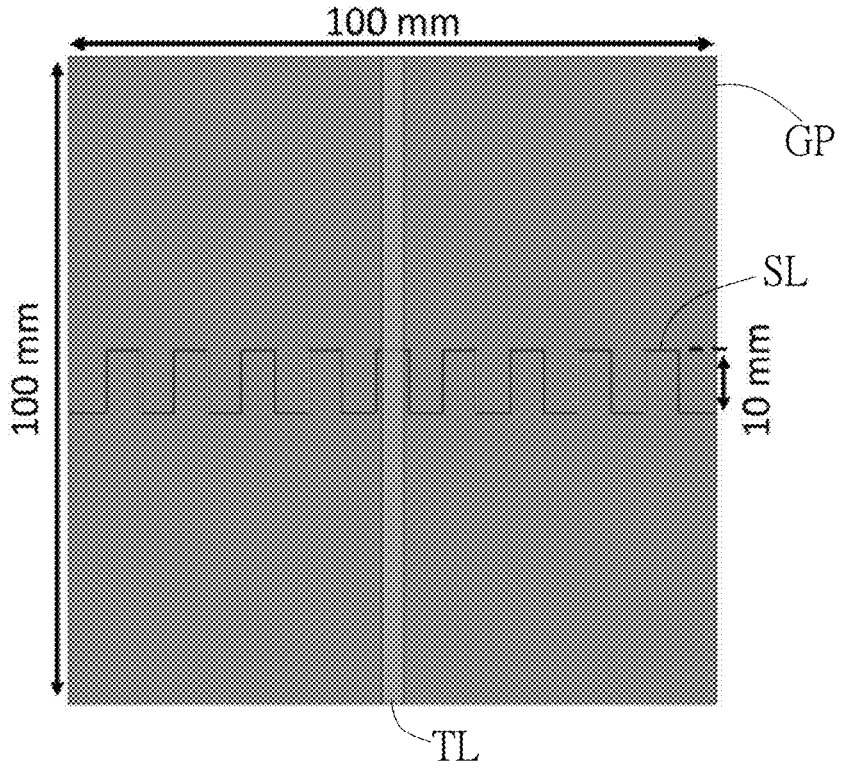
FIG. 6A illustrates a schematic view of 100 mm*100 mm transmission line with a 10 mm interdigital slot.
Figure 6B:
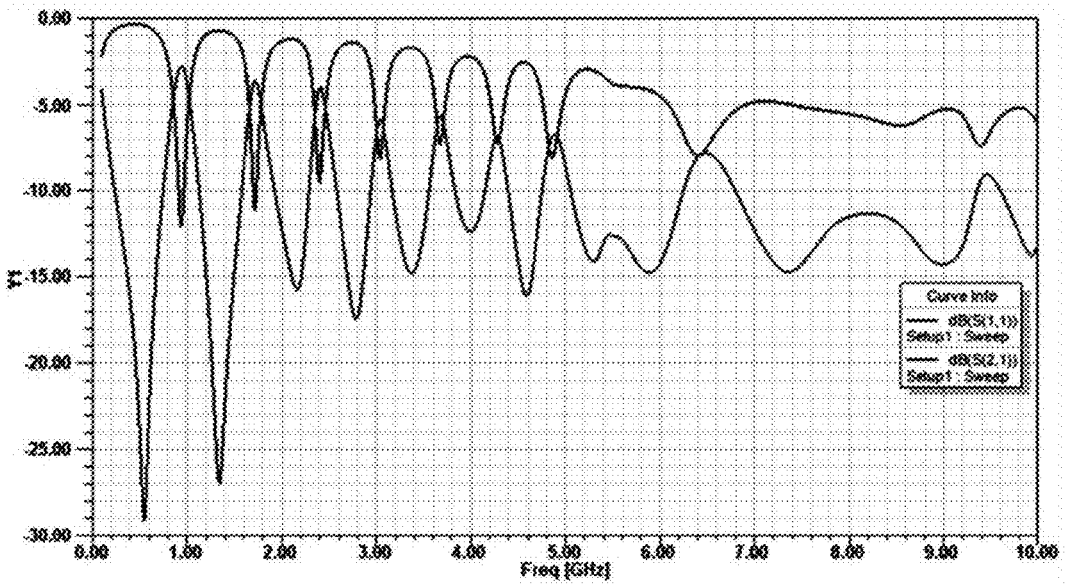
FIG. 6B illustrates simulation results of FIG. 6A.

As shown in FIG. 6A, an interdigital slot SL is disposed on a 100 mm*100 mm non-common-ground plane GP and the height of the interdigital slot SL is 10 mm; a transmission line TL is disposed above the non-common-ground plane GP. And, FIG. 6B illustrates simulation results of FIG. 6A.

Figure 7A:
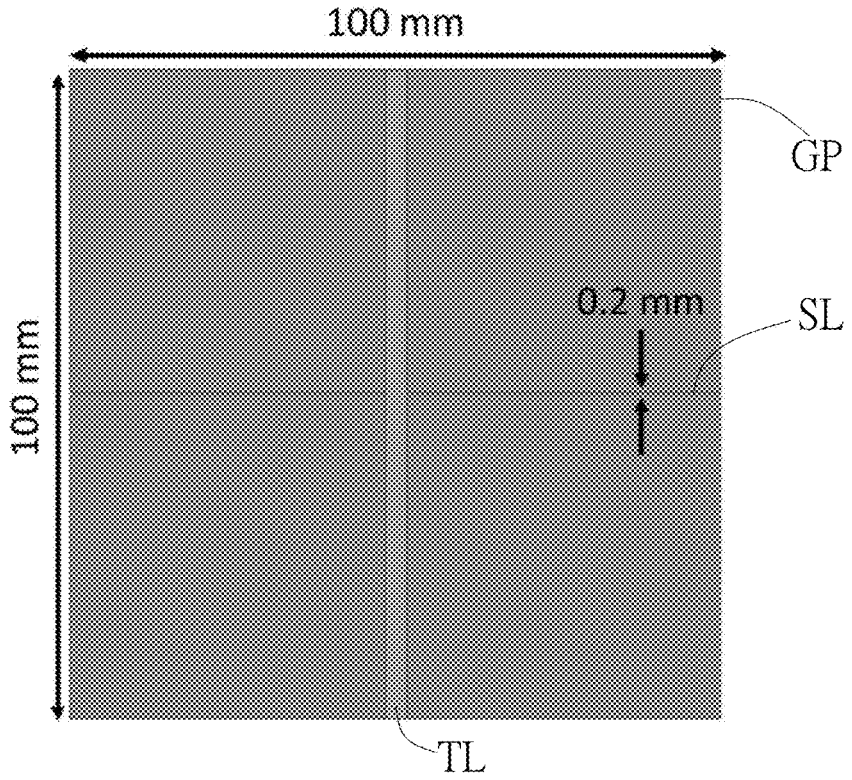
FIG. 7A illustrates a schematic view of 100 mm*100 mm transmission line with a narrow (0.2 mm) slot.
Figure 7B:
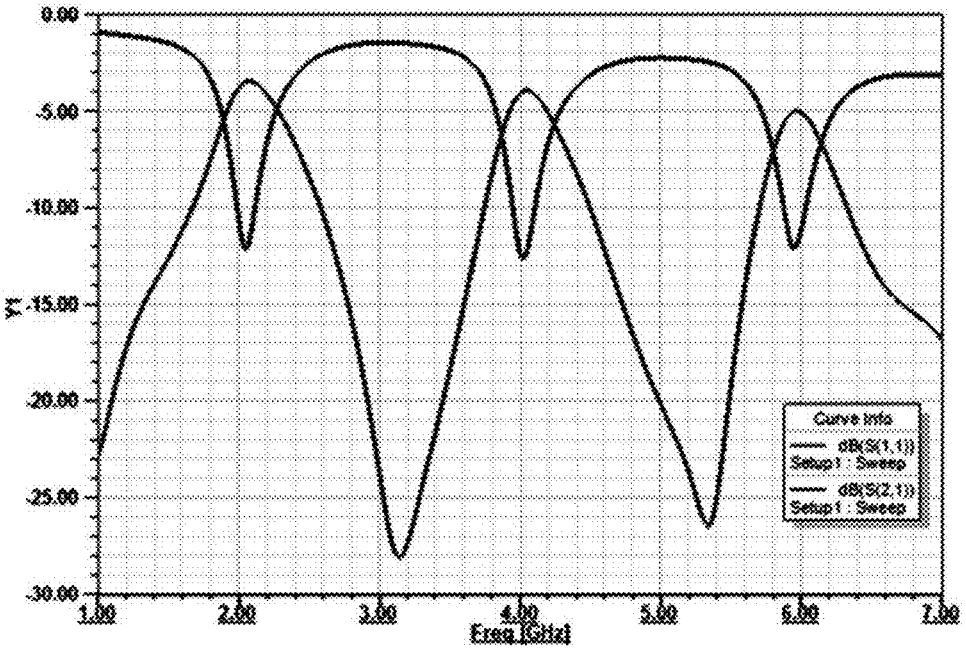
FIG. 7B illustrates simulation results of FIG. 7A.

As shown in FIG. 7A, a narrow slot SL is disposed on a 100 mm*100 mm non-common-ground plane GP and the width of the narrow slot SL is 0.2 mm; a transmission line TL is disposed above the non-common-ground plane GP. And, FIG. 7B illustrates simulation results of FIG. 7A.

Figure 8A:
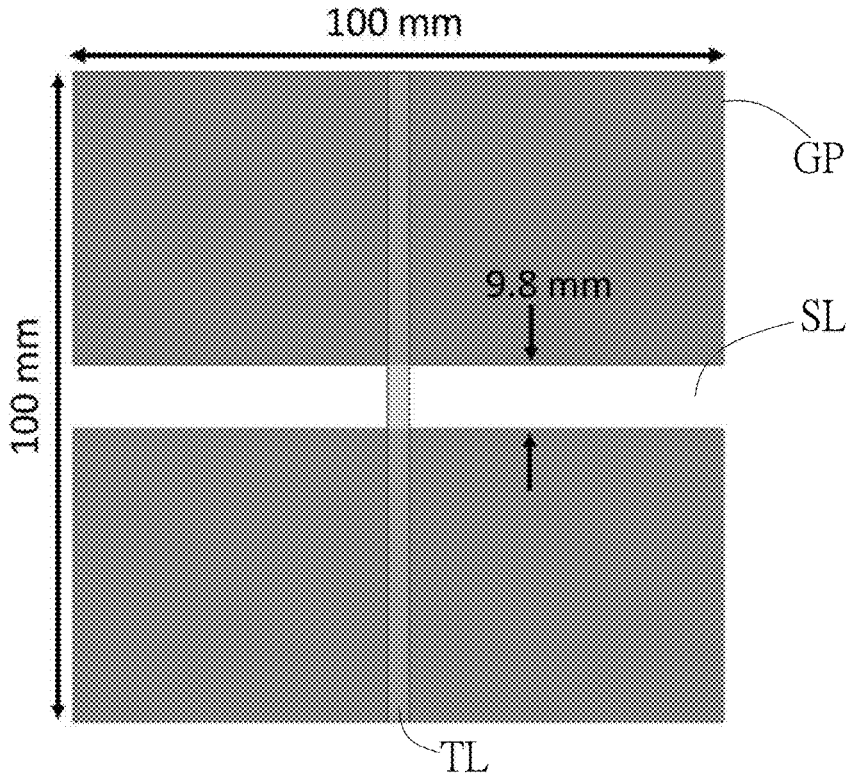
FIG. 8A illustrates a schematic view of 100 mm*100 mm transmission line with a wide (9.8 mm) slot.
Figure 8B:
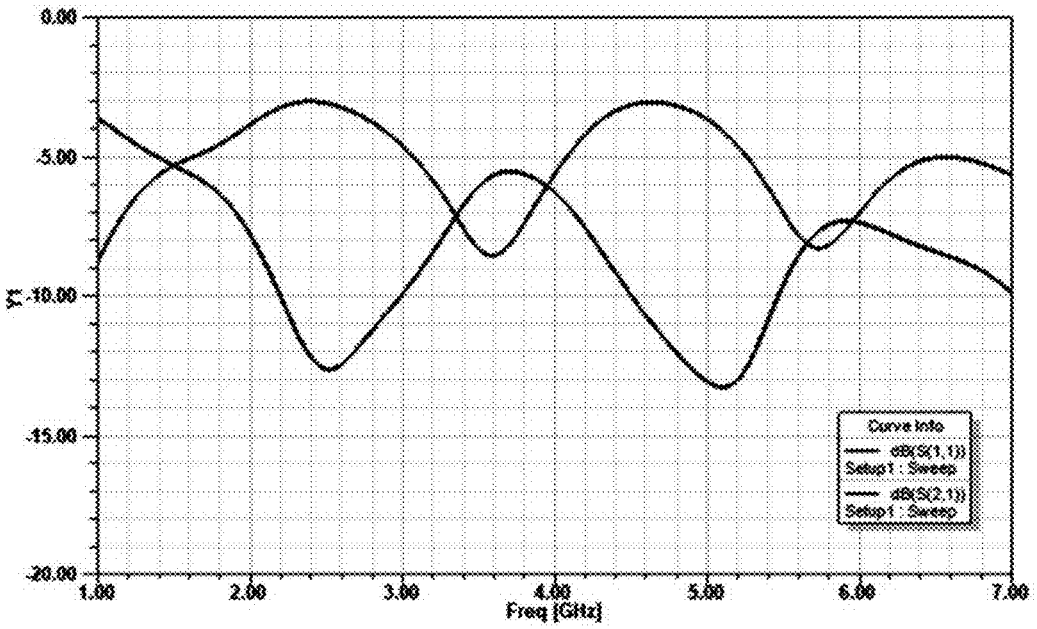
FIG. 8B illustrates simulation results of FIG. 8A.

As shown in FIG. 8A, a wide slot SL is disposed on a 100 mm*100 mm non-common-ground plane GP and the width of the narrow slot SL is 9.8 mm; a transmission line TL is disposed above the non-common-ground plane GP. And, FIG. 8B illustrates simulation results of FIG. 8A.

Figure 9A:
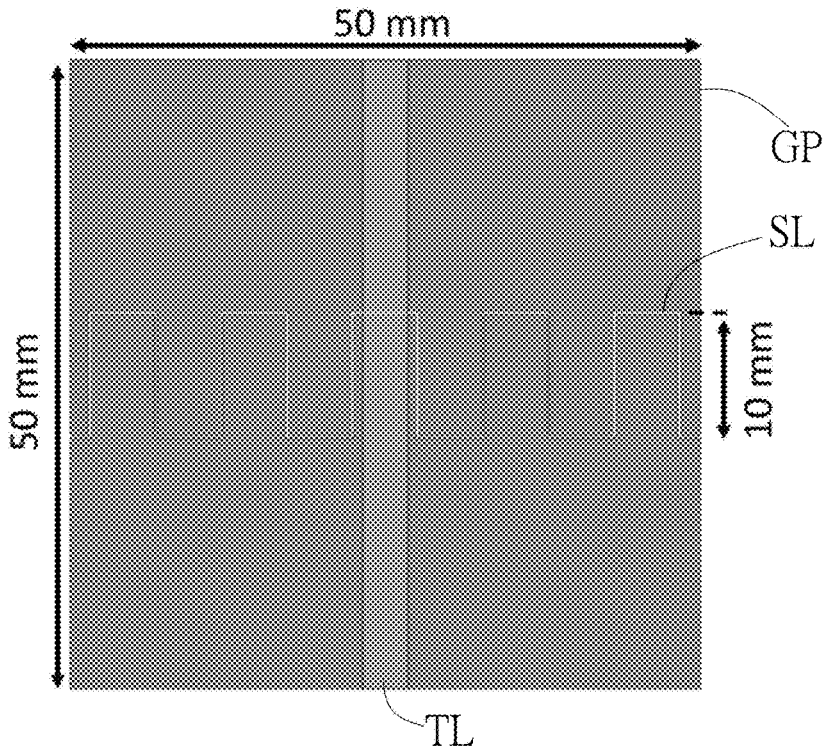
FIG. 9A illustrates a schematic view of 50 mm*50 mm transmission line with a 10 mm interdigital slot.
Figure 9B:
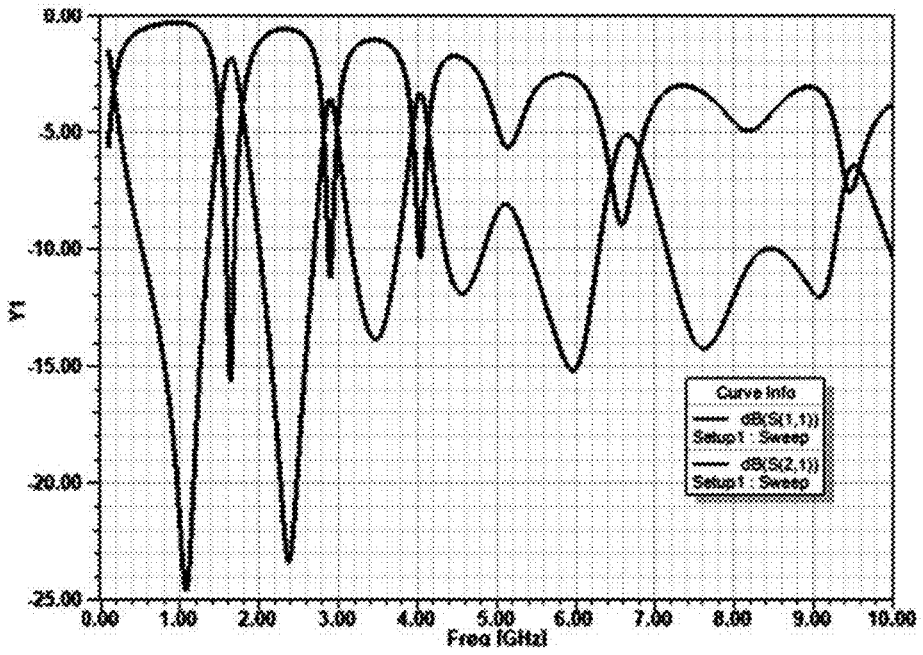
FIG. 9B illustrates simulation results of FIG. 9A.

As shown in FIG. 9A, an interdigital slot SL is disposed on a 50 mm*50 mm non-common-ground plane GP and the height of the interdigital slot SL is 10 mm, that is to say, the height of the interdigital slot SL of FIG. 9A is the same with the height of the interdigital slot SL of FIG. 6A, but the size of the non-common-ground plane GP of FIG. 9A is smaller than the size of the non-common-ground plane GP of FIG. 6A; a transmission line TL is disposed above the non-common-ground plane GP. And, FIG. 9B illustrates simulation results of FIG. 9A.

Figure 10A:
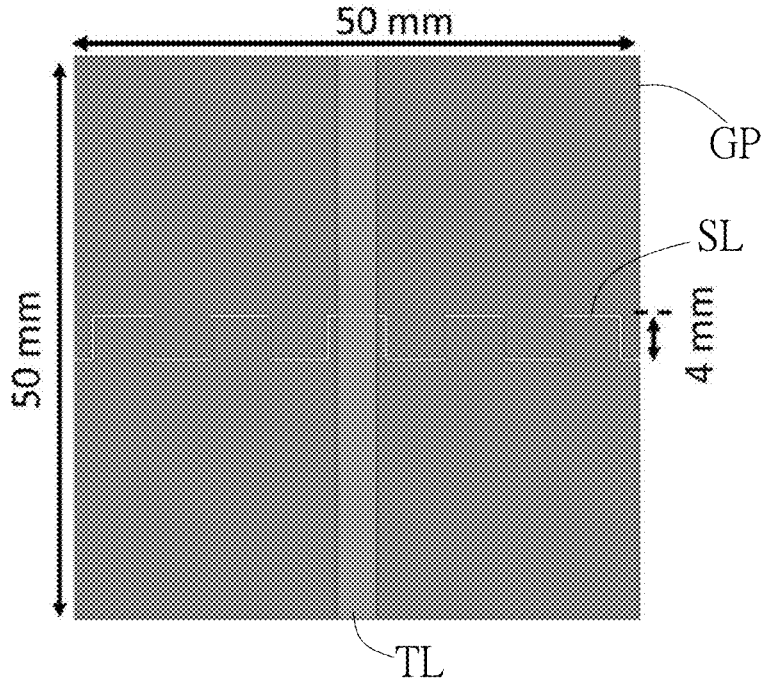
FIG. 10A illustrates a schematic view of 50 mm*50 mm transmission line with a 4 mm interdigital slot.
Figure 10B:
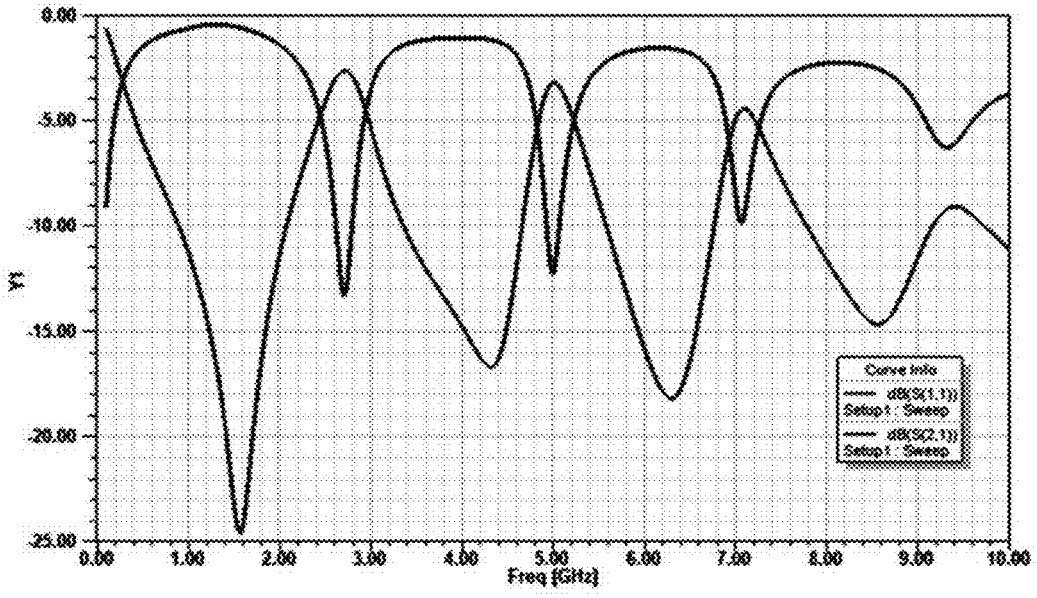
FIG. 10B illustrates simulation results of FIG. 10A.

As shown in FIG. 10A, an interdigital slot SL is disposed on a 50 mm*50 mm non-common-ground plane GP and the height of the interdigital slot SL is 4 mm, that is to say, the size of the non-common-ground plane GP of FIG. 10A is the same with the size of the non-common-ground plane GP of FIG. 9A, but the height of the interdigital slot SL of FIG. 10A is smaller than the height of the interdigital slot SL of FIG. 9A. And, FIG. 10B illustrates simulation results of FIG. 10A.

Figure 11A:
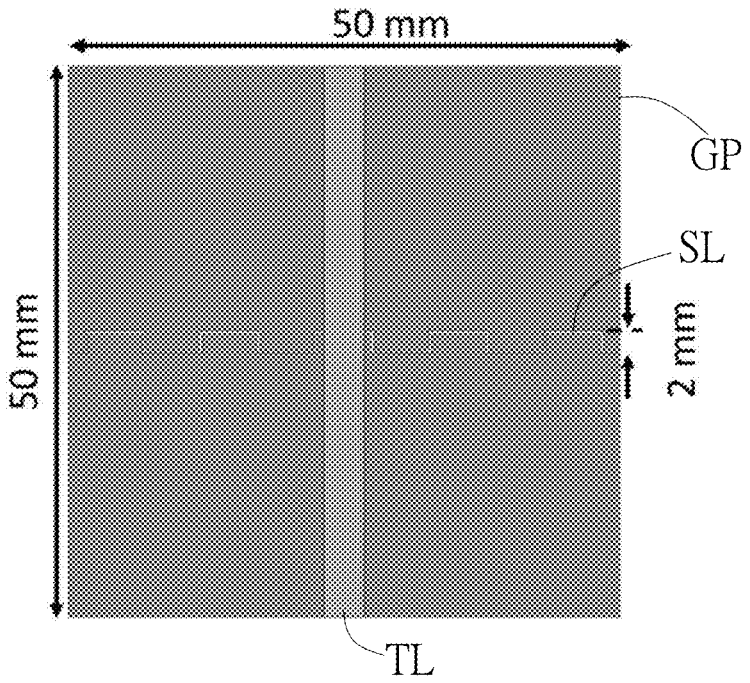
FIG. 11A illustrates a schematic view of 50 mm*50 mm transmission line with a 2 mm interdigital slot.
Figure 11B:
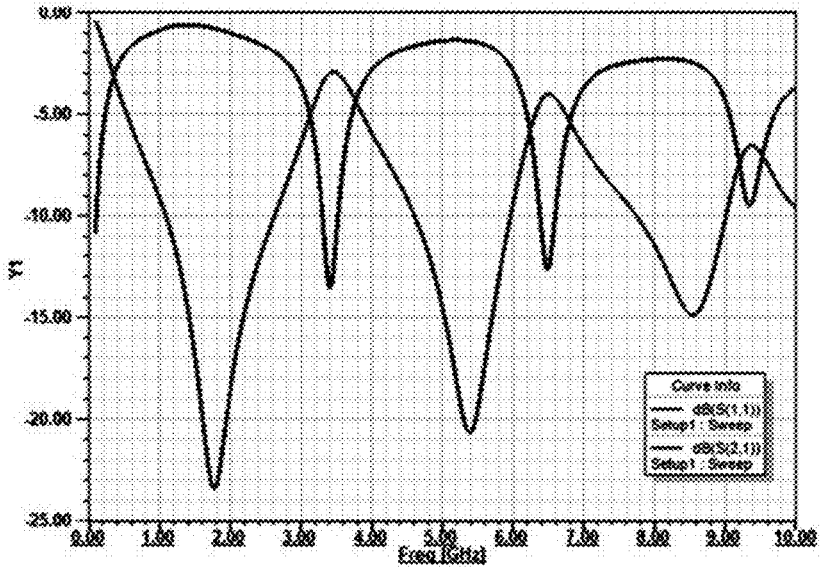
FIG. 11B illustrates simulation results of FIG. 11A.

As shown in FIG. 11A, an interdigital slot SL is disposed on a 50 mm*50 mm non-common-ground plane GP and the height of the interdigital slot SL is 2 mm, that is to say, the size of the non-common-ground plane GP of FIG. 11A is the same with the size of the non-common-ground plane GP of FIG. 10A, but the height of the interdigital slot SL of FIG. 11A is smaller than the height of the interdigital slot SL of FIG. 10A. And, FIG. 11B illustrates simulation results of FIG. 11A.

Figure 12A:
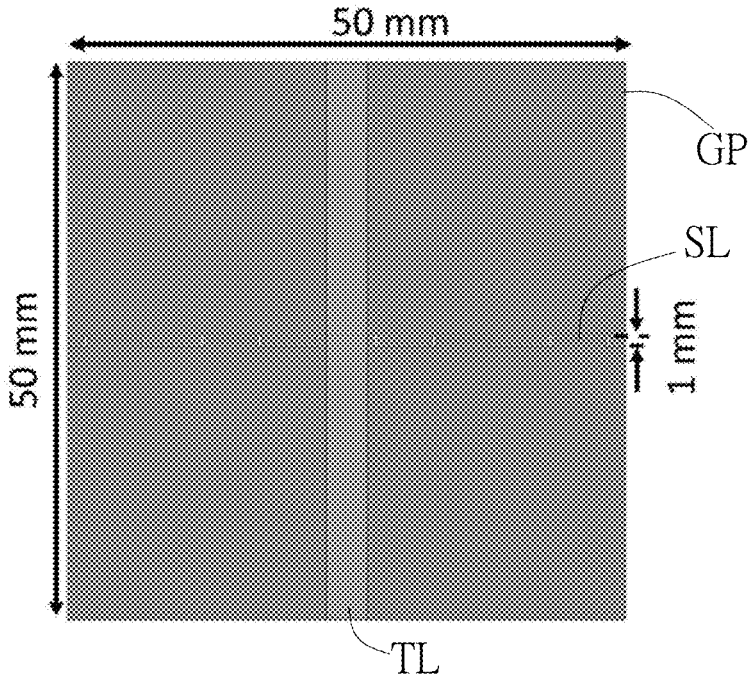
FIG. 12A illustrates a schematic view of 50 mm*50 mm transmission line with a 1 mm interdigital slot.
Figure 12B:
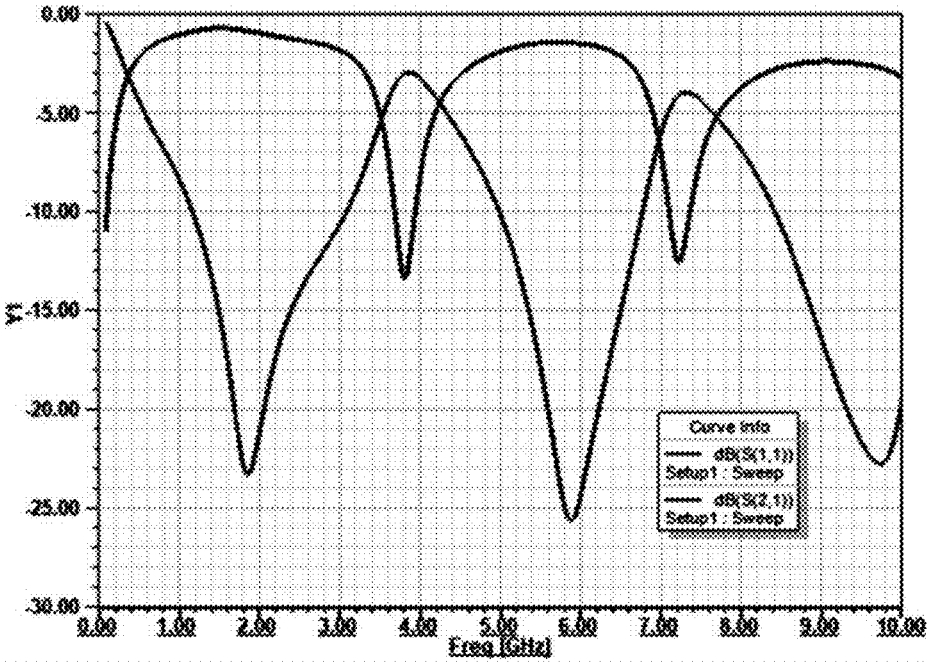
FIG. 12B illustrates simulation results of FIG. 12A.

As shown in FIG. 12A, an interdigital slot SL is disposed on a 50 mm*50 mm non-common-ground plane GP and the height of the interdigital slot SL is 1 mm, that is to say, the size of the non-common-ground plane GP of FIG. 12A is the same with the size of the non-common-ground plane GP of FIG. 11A, but the height of the interdigital slot SL of FIG. 12A is smaller than the height of the interdigital slot SL of FIG. 11A. And, FIG. 12B illustrates simulation results of FIG. 12A.

Figure 13A:
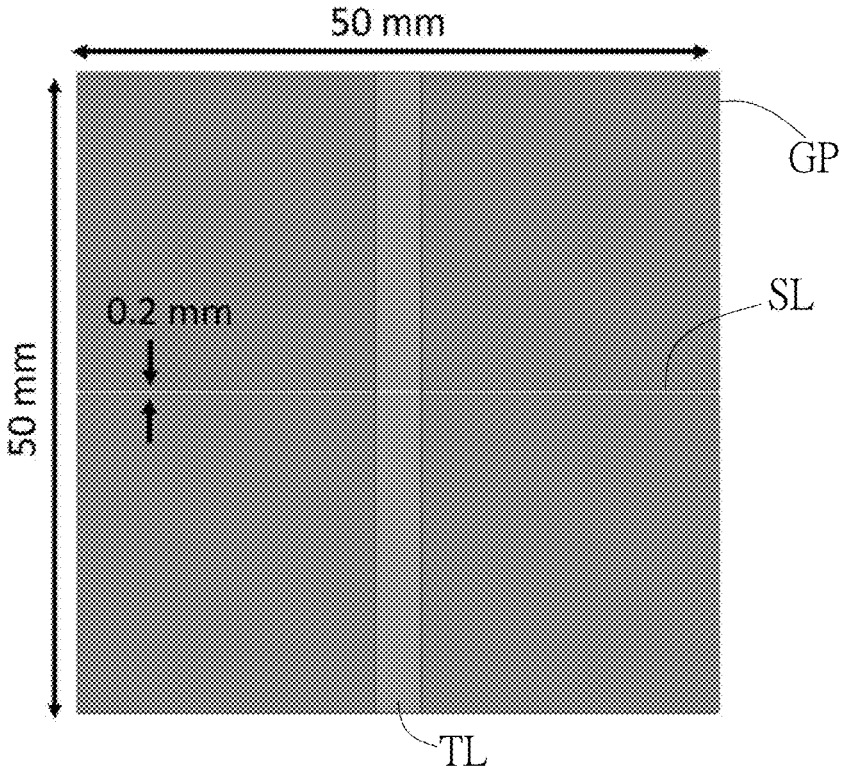
FIG. 13A illustrates a schematic view of 50 mm*50 mm transmission line with a narrow (0.2 mm) slot.
Figure 13B:
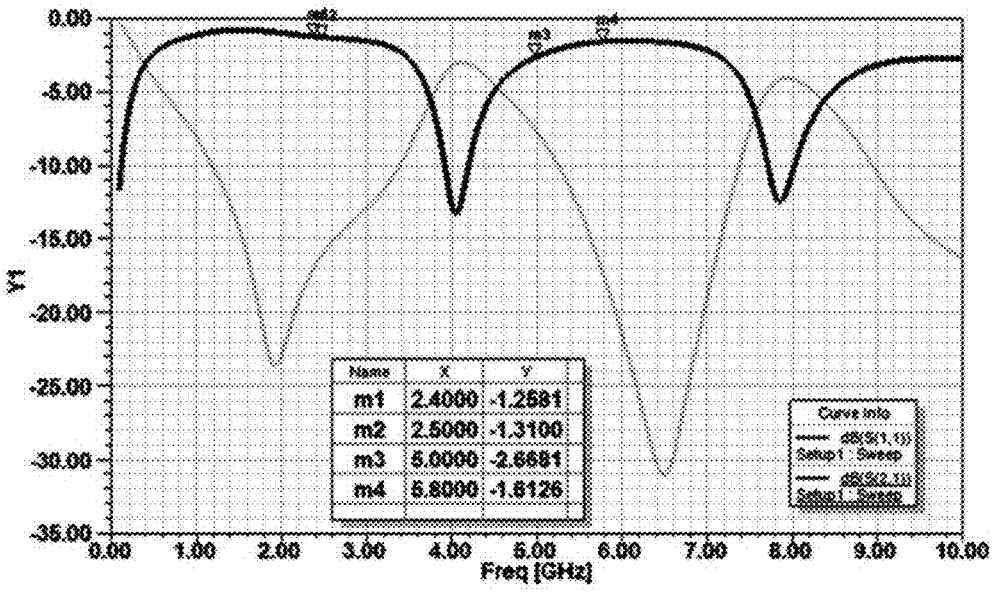
FIG. 13B illustrates simulation results of FIG. 13A.

As shown in FIG. 13A, a narrow slot SL is disposed on a 50 mm*50 mm non-common-ground plane GP and the width of the narrow slot SL is 0.2 mm; a transmission line TL is disposed above the non-common-ground plane GP. And, FIG. 13B illustrates simulation results of FIG. 13A.

Figure 14A:
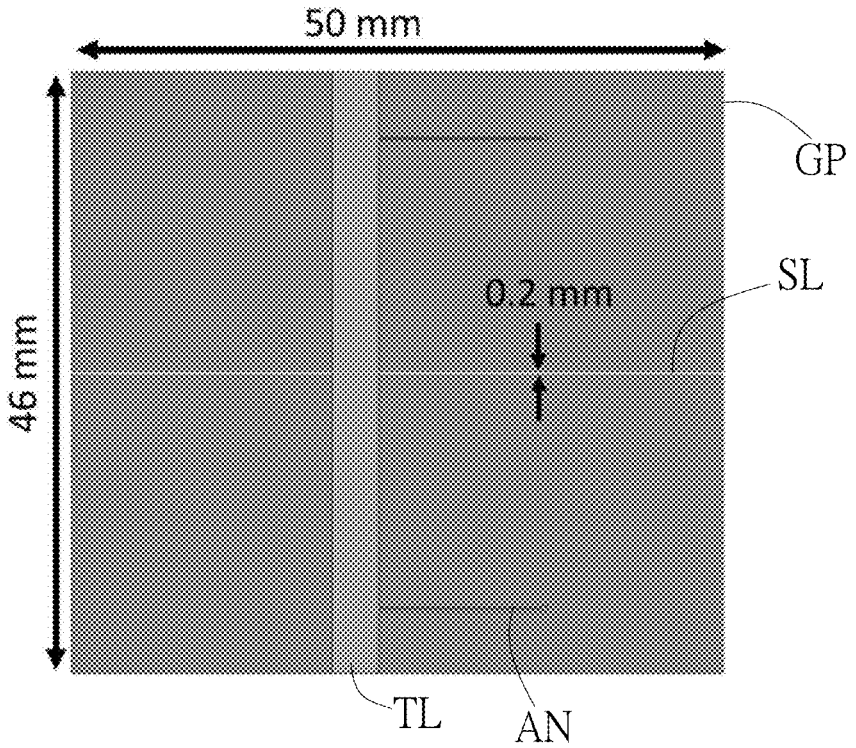
FIG. 14A illustrates a schematic view of 46 mm*50 mm non-common-ground bandpass filter circuit with a defected ground plane (Type 1) having a narrow (0.2 mm) slot.
Figure 14B:
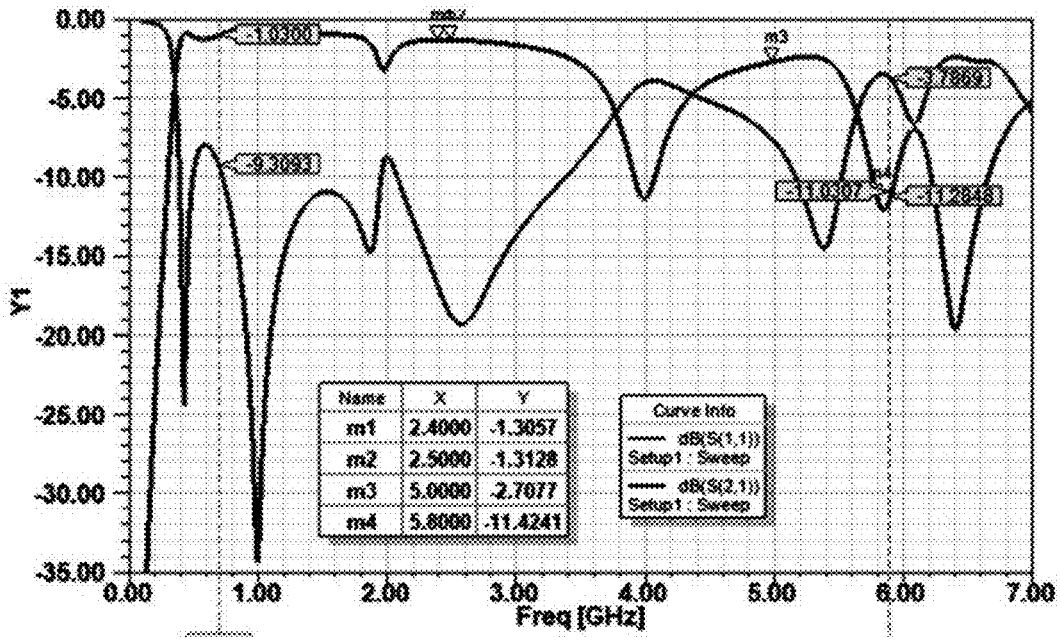
FIG. 14B illustrates simulation results of FIG. 14A.

As shown in FIG. 14A, the non-common-ground bandpass filter circuit has a 46 mm*50 mm defected ground plane (Type 1) GP having a narrow slot SL (width=0.2 mm); the transmission line TL and the antenna AN are disposed above the non-common-ground plane GP. The antenna AN can be coupled to the ground through the via, but not limited to this. And, FIG. 14B illustrates simulation results of FIG. 14A.

Figure 15A:
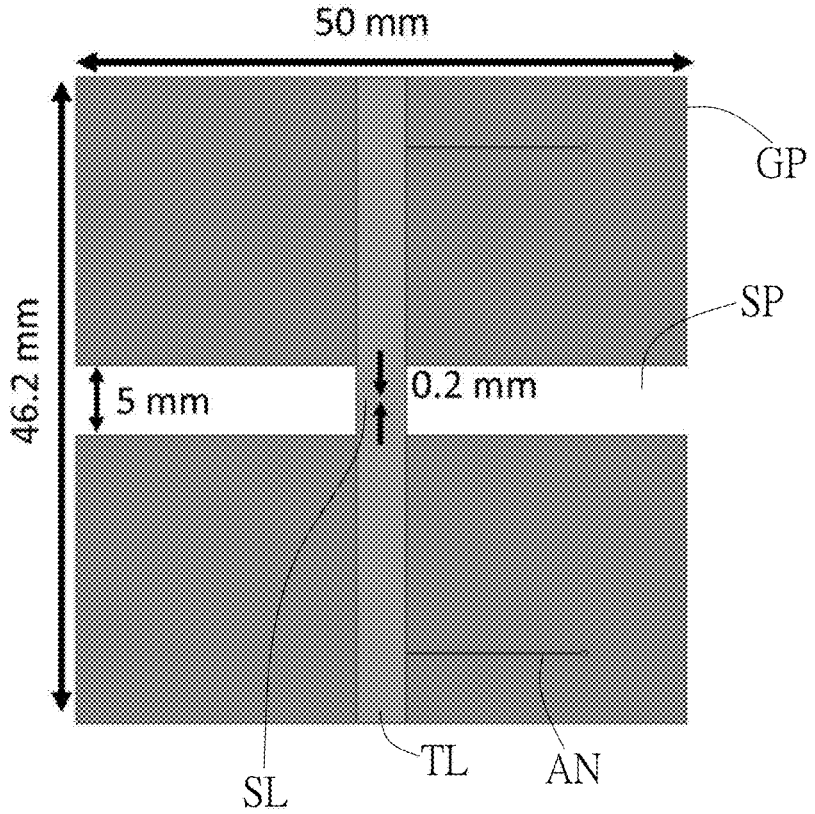
FIG. 15A illustrates a schematic view of 46 mm*50 mm non-common-ground bandpass filter circuit with a defected ground plane (Type 2) having a wide (5 mm) slot.
Figure 15B:
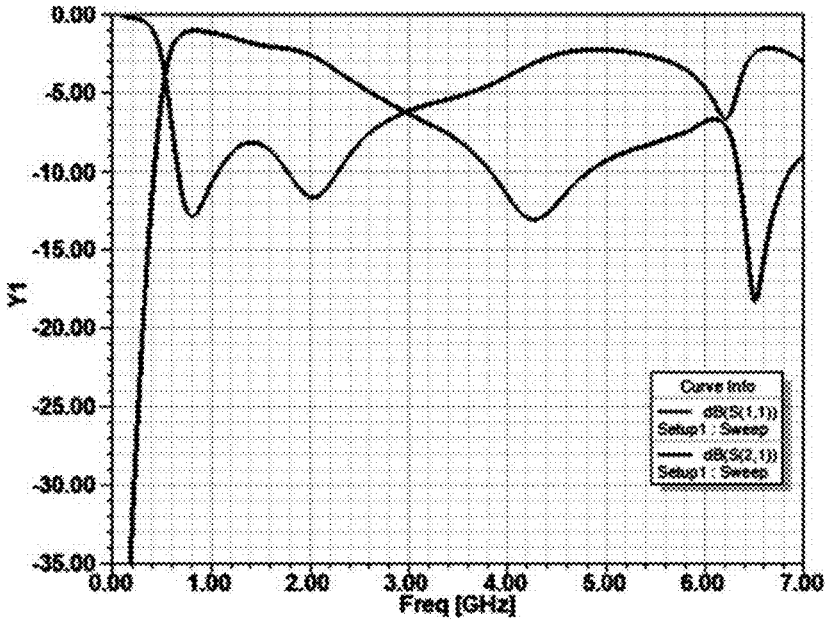
FIG. 15B illustrates simulation results of FIG. 15A.

As shown in FIG. 15A, the non-common-ground bandpass filter circuit has a 46 mm*50 mm defected ground plane (Type 2) GP having a wide space SP (width=5 mm) and a narrow slot SL (width=0.2 mm) which are connected; the transmission line TL and the antenna AN are disposed above the non-common-ground plane GP. The antenna AN can be coupled to the ground through the via, but not limited to this. And, FIG. 15B illustrates simulation results of FIG. 15A.

Figure 16A:
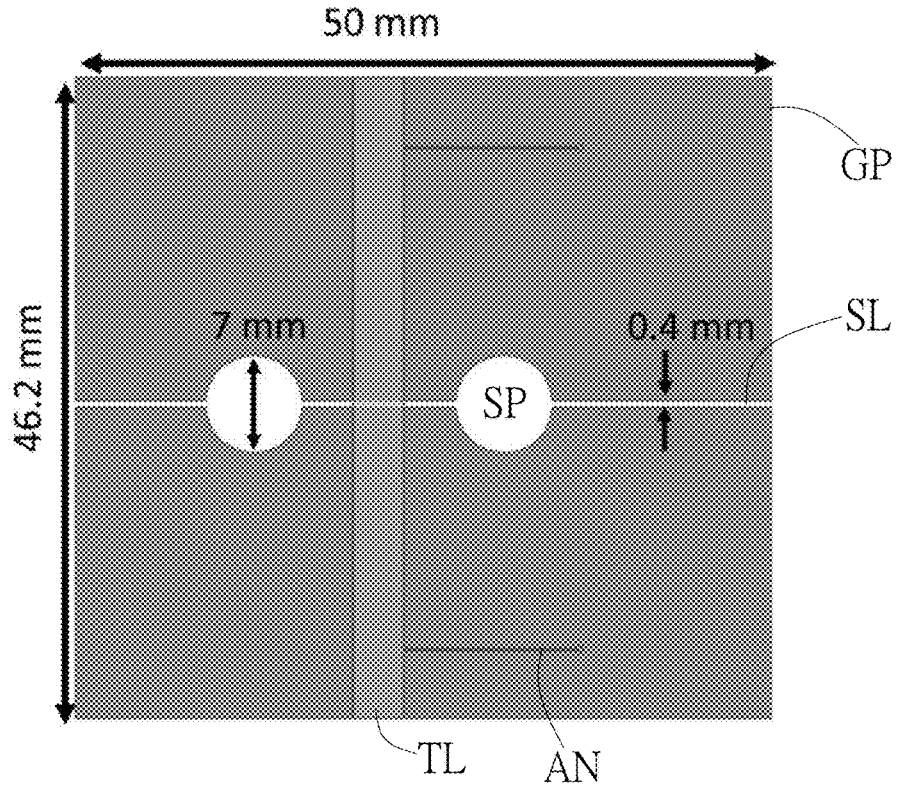
FIG. 16A illustrates a schematic view of 46 mm*50 mm non-common-ground bandpass filter circuit with a defected ground plane (Type 3) having a narrow (0.4 mm) slot and two round spaces.
Figure 16B:
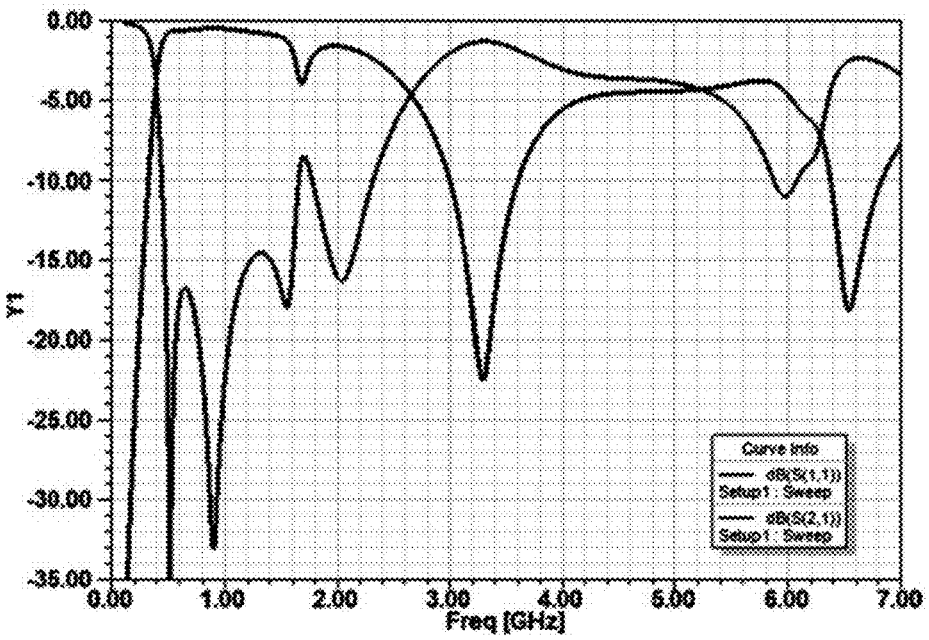
FIG. 16B illustrates simulation results of FIG. 16A.

As shown in FIG. 16A, the non-common-ground bandpass filter circuit has a 46 mm*50 mm defected ground plane (Type 3) GP having a narrow slot SL (width=0.4 mm) and two round spaces (diameter=7 mm) which are connected through the narrow slot SL. The antenna AN can be coupled to the ground through the via, but not limited to this. And, FIG. 16B illustrates simulation results of FIG. 16A.

Figure 17A:
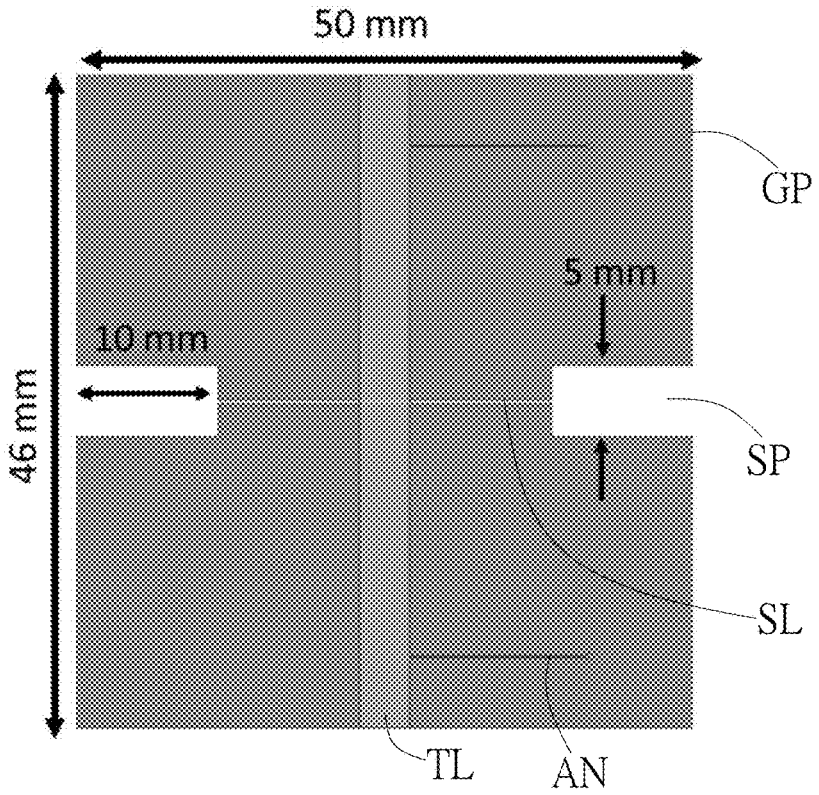
FIG. 17A illustrates a schematic view of 46 mm*50 mm non-common-ground bandpass filter circuit with a defected ground plane (Type 4) having a narrow (0.2 mm) slot and two rectangle spaces (10 mm*5 mm).
Figure 17B:
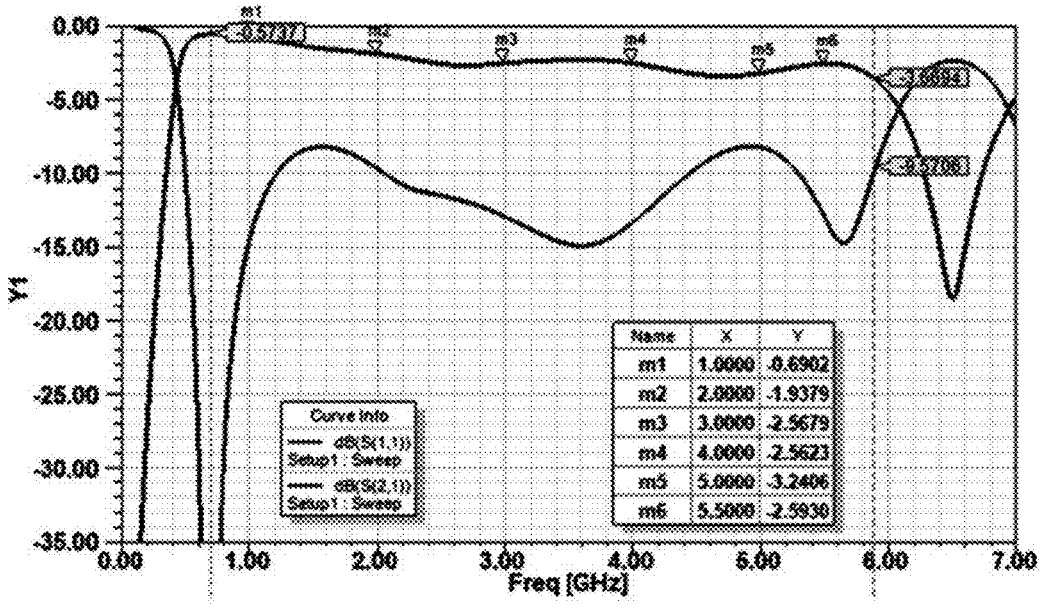
FIG. 17B illustrates simulation results of FIG. 17A.

As shown in FIG. 17A, the non-common-ground bandpass filter circuit has a 46 mm*50 mm defected ground plane (Type 4) GP having a narrow slot SL (width=0.2 mm) and two rectangle spaces (size=10 mm*5 mm) which are connected through the narrow slot SL. The antenna AN can be coupled to the ground through the via, but not limited to this. And, FIG. 17B illustrates simulation results of FIG. 17A.

Figure 18A:
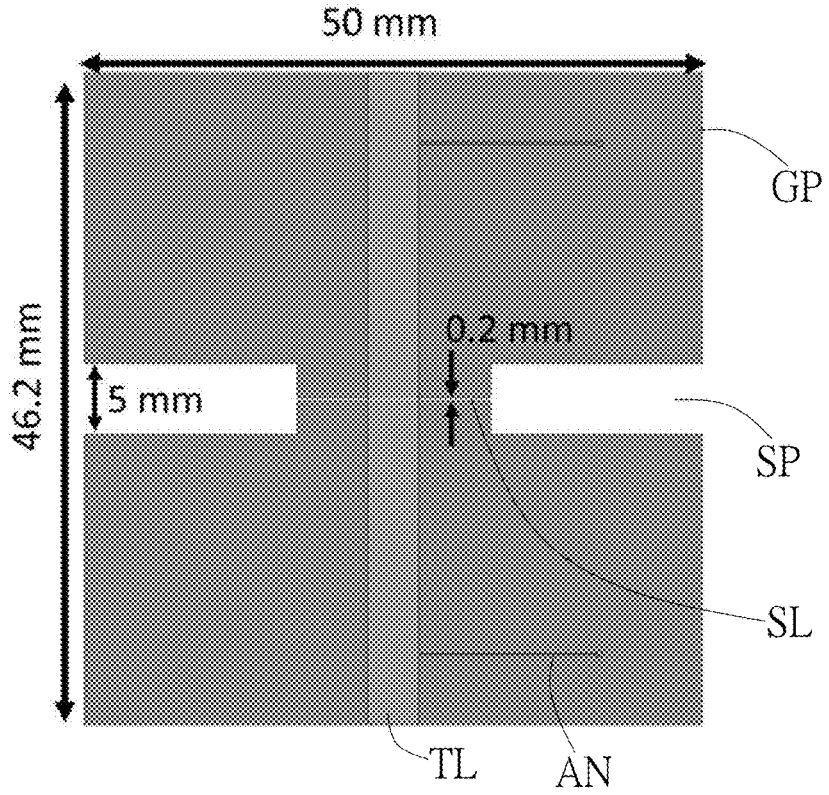
FIG. 18A illustrates a schematic view of 46 mm*50 mm non-common-ground bandpass filter circuit with a defected ground plane (Type 4) having a narrow (0.2 mm) slot and two rectangle spaces (15 mm*5 mm).
Figure 18B:
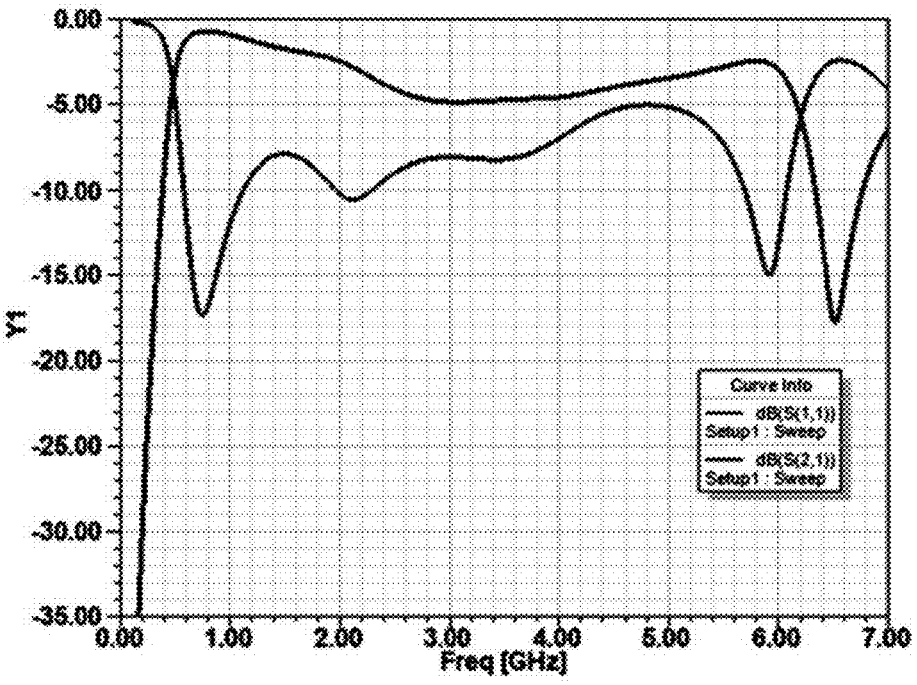
FIG. 18B illustrates simulation results of FIG. 18A.

As shown in FIG. 18A, the non-common-ground bandpass filter circuit has a 46 mm*50 mm defected ground plane (Type 4) GP having a narrow slot SL (width=0.2 mm) and two rectangle spaces (size=15 mm*5 mm) which are connected through the narrow slot SL. The antenna AN can be coupled to the ground through the via, but not limited to this. And, FIG. 18B illustrates simulation results of FIG. 18A.

Figure 19A:
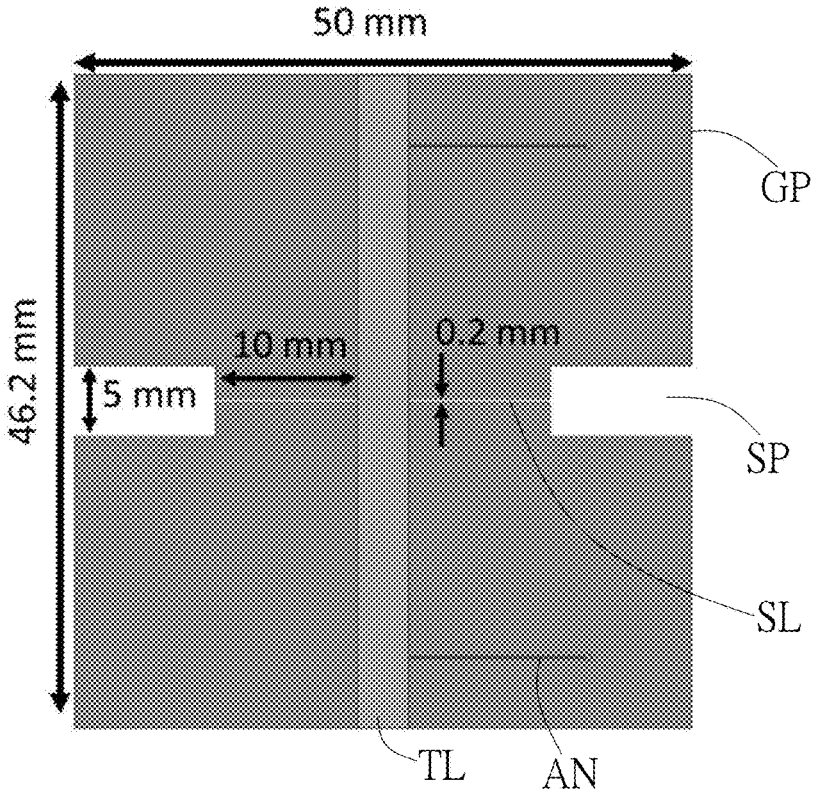
FIG. 19A illustrates a schematic view of 46 mm*50 mm non-common-ground bandpass filter circuit with a defected ground plane (Type 4) having a narrow (0.2 mm) slot and two rectangle spaces (10 mm*5 mm).
Figure 19B:
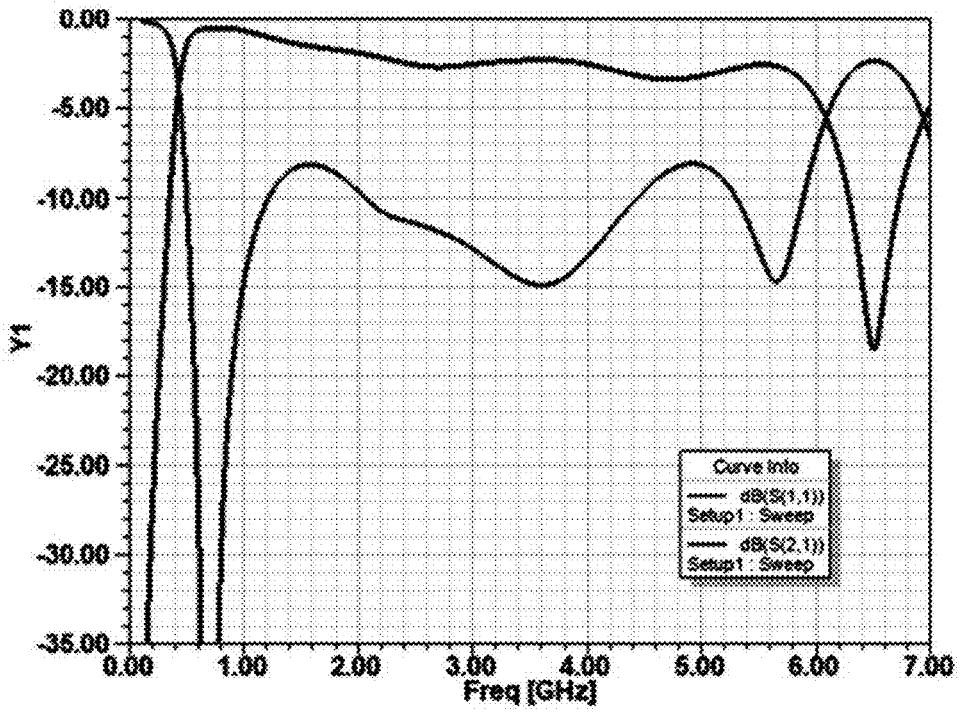
FIG. 19B illustrates simulation results of FIG. 19A.

As shown in FIG. 19A, the non-common-ground bandpass filter circuit has a 46 mm*50 mm defected ground plane (Type 4) GP having a narrow slot SL (width=0.2 mm) and two rectangle spaces (size=10 mm*5 mm) which are connected through the narrow slot SL. The antenna AN can be coupled to the ground through the via, but not limited to this. And, FIG. 19B illustrates simulation results of FIG. 19A.

Figure 20A:
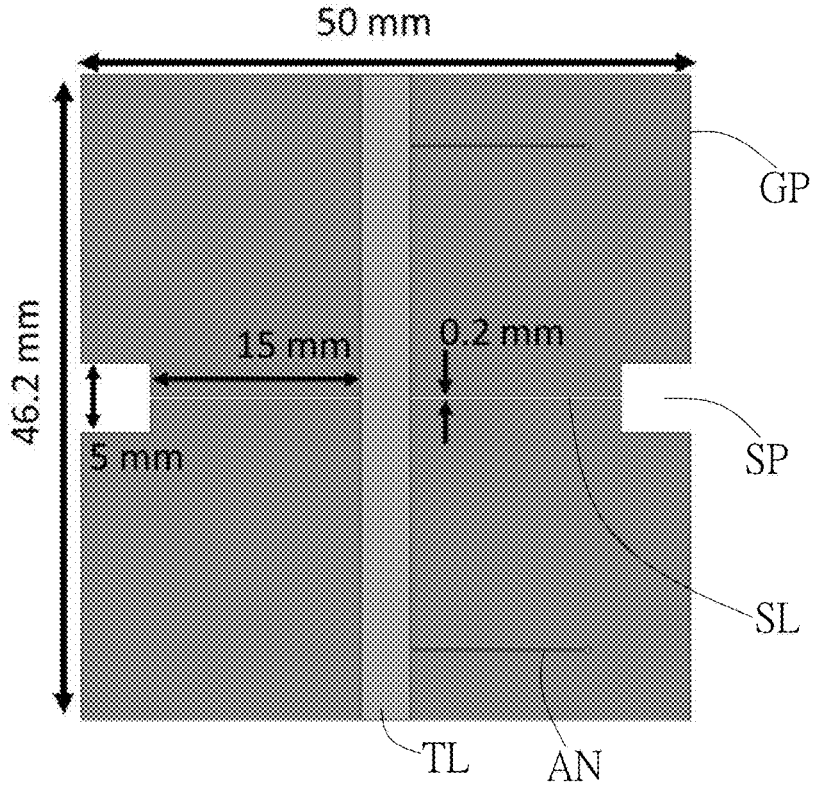
FIG. 20A illustrates a schematic view of 46 mm*50 mm non-common-ground bandpass filter circuit with a defected ground plane (Type 4) having a narrow (0.2 mm) slot and two square spaces (5 mm*5 mm).
Figure 20B:
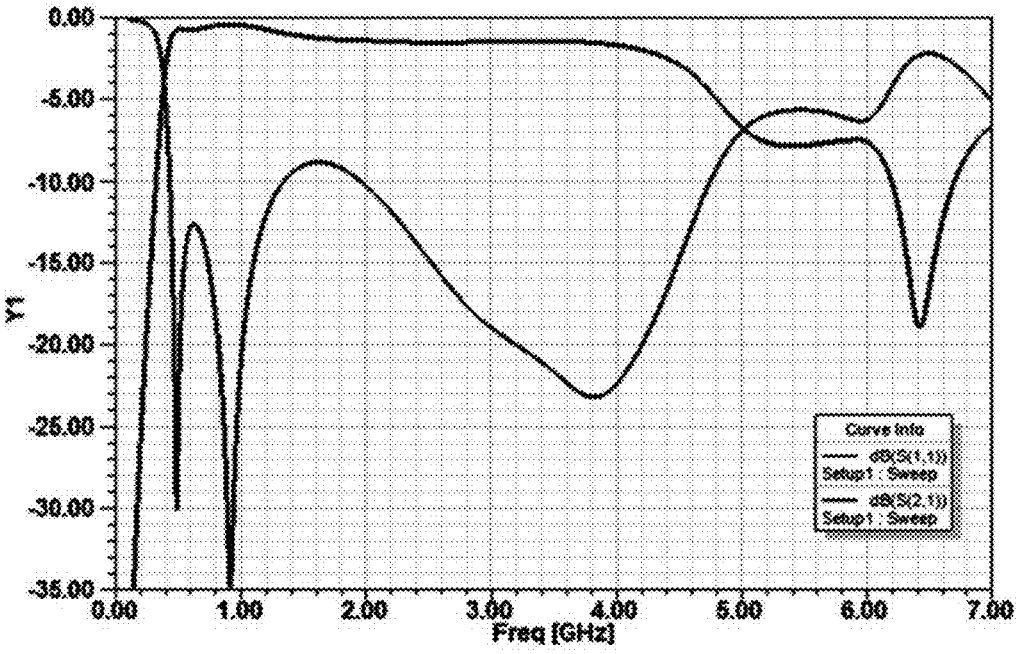
FIG. 20B illustrates simulation results of FIG. 20A.

As shown in FIG. 20A, the non-common-ground band-pass filter circuit has a 46 mm*50 mm defected ground plane (Type 4) GP having a narrow slot SL (width=0.2 mm) and two rectangle spaces (size=5 mm*5 mm) which are connected through the narrow slot SL. The antenna AN can be coupled to the ground through the via, but not limited to this. And, FIG. 20B illustrates simulation results of FIG. 20A.

Figure 21A:
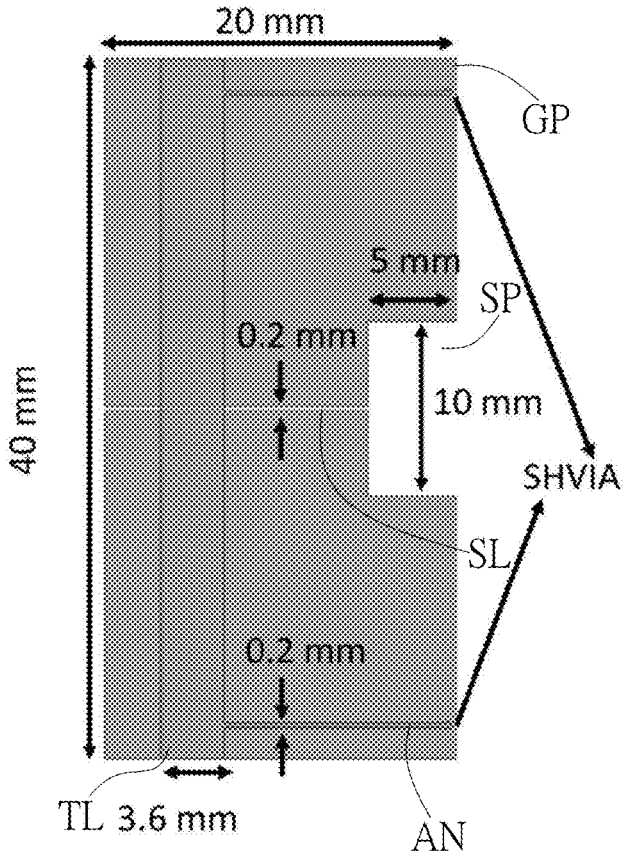
FIG. 21A illustrates a schematic view of 40 mm*20 mm non-common-ground bandpass filter circuit with a defected ground plane (Type 1) having a narrow (0.2 mm) slot and one rectangle space (5 mm*10 mm).
Figure 21B:
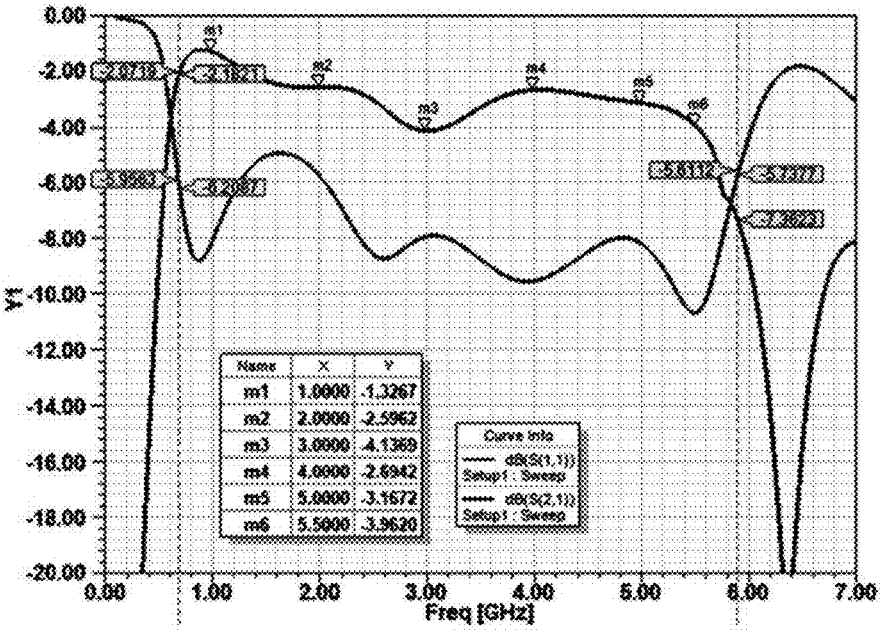
FIG. 21B illustrates simulation results of FIG. 21A.

As shown in FIG. 21A, the non-common-ground band-pass filter circuit has a 40 mm*20 mm defected ground plane (Type 1) GP having a narrow slot SL (width=0.2 mm) and one rectangle space (size=5 mm*10 mm) which are connected. The antenna AN can be coupled to the ground through the via SHVIA, but not limited to this. And, FIG. 21B illustrates simulation results of FIG. 21A.

Figure 22A:
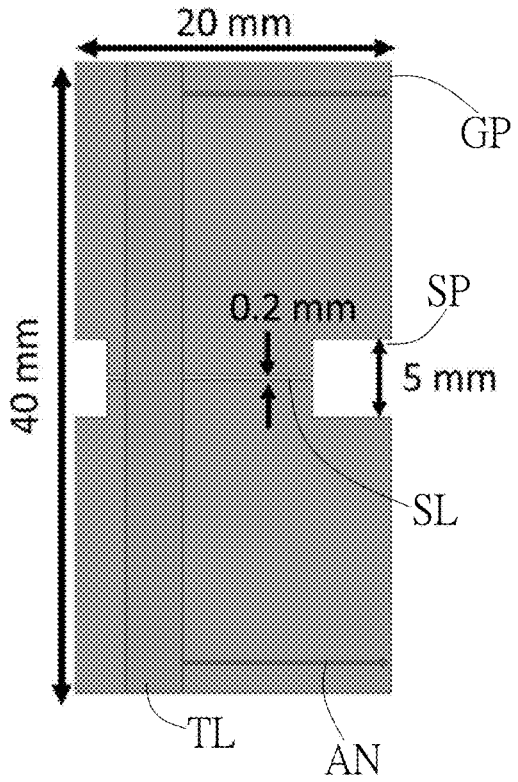
FIG. 22A illustrates a schematic view of 40 mm*20 mm non-common-ground bandpass filter circuit with a defected ground plane (Type 2) having a narrow (0.2 mm) slot, one rectangle space (2.5 mm*5 mm) and one square space (5 mm*5 mm), wherein the rectangle space (2.5 mm*5 mm) and the square space (5 mm*5 mm) are separated.
Figure 22B:
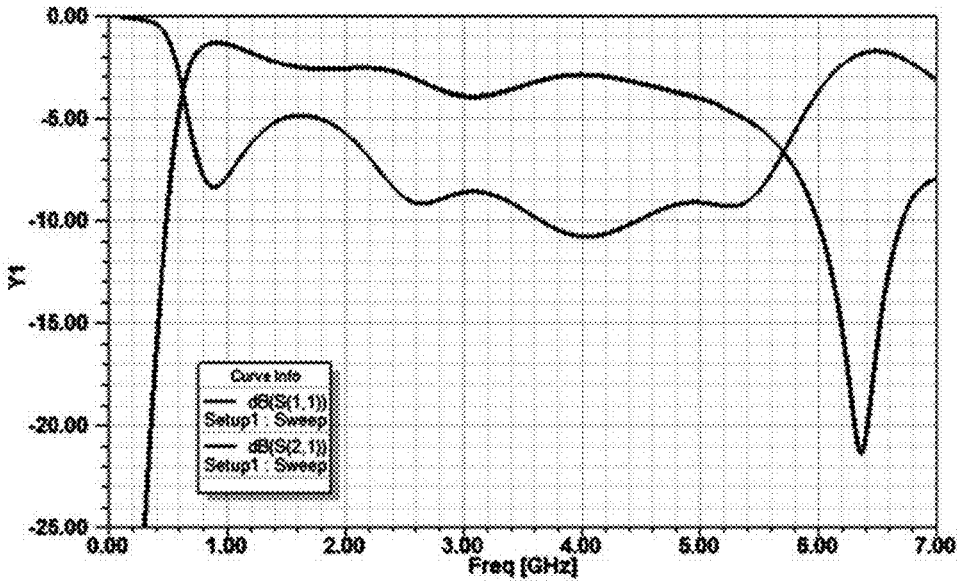
FIG. 22B illustrates simulation results of FIG. 22A.

As shown in FIG. 22A, the non-common-ground band-pass filter circuit has a 40 mm*20 mm defected ground plane (Type 2) GP having a narrow slot SL (width=0.2 mm), one rectangle space (size=2.5 mm*5 mm) and one square space (size=5 mm*5 mm), wherein the rectangle space (2.5 mm*5 mm) and the square space (5 mm*5 mm) are connected through the narrow slot SL. The antenna AN can be coupled to the ground through the via, but not limited to this. And, FIG. 22B illustrates simulation results of FIG. 22A.

Figure 23A:
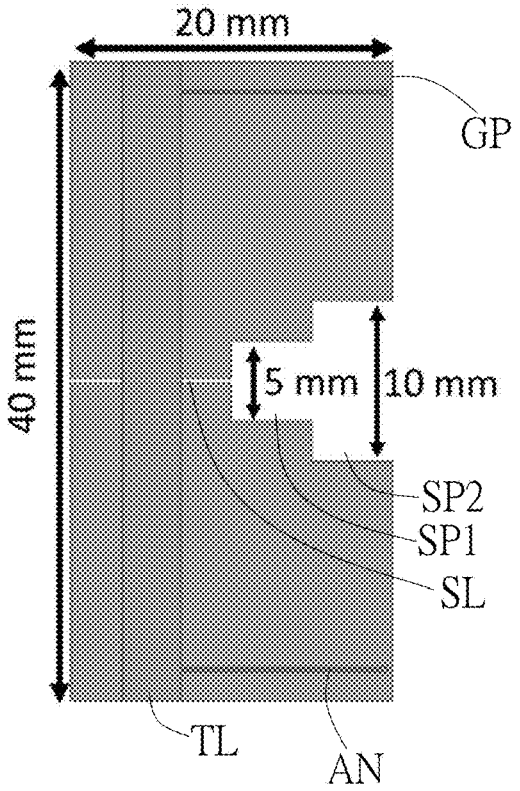
FIG. 23A illustrates a schematic view of 40 mm*20 mm non-common-ground bandpass filter circuit with a defected ground plane (Type 3) having a narrow (0.2 mm) slot, one rectangle space (5 mm*10 mm) and one square space (5 mm*5 mm), wherein the rectangle space (5 mm*10 mm) and the square space (5 mm*5 mm) are connected.
Figure 23B:
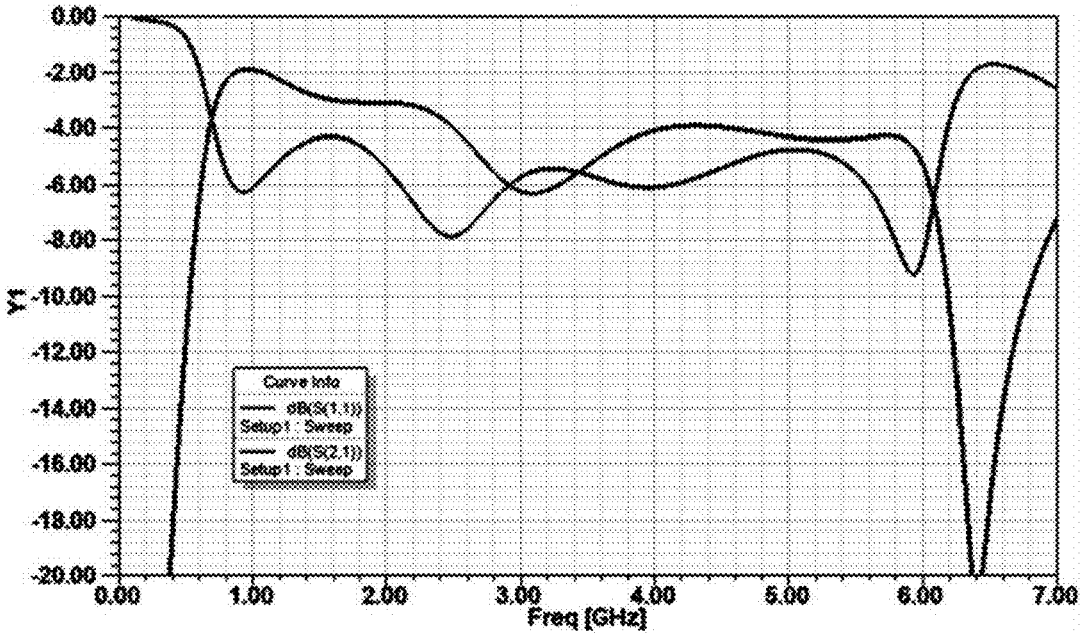
FIG. 23B illustrates simulation results of FIG. 23A.

As shown in FIG. 23A, the non-common-ground band-pass filter circuit has a 40 mm*20 mm defected ground plane (Type 3) GP having a narrow slot (width=0.2 mm) SL, one rectangle space (size=5 mm*10 mm) and one square space (size=5 mm*5 mm), wherein the narrow slot SL and the rectangle space (size=5 mm*10 mm) are connected through the square space (size=5 mm*5 mm). The antenna AN can be coupled to the ground through the via, but not limited to this. And, FIG. 23B illustrates simulation results of FIG. 23A.

Figure 24A:
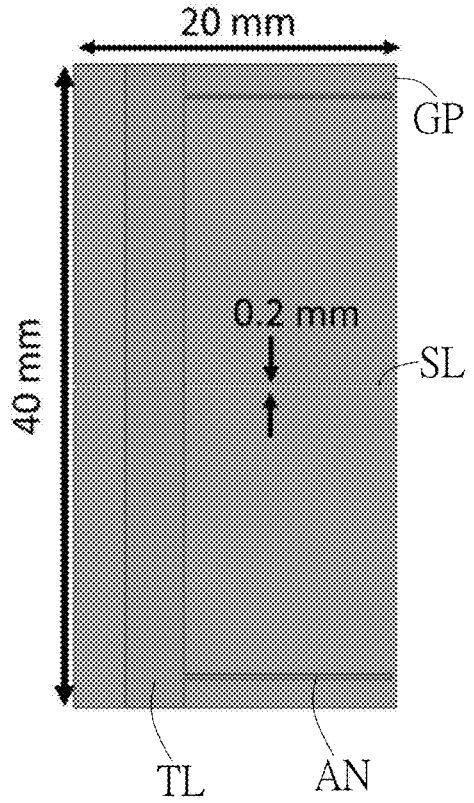
FIG. 24A illustrates a schematic view of 40 mm*20 mm non-common-ground bandpass filter circuit with a defected ground plane (Type 4) having only one narrow (0.2 mm) slot disposed on the center along the length direction.
Figure 24B:
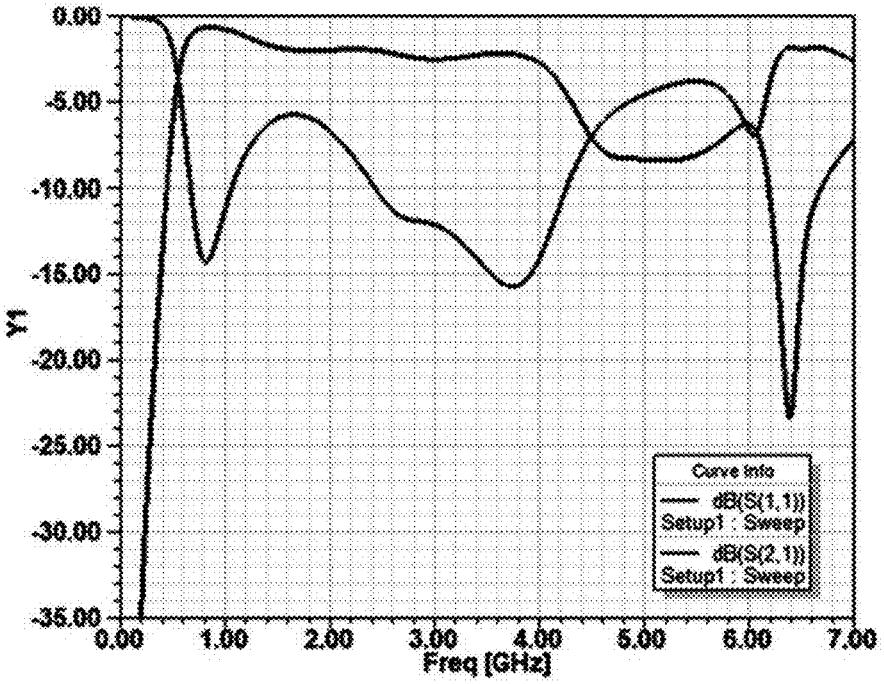
FIG. 24B illustrates simulation results of FIG. 24A.

As shown in FIG. 24A, only one narrow slot SL (width=0.2 mm) is disposed on the center of a 40 mm*20 mm defected ground plane (Type 4) GP along the length direction of the defected ground plane GP. The antenna AN can be coupled to the ground through the via, but not limited to this. And, FIG. 24B illustrates simulation results of FIG. 24A.

Figure 25A:
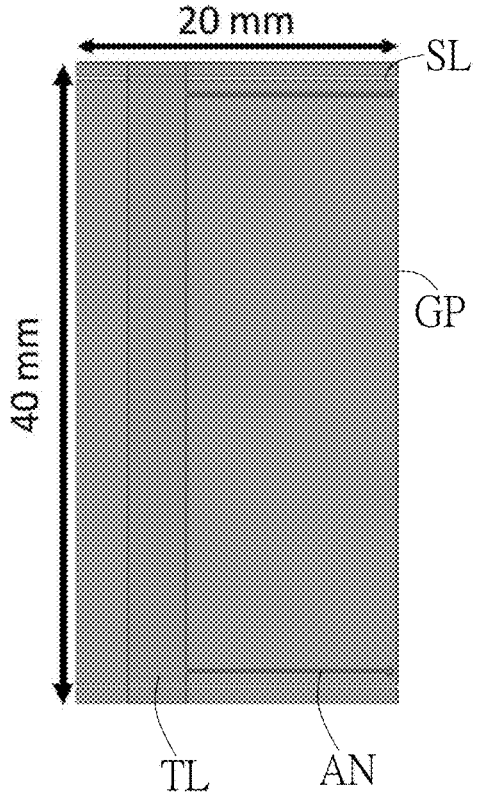
FIG. 25A illustrates a schematic view of 40 mm*20 mm non-common-ground bandpass filter circuit with a defected ground plane (Type 5) having two narrow (0.2 mm) slots disposed on two sides along the length direction.
Figure 25B:
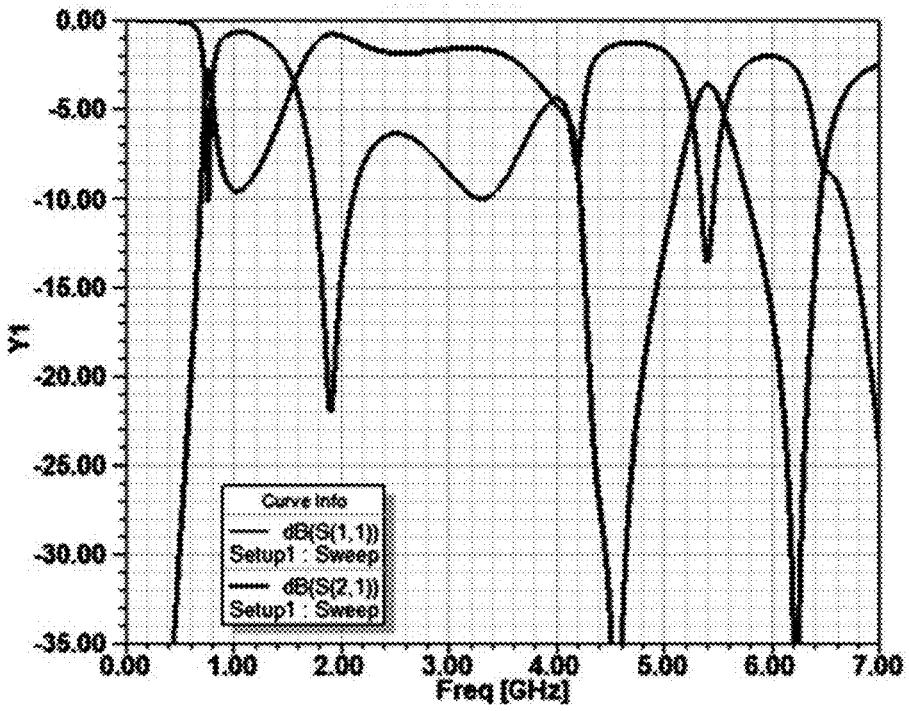
FIG. 25B illustrates simulation results of FIG. 25A.

As shown in FIG. 25A, two narrow slots SL (width=0.2 mm) are disposed on two sides of a 40 mm*20 mm defected ground plane (Type 5) GP along the length direction of the defected ground plane GP. The antenna AN can be coupled to the ground through the via, but not limited to this. And, FIG. 25B illustrates simulation results of FIG. 25A.

Figure 26A:
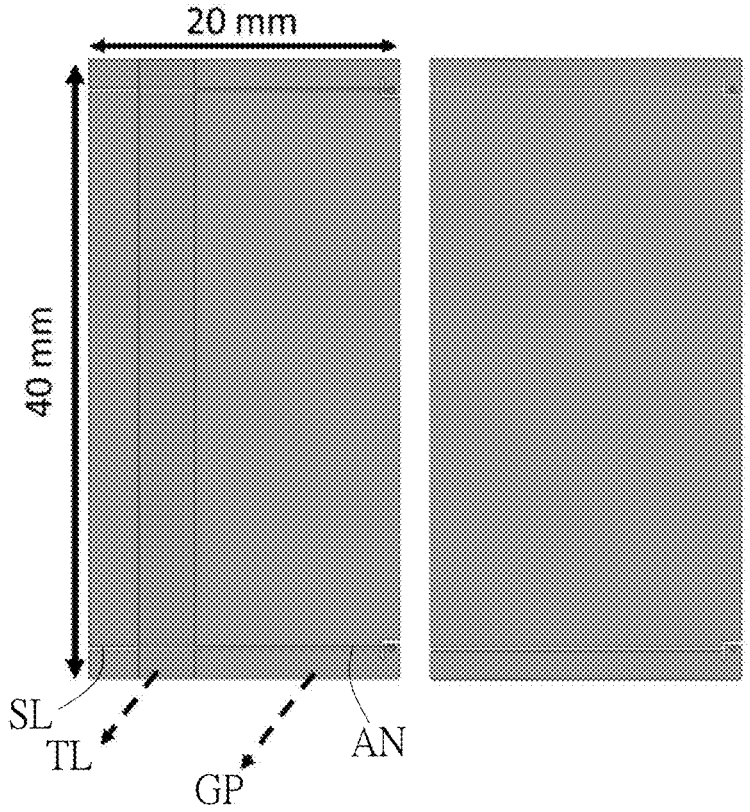
FIG. 26A illustrates a front view (the left part of FIG. 26A) and a back view (the right part of FIG. 26A) of 40 mm*20 mm non-common-ground bandpass filter circuit with a defected ground plane (Type 6) having two narrow (0.2 mm) slots disposed on two sides along the length direction, wherein a right-angle slot is connected with one terminal of each narrow (0.2 mm) slot.
Figure 26B:
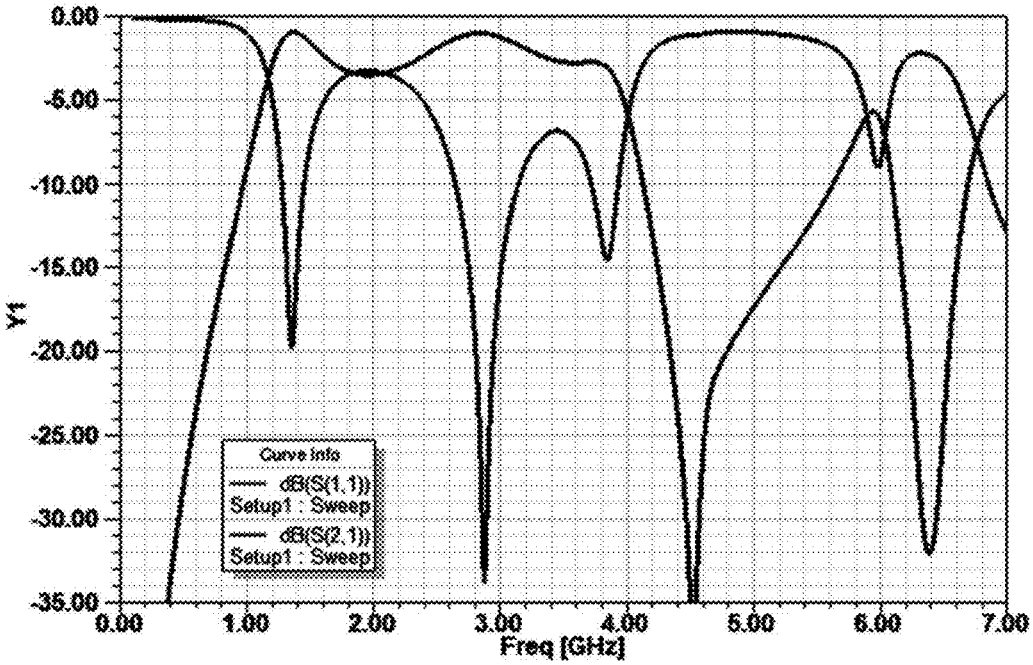
FIG. 26B illustrates simulation results of FIG. 26A.

As shown in FIG. 26A, two narrow slots SL (width=0.2 mm) are disposed on two sides of a 40 mm*20 mm defected ground plane (Type 6) GP along the length direction of the defected ground plane GP, wherein a right-angle slot is connected with one terminal of each narrow slot SL. The antenna AN can be coupled to the ground through the via, but not limited to this. And, FIG. 26B illustrates simulation results of FIG. 26A.

Figure 27A:
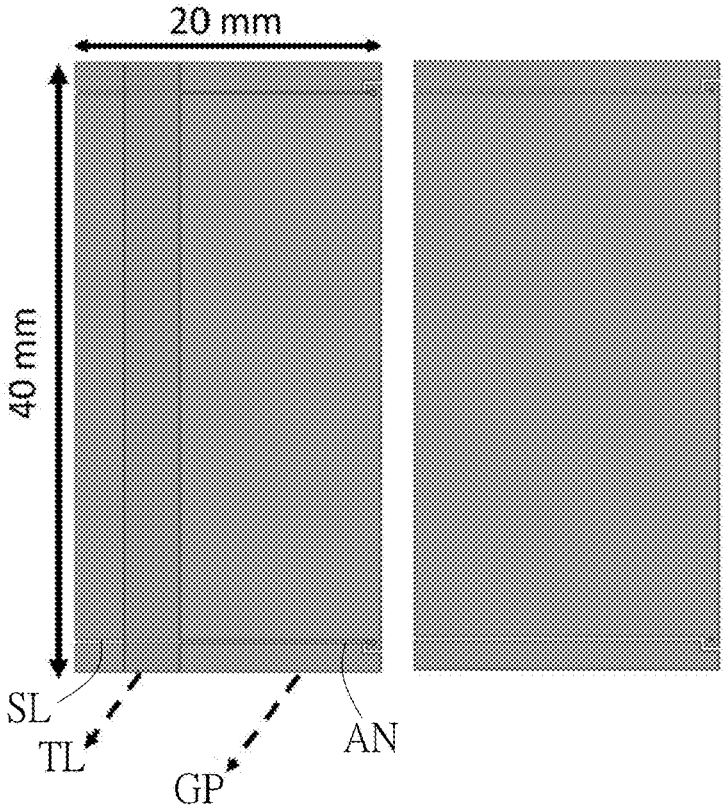
FIG. 27A illustrates a front view (the left part of FIG. 27A) and a back view (the right part of FIG. 27A) of 40 mm*20 mm non-common-ground bandpass filter circuit with a defected ground plane (Type 7) having two narrow (0.2 mm) slots disposed on two sides along the length direction, wherein a right-angle slot is connected with one terminal of each narrow (0.2 mm) slot.
Figure 27B:
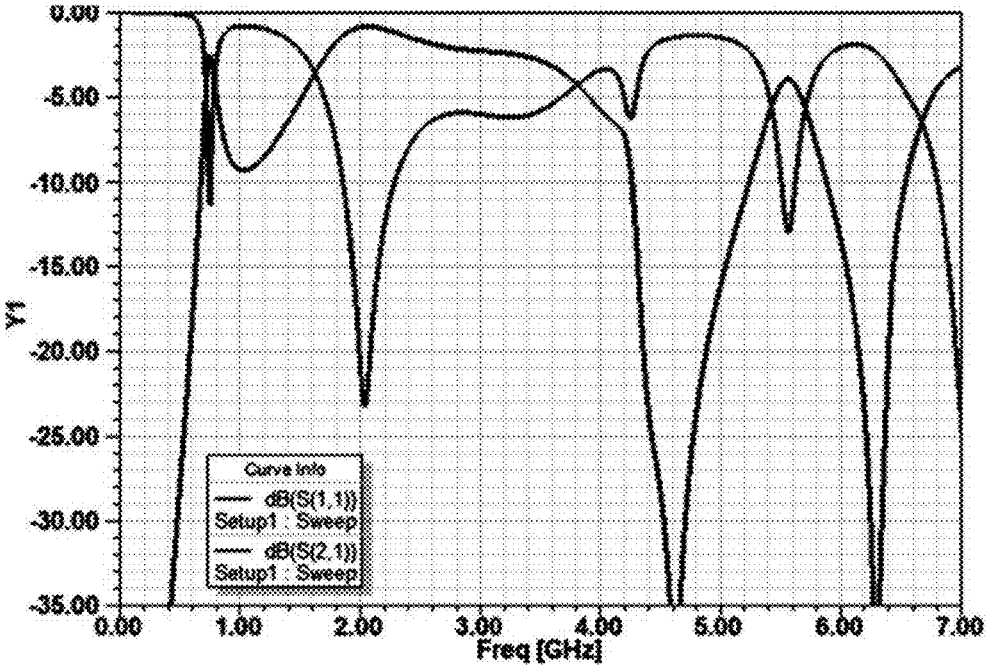
FIG. 27B illustrates simulation results of FIG. 27A.

As shown in FIG. 27A, two narrow slots SL (width=0.2 mm) are disposed on two sides of a 40 mm*20 mm defected ground plane (Type 7) GP along the length direction of the defected ground plane, wherein a right-angle slot is connected with one terminal of each narrow slot SL. The antenna AN can be coupled to the ground through the via, but not limited to this. And, FIG. 27B illustrates simulation results of FIG. 27A.

Figure 28A:
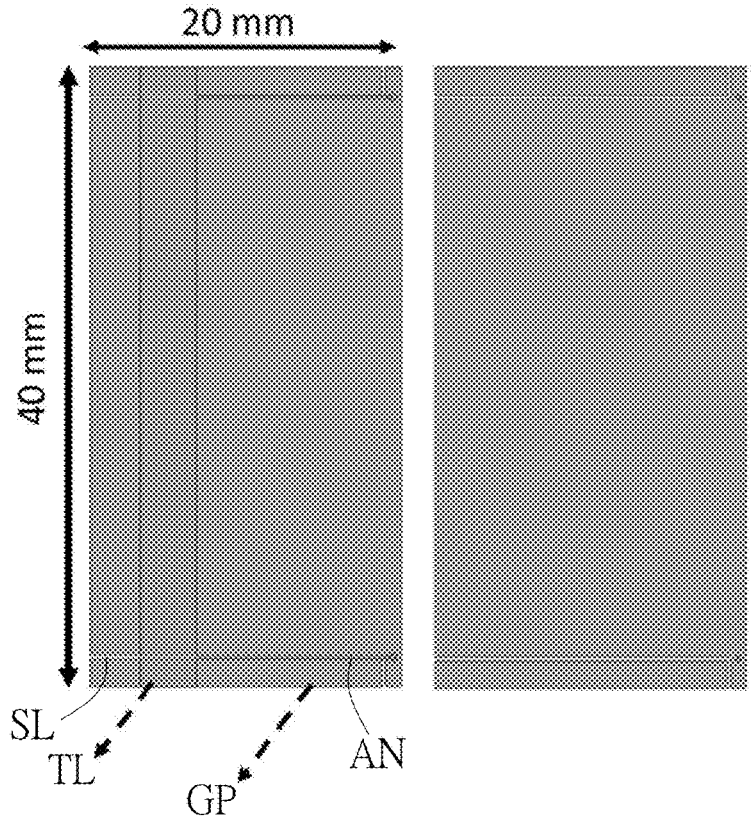
FIG. 28A illustrates a front view (the left part of FIG. 28A) and a back view (the right part of FIG. 28A) of 40 mm*20 mm non-common-ground bandpass filter circuit with a defected ground plane (Type 8) having two narrow (0.2 mm) slots disposed on two sides along the length direction, wherein a linear slot is connected with one terminal of each narrow (0.2 mm) slot.
Figure 28B:
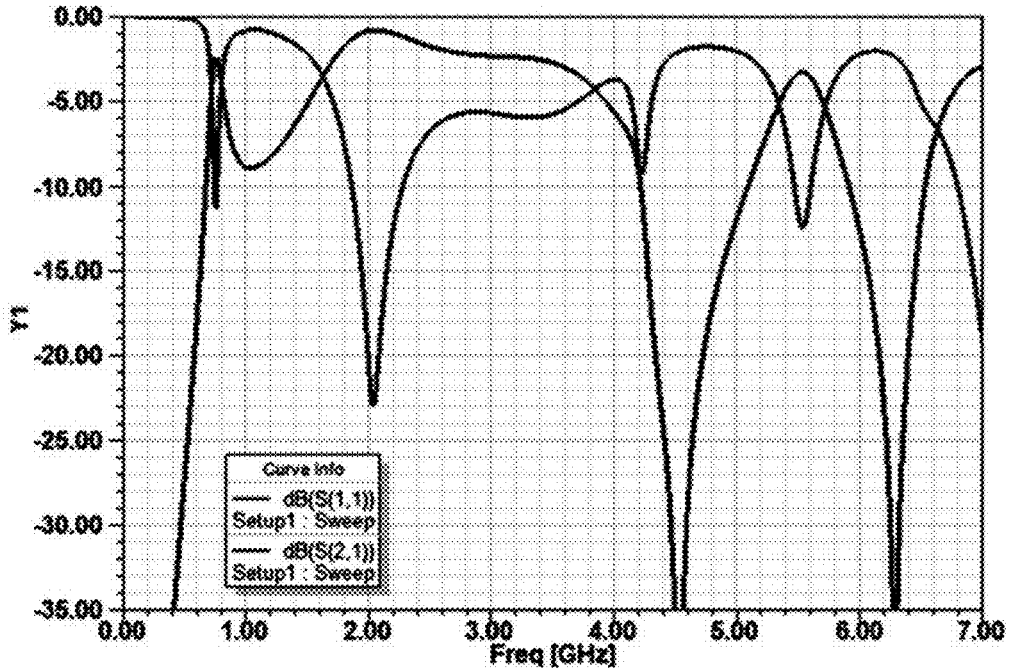
FIG. 28B illustrates simulation results of FIG. 28A.

As shown in FIG. 28A, two narrow slots SL (width=0.2 mm) are disposed on two sides of a 40 mm*20 mm defected ground plane (Type 8) GP along the length direction of the defected ground plane GP, wherein a linear slot is connected with one terminal of each narrow slot SL. The antenna AN can be coupled to the ground through the via, but not limited to this. And, FIG. 28B illustrates simulation results of FIG. 28A.

Figure 29A:
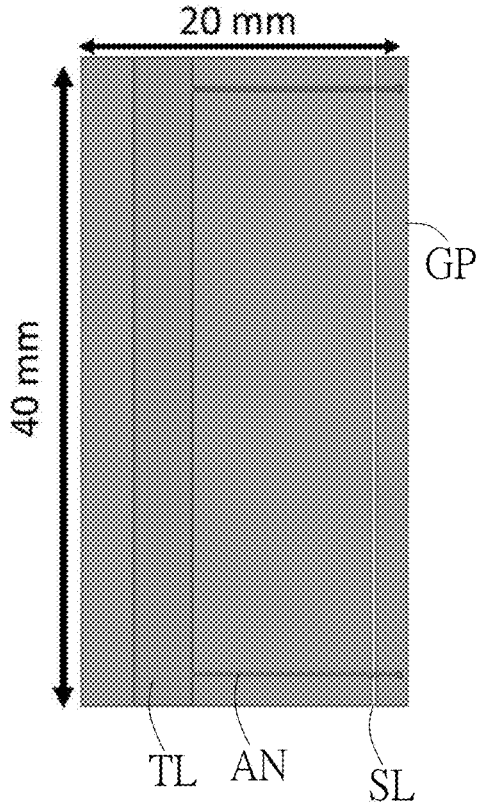
FIG. 29A illustrates a schematic view of 40 mm*20 mm non-common-ground bandpass filter circuit with a defected ground plane (Type 9) having one narrow (0.2 mm) slot disposed on one side along the length direction.
Figure 29B:
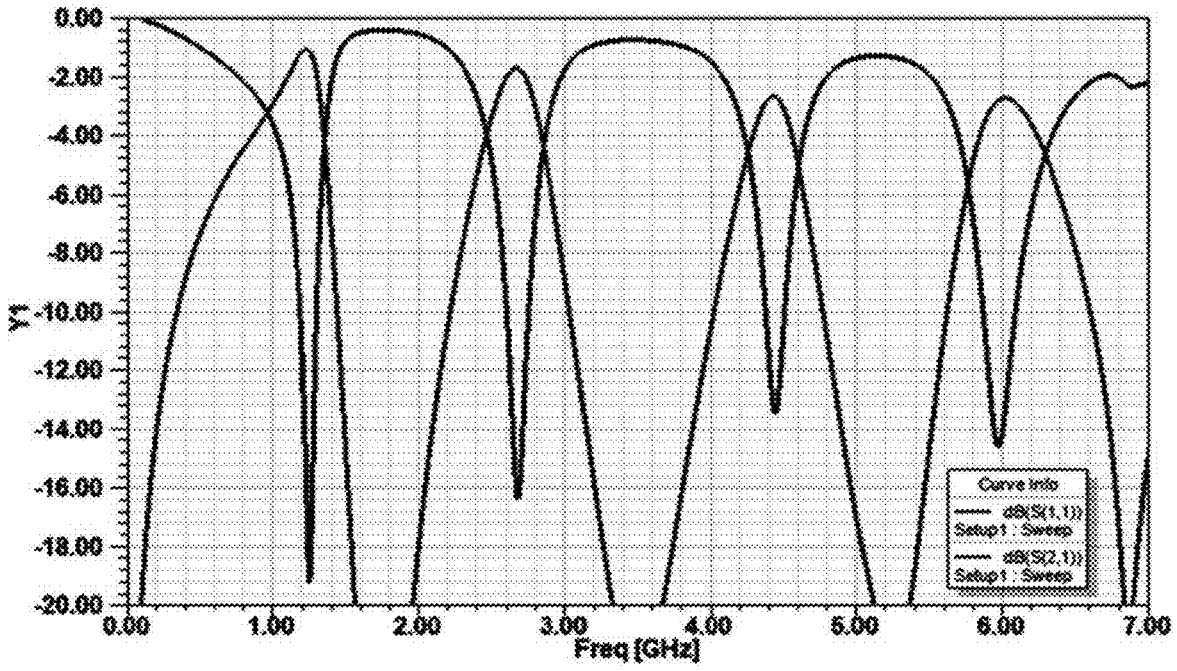
FIG. 29B illustrates simulation results of FIG. 29A.

As shown in FIG. 29A, a narrow slot SL (width=0.2 mm) is disposed on one side of a 40 mm*20 mm defected ground plane (Type 9) GP along the length direction of the defected ground plane GP. The antenna AN can be coupled to the ground through the via, but not limited to this. And, FIG. 29B illustrates simulation results of FIG. 29A.

Figure 30A:
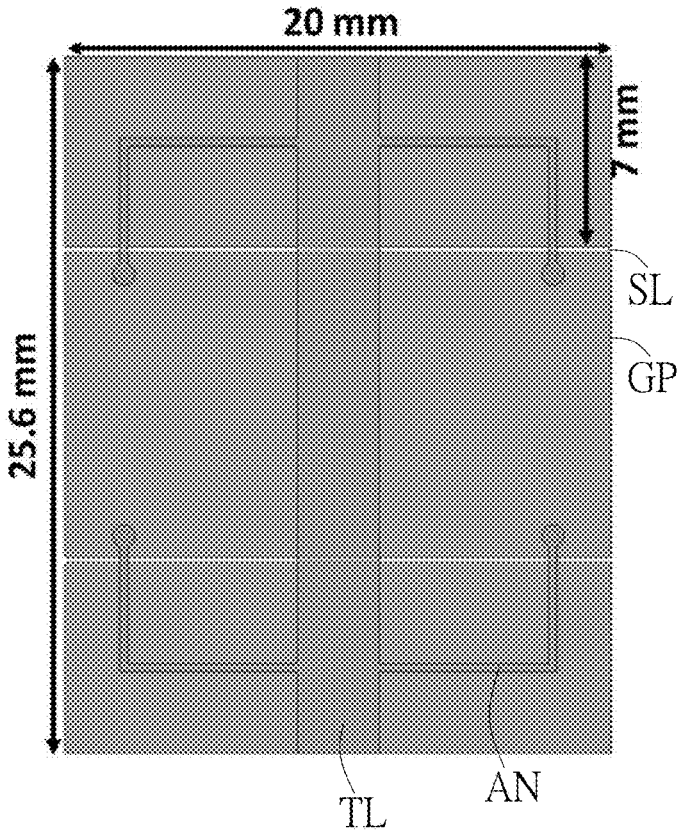
FIG. 30A illustrates a schematic view of 25.6 mm*20 mm non-common-ground bandpass filter circuit with a defected ground plane (Type 1) having two narrow (0.2 mm) slots disposed on two sides along the width direction, wherein the distance between the upper side/the lower side and the narrow (0.2 mm) slot is 7 mm.
Figure 30B:
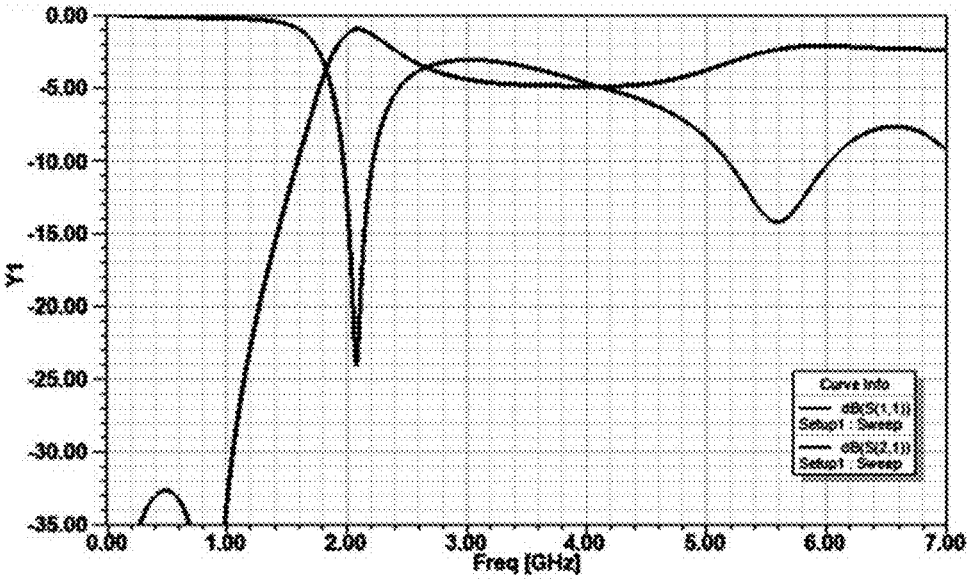
FIG. 30B illustrates simulation results of FIG. 30A.

As shown in FIG. 30A, two narrow slots SL (width=0.2 mm) are disposed on two sides of a 25.6 mm*20 mm defected ground plane (Type 1) GP along the width direction of the defected ground plane GP, wherein a distance between the upper side/the lower side of the defected ground plane GP and the narrow slot SL is 7 mm. The antenna AN can be coupled to the ground through the via, but not limited to this. And, FIG. 30B illustrates simulation results of FIG. 30A.

Figure 31A:
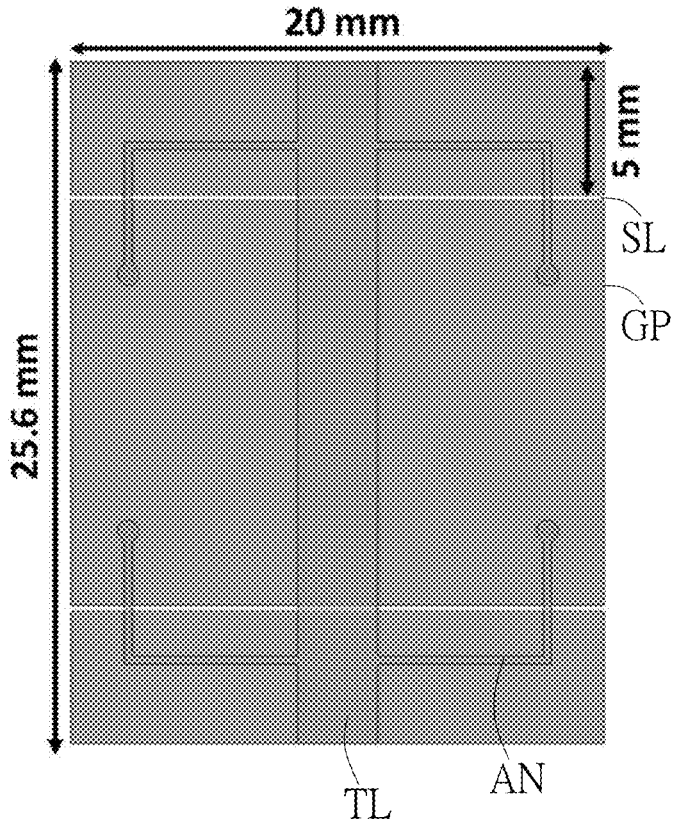
FIG. 31A illustrates a schematic view of 25.6 mm*20 mm non-common-ground bandpass filter circuit with a defected ground plane (Type 1) having two narrow (0.2 mm) slots disposed on two sides along the width direction, wherein the distance between the upper side/the lower side and the narrow (0.2 mm) slot is 5 mm.
Figure 31B:
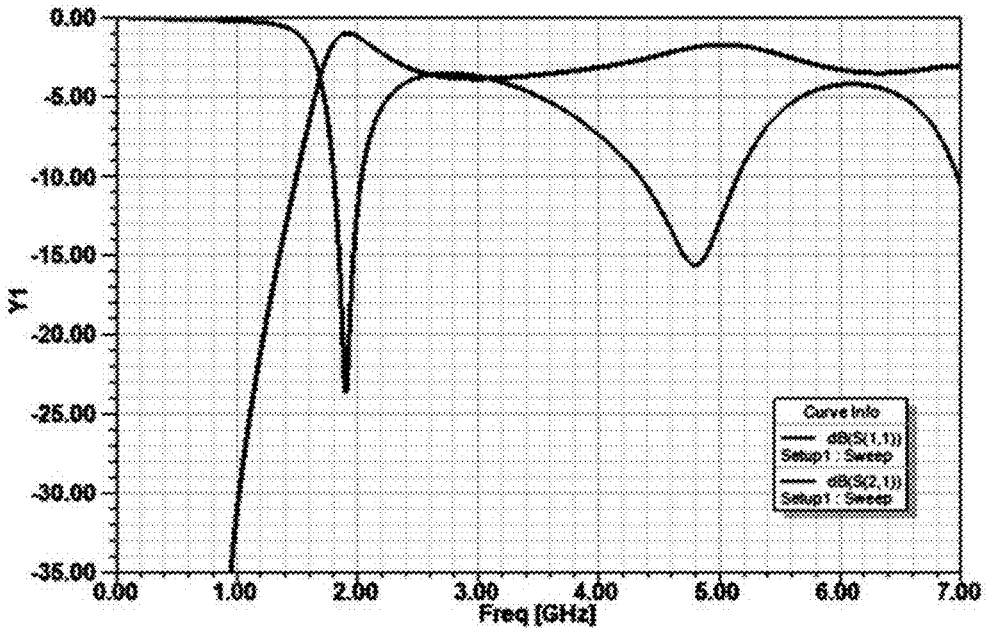
FIG. 31B illustrates simulation results of FIG. 31A.

As shown in FIG. 31A, two narrow slots SL (width=0.2 mm) are disposed on two sides of a 25.6 mm*20 mm defected ground plane (Type 1) GP along the width direction of the defected ground plane GP, wherein a distance between the upper side/the lower side of the defected ground plane GP and the narrow slot SL is 5 mm. The antenna AN can be coupled to the ground through the via, but not limited to this. And, FIG. 31B illustrates simulation results of FIG. 31A.

Figure 32A:
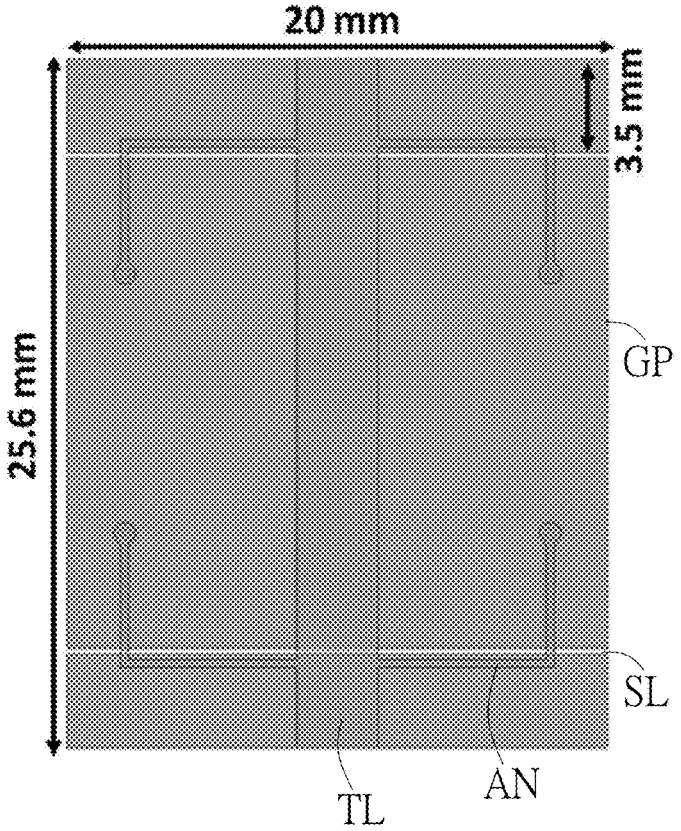
FIG. 32A illustrates a schematic view of 25.6 mm*20 mm non-common-ground bandpass filter circuit with a defected ground plane (Type 1) having two narrow (0.2 mm) slots disposed on two sides along the width direction, wherein the distance between the upper side/the lower side and the narrow (0.2 mm) slot is 3.5 mm.
Figure 32B:
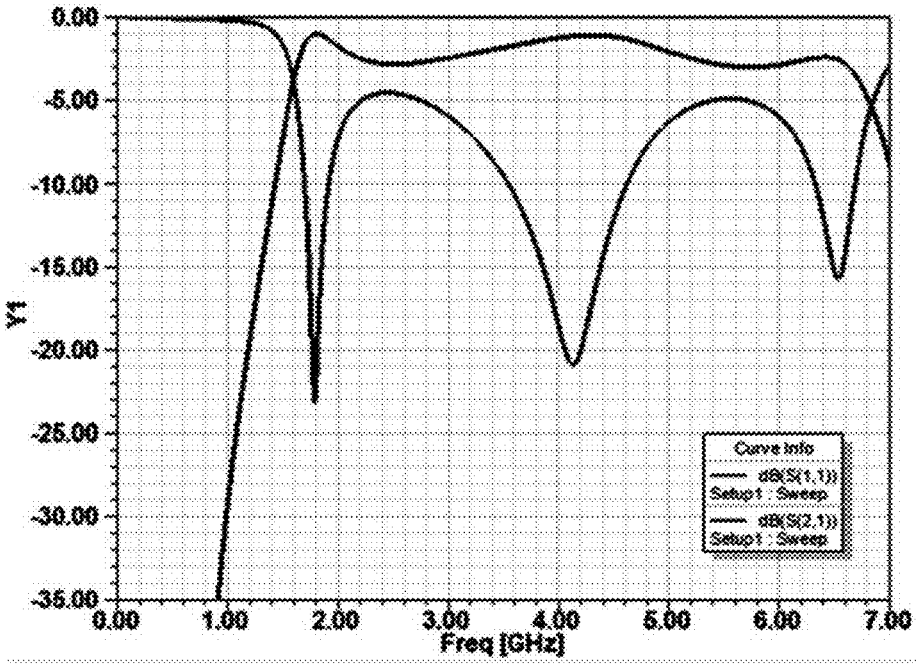
FIG. 32B illustrates simulation results of FIG. 32A.

As shown in FIG. 32A, two narrow slots SL (width=0.2 mm) are disposed on two sides of a 25.6 mm*20 mm defected ground plane (Type 1) GP along the width direction of the defected ground plane GP, wherein a distance between the upper side/the lower side of the defected ground plane GP and the narrow slot SL is 3.5 mm. The antenna AN can be coupled to the ground through the via, but not limited to this. And, FIG. 32B illustrates simulation results of FIG. 32A.

Figure 33A:
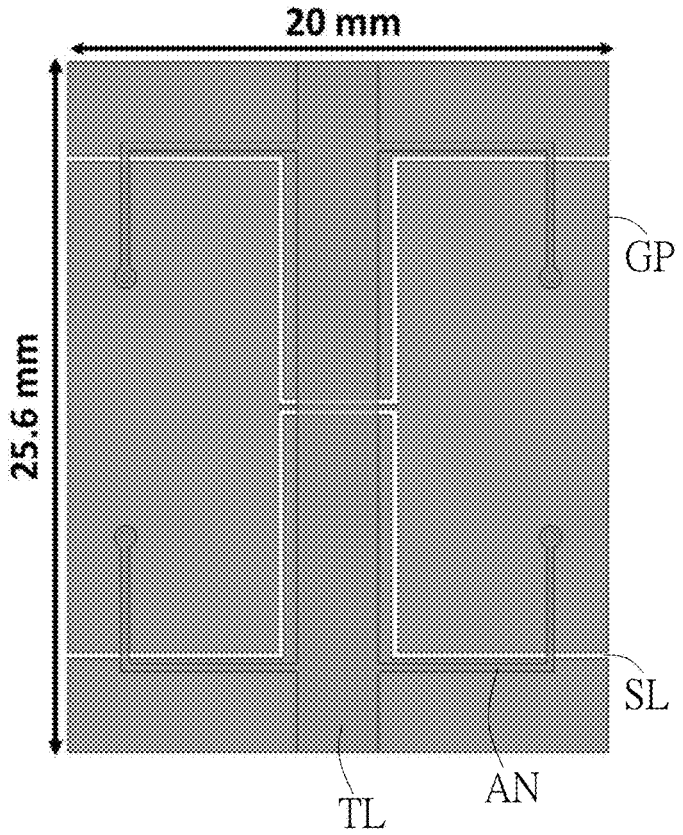
FIG. 33A illustrates a schematic view of 25.6 mm*20 mm non-common-ground bandpass filter circuit with a defected ground plane (Type 2) having two narrow (0.2 mm) polyline slots disposed on two sides, wherein some parts of the narrow (0.2 mm) polyline slot disposed along the width direction and the other parts of the narrow (0.2 mm) polyline slot disposed along the length direction.
Figure 33B:
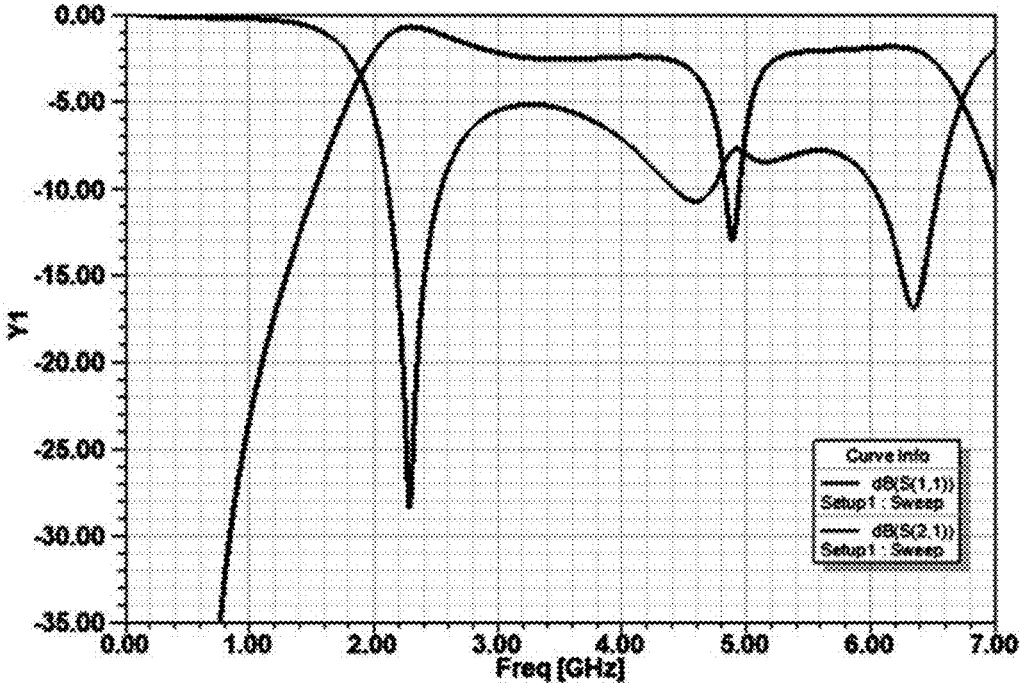
FIG. 33B illustrates simulation results of FIG. 33A.

As shown in FIG. 33A, two narrow polyline slots SL (width=0.2 mm) are disposed on two sides of a 25.6 mm*20 mm defected ground plane (Type 2) GP, wherein some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 33B illustrates simulation results of FIG. 33A.

Figure 34A:
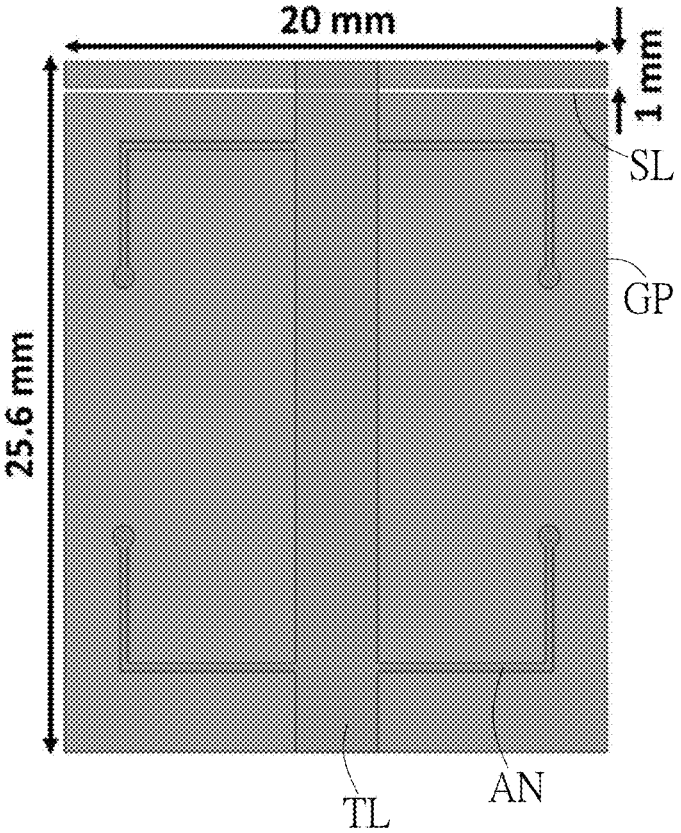
FIG. 34A illustrates a schematic view of 25.6 mm*20 mm non-common-ground bandpass filter circuit with a defected ground plane (Type 3) having one narrow (0.2 mm) slot disposed on one side near the upper side along the width direction.
Figure 34B:
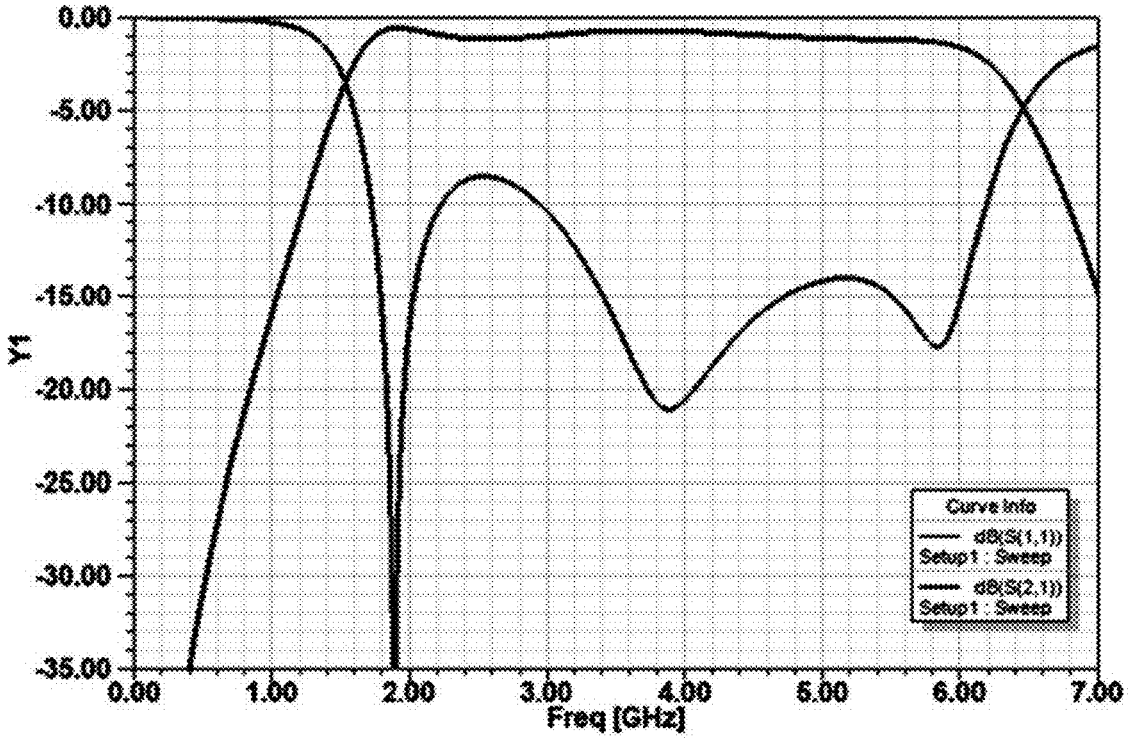
FIG. 34B illustrates simulation results of FIG. 34A.

As shown in FIG. 34A, one narrow slot SL (width=0.2 mm) is disposed on one side near the upper side of a 25.6 mm*20 mm defected ground plane (Type 3) GP along the width direction of the defected ground plane GP. The antenna AN can be coupled to the ground through the via, but not limited to this. And, FIG. 34B illustrates simulation results of FIG. 34A.

Figure 35A:
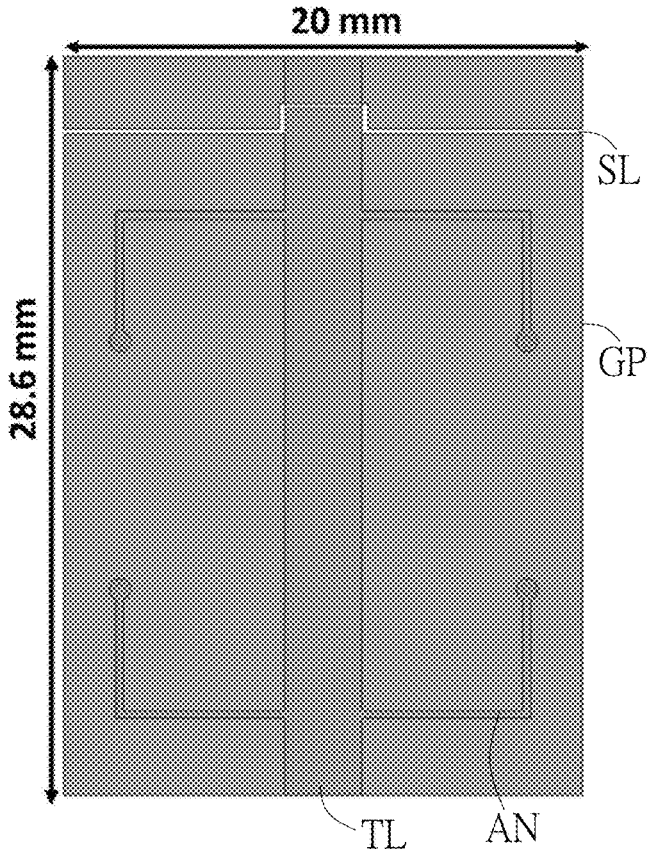
FIG. 35A illustrates a schematic view of 28.6 mm*20 mm non-common-ground bandpass filter circuit with a defected ground plane (Type 4) having one polyline narrow (0.2 mm) slot disposed on one side near the upper side, wherein some parts of the narrow (0.2 mm) polyline slot disposed along the width direction and the other parts of the narrow (0.2 mm) polyline slot disposed along the length direction.
Figure 35B:
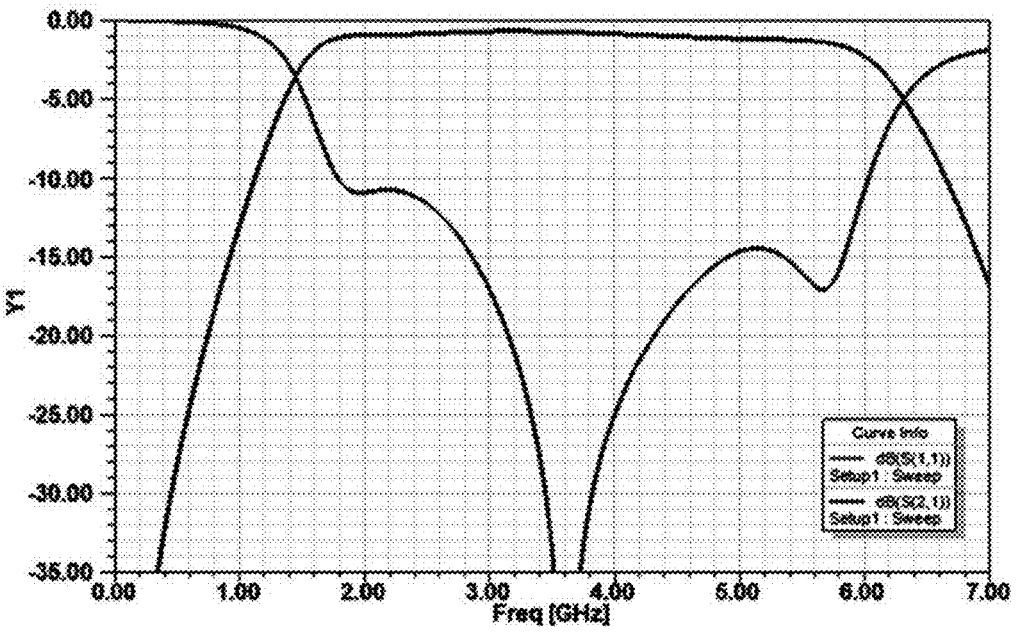
FIG. 35B illustrates simulation results of FIG. 35A.

As shown in FIG. 35A, one polyline narrow slot SL (width=0.2 mm) is disposed on one side near the upper side of a 28.6 mm*20 mm defected ground plane (Type 4) GP, wherein some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 35B illustrates simulation results of FIG. 35A.

Figure 36A:
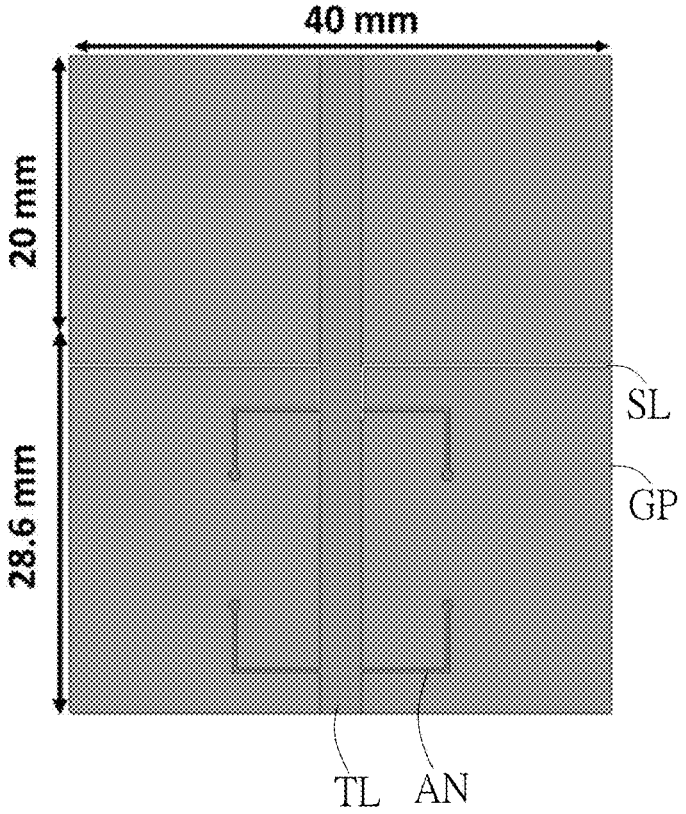
FIG. 36A illustrates a schematic view of (28.6 mm+20 mm)*20 mm non-common-ground bandpass filter circuit with a defected ground plane (Type 5) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 36B:
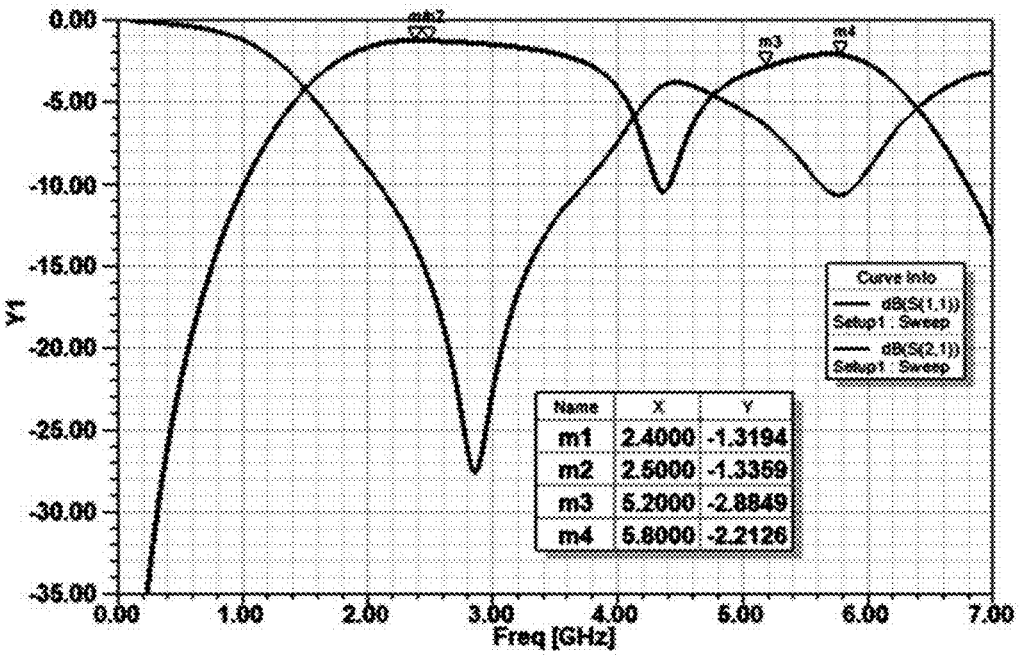
FIG. 36B illustrates simulation results of FIG. 36A.

As shown in FIG. 36A, one polyline narrow slot SL (width=0.2 mm) is disposed on a (28.6 mm+20 mm)*20 mm defected ground plane (Type 5) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 36B illustrates simulation results of FIG. 36A.

Figure 37A:
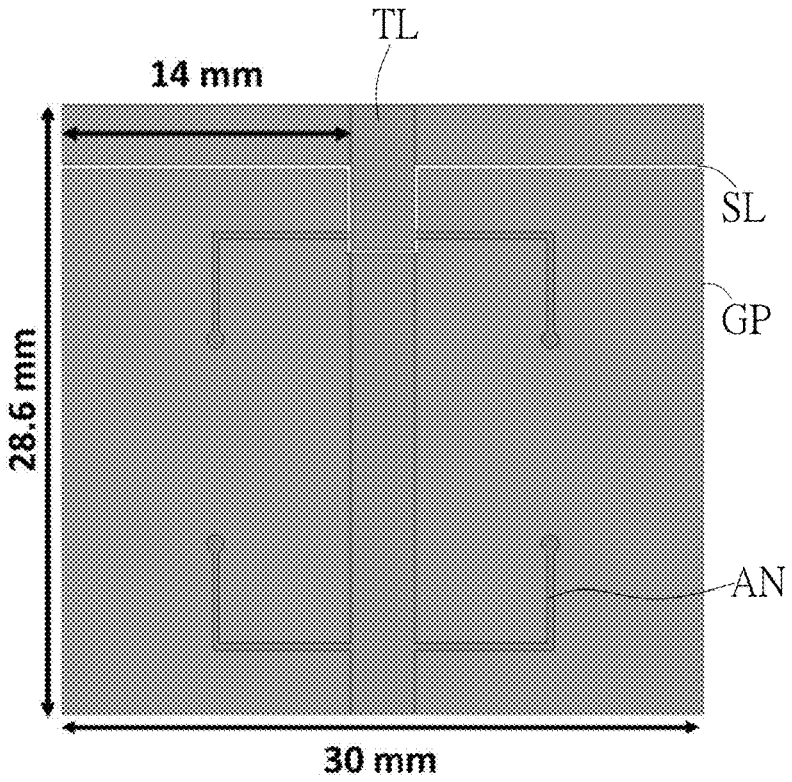
FIG. 37A illustrates a schematic view of 28.6 mm*30 mm non-common-ground bandpass filter circuit with a defected ground plane (Type 5) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 37B:
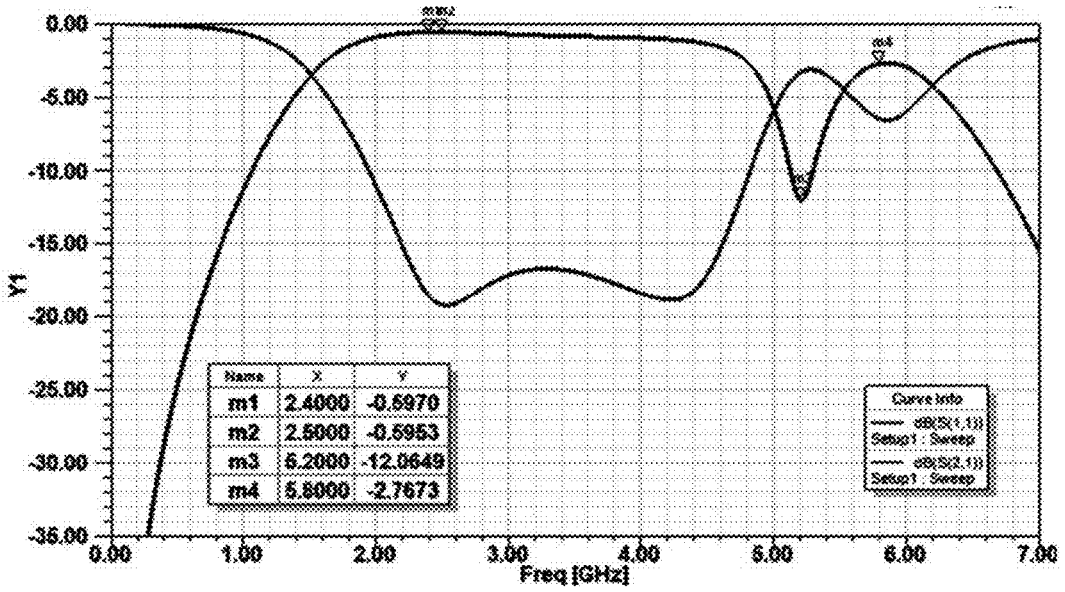
FIG. 37B illustrates simulation results of FIG. 37A.

As shown in FIG. 37A, one polyline narrow slot SL (width=0.2 mm) is disposed on a 28.6 mm*30 mm defected ground plane (Type 5) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 37B illustrates simulation results of FIG. 37A.

Figure 38A:
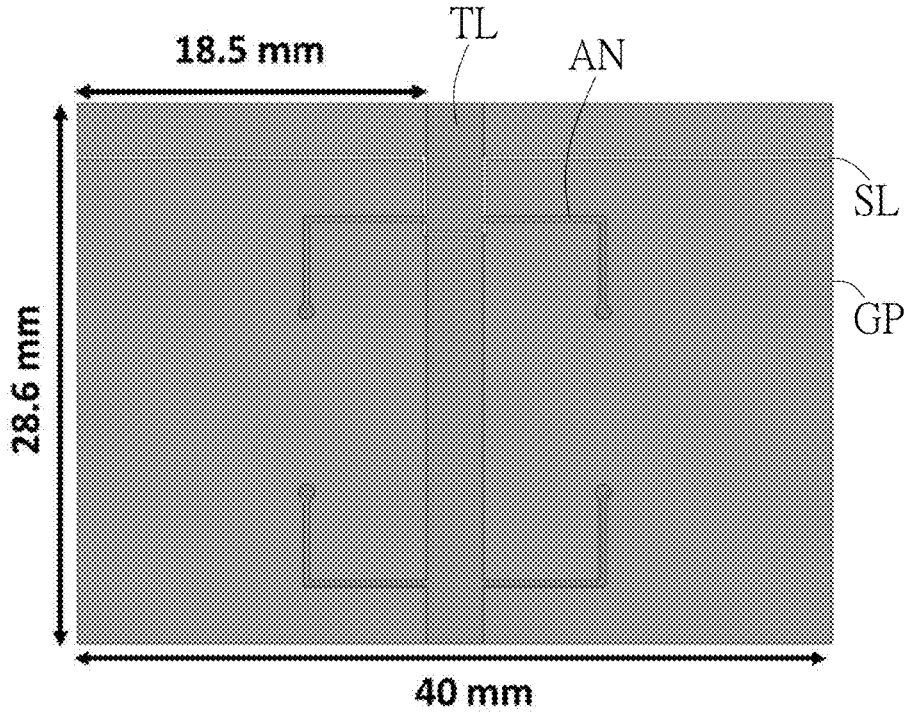
FIG. 38A illustrates a schematic view of 28.6 mm*40 mm non-common-ground bandpass filter circuit with a defected ground plane (Type 5) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 38B:
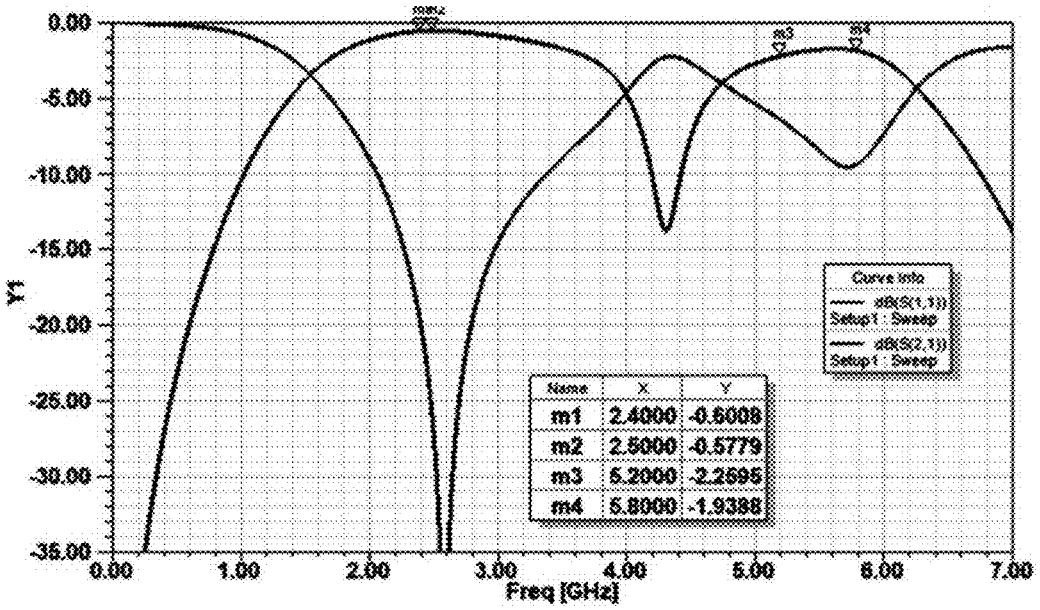
FIG. 38B illustrates simulation results of FIG. 38A.

As shown in FIG. 38A, one polyline narrow slot SL (width=0.2 mm) is disposed on a 28.6 mm*40 mm defected ground plane (Type 5) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 38B illustrates simulation results of FIG. 38A.

Figure 39A:
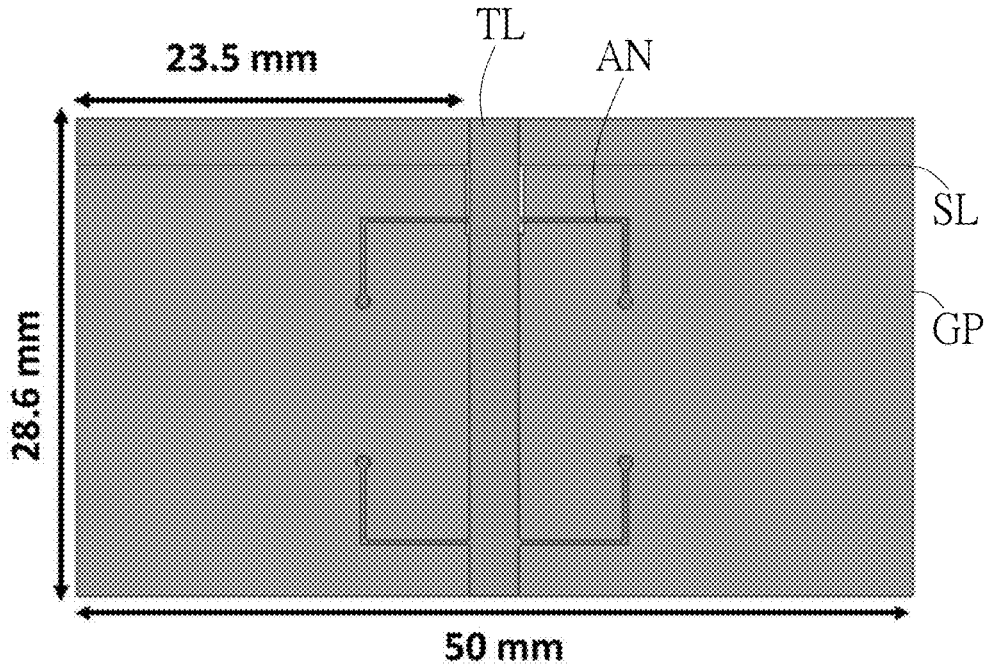
FIG. 39A illustrates a schematic view of 28.6 mm*50 mm non-common-ground bandpass filter circuit with a defected ground plane (Type 5) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 39B:
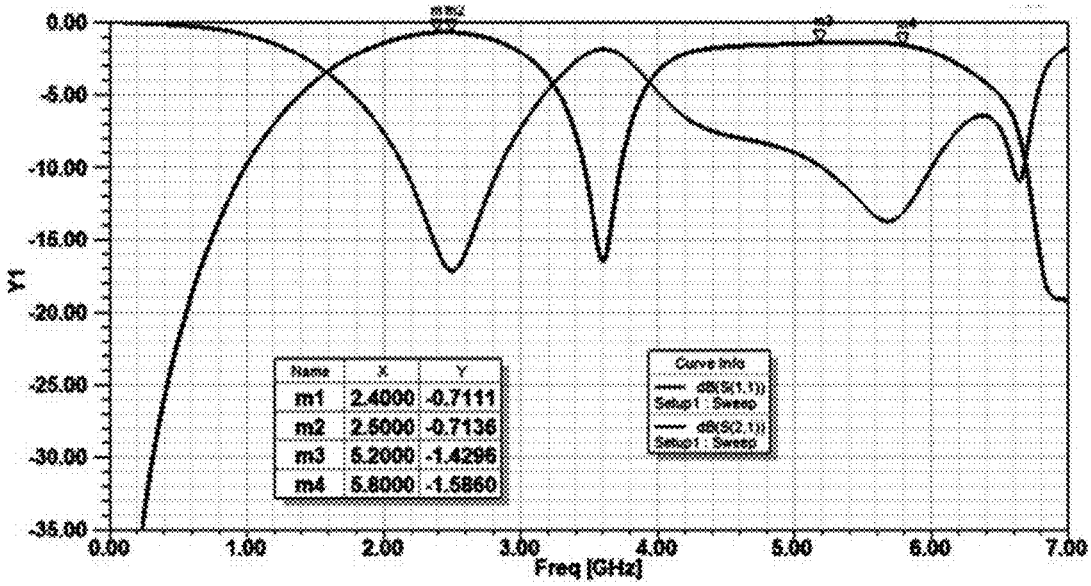
FIG. 39B illustrates simulation results of FIG. 39A.

As shown in FIG. 39A, one polyline narrow slot SL (width=0.2 mm) is disposed on a 28.6 mm*50 mm defected ground plane (Type 5) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 39B illustrates simulation results of FIG. 39A.

Figure 40A:
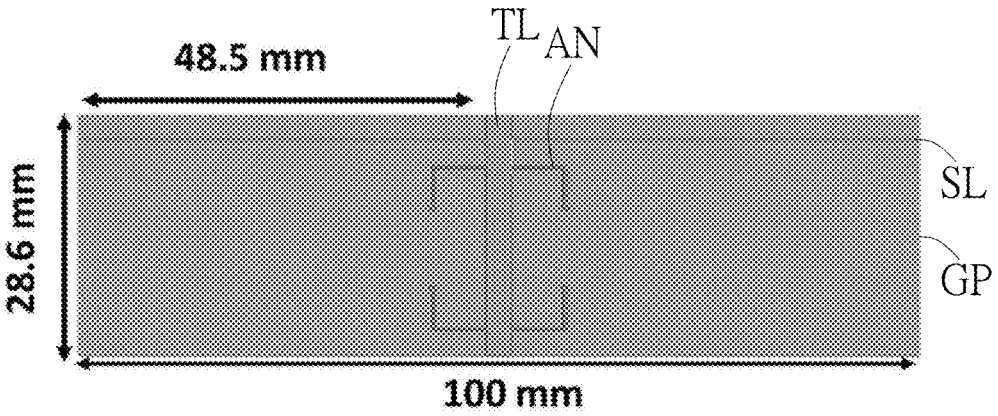
FIG. 40A illustrates a schematic view of 28.6 mm*100 mm non-common-ground bandpass filter circuit with a defected ground plane (Type 5) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 40B:
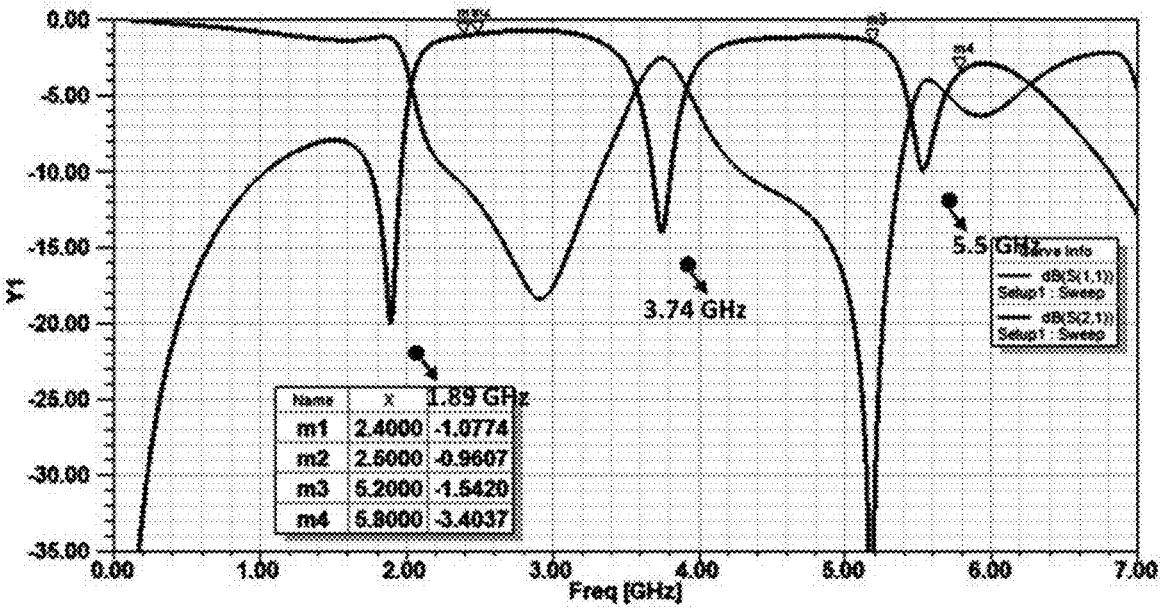
FIG. 40B illustrates simulation results of FIG. 40A.

As shown in FIG. 40A, one polyline narrow slot SL (width=0.2 mm) is disposed on a 28.6 mm*100 mm defected ground plane (Type 5) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 40B illustrates simulation results of FIG. 40A.

Figure 41A:
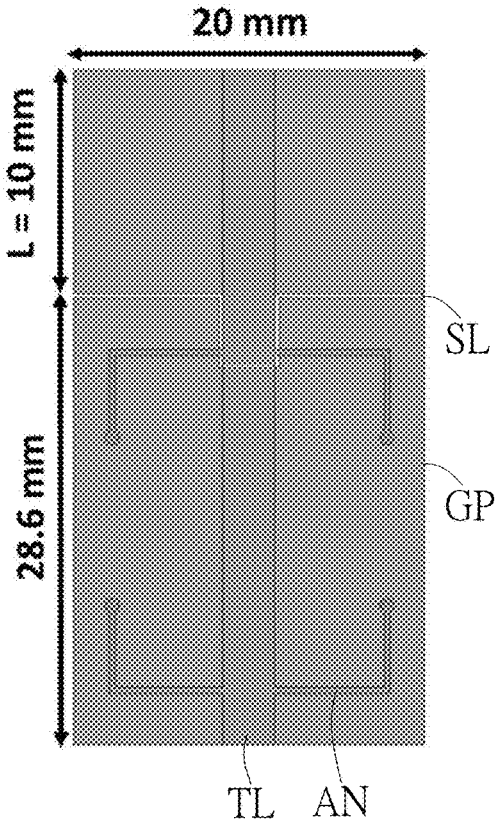
FIG. 41A illustrates a schematic view of 38.6 mm*20 mm non-common-ground bandpass filter circuit with a defected ground plane (Type 5) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 41B:
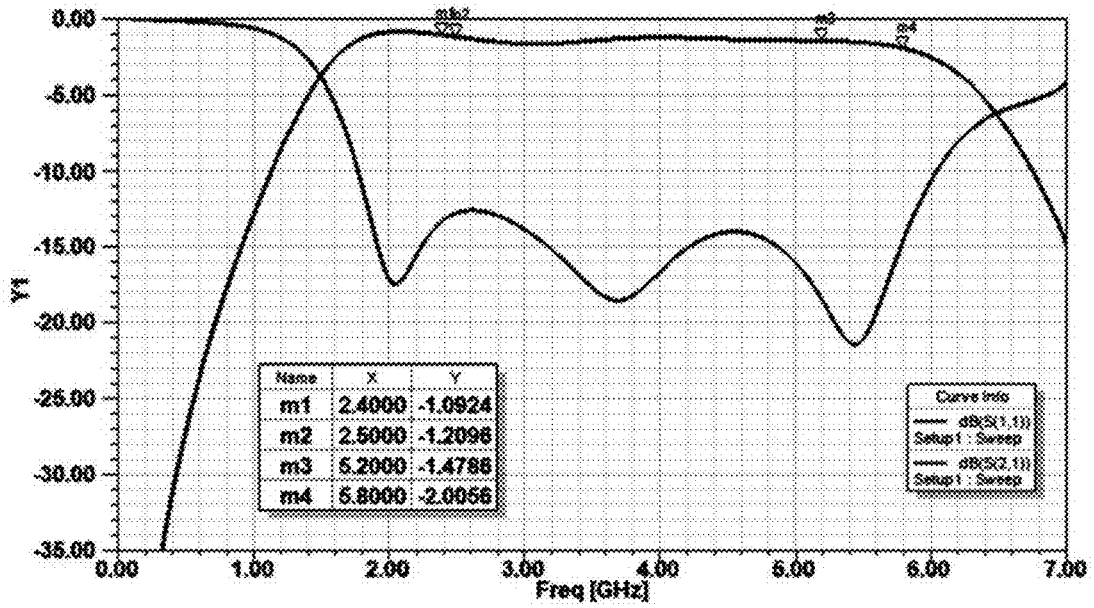
FIG. 41B illustrates simulation results of FIG. 41A.

As shown in FIG. 41A, one polyline narrow slot SL (width=0.2 mm) is disposed on a 38.6 mm*20 mm defected ground plane (Type 5) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 41B illustrates simulation results of FIG. 41A.

Figure 42A:
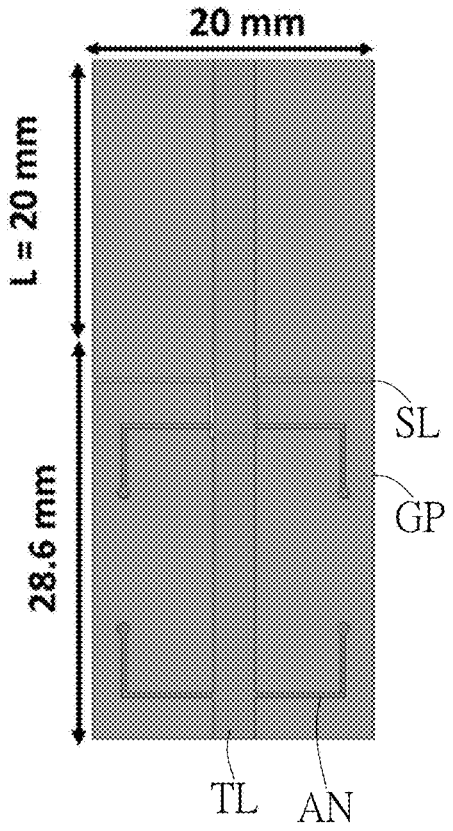
FIG. 42A illustrates a schematic view of 48.6 mm*20 mm non-common-ground bandpass filter circuit with a defected ground plane (Type 5) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 42B:
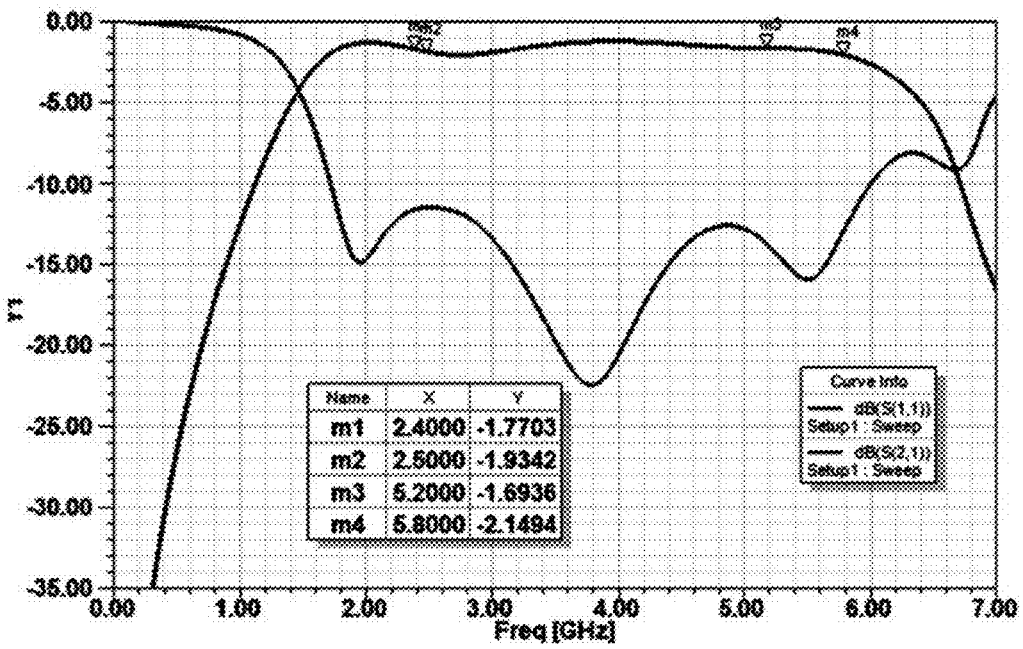
FIG. 42B illustrates simulation results of FIG. 42A.

As shown in FIG. 42A, one polyline narrow slot SL (width=0.2 mm) is disposed on a 48.6 mm*20 mm defected ground plane (Type 5) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 42B illustrates simulation results of FIG. 42A.

Figure 43A:
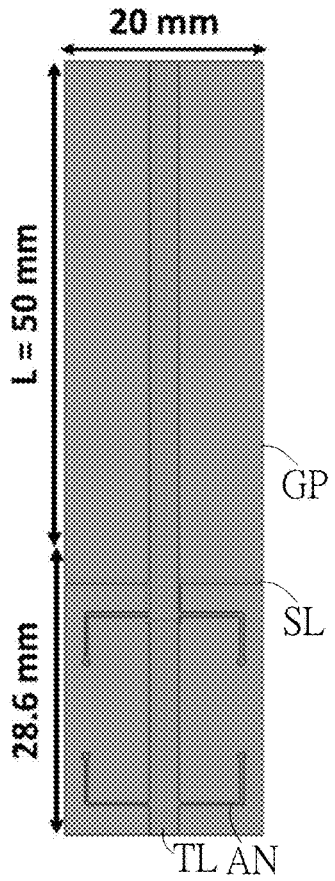
FIG. 43A illustrates a schematic view of 78.6 mm*20 mm non-common-ground bandpass filter circuit with a defected ground plane (Type 5) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 43B:
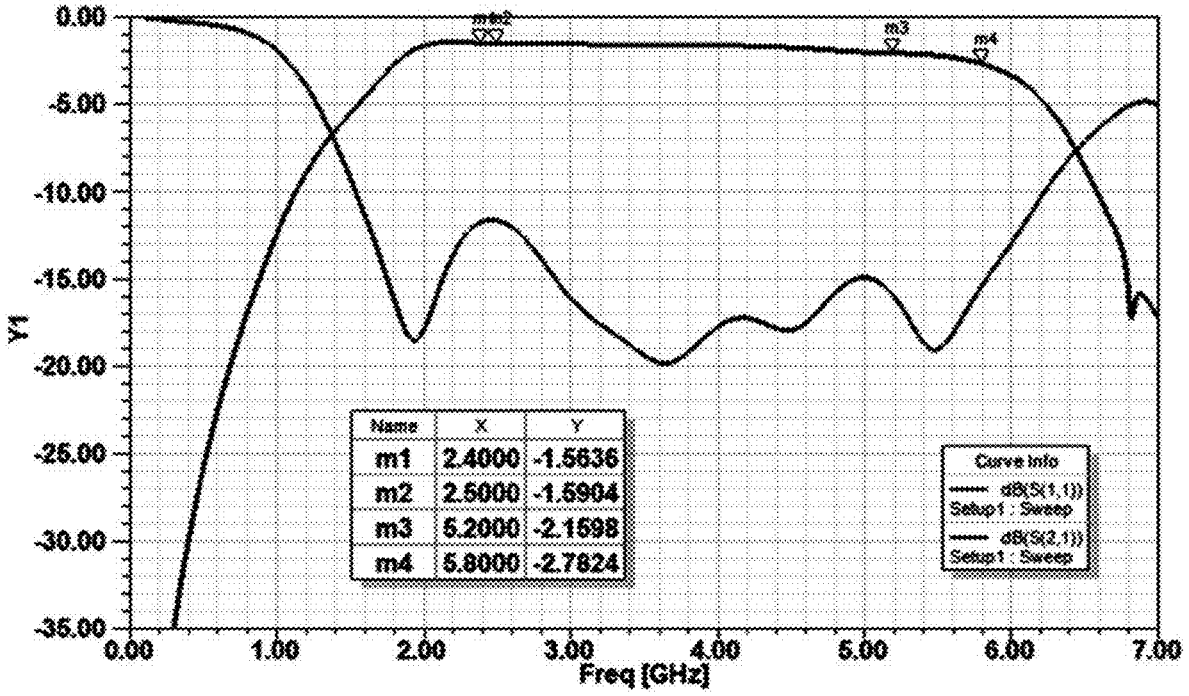
FIG. 43B illustrates simulation results of FIG. 43A.

As shown in FIG. 43A, one polyline narrow slot SL (width=0.2 mm) is disposed on a 78.6 mm*20 mm defected ground plane (Type 5) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 43B illustrates simulation results of FIG. 43A.

Figure 44A:
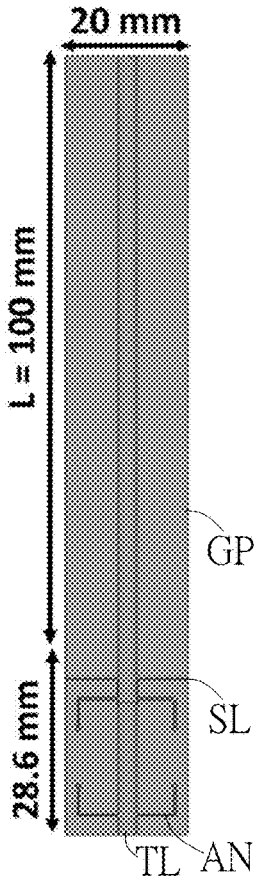
FIG. 44A illustrates a schematic view of 128.6 mm*20 mm non-common-ground bandpass filter circuit with a defected ground plane (Type 5) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 44B:
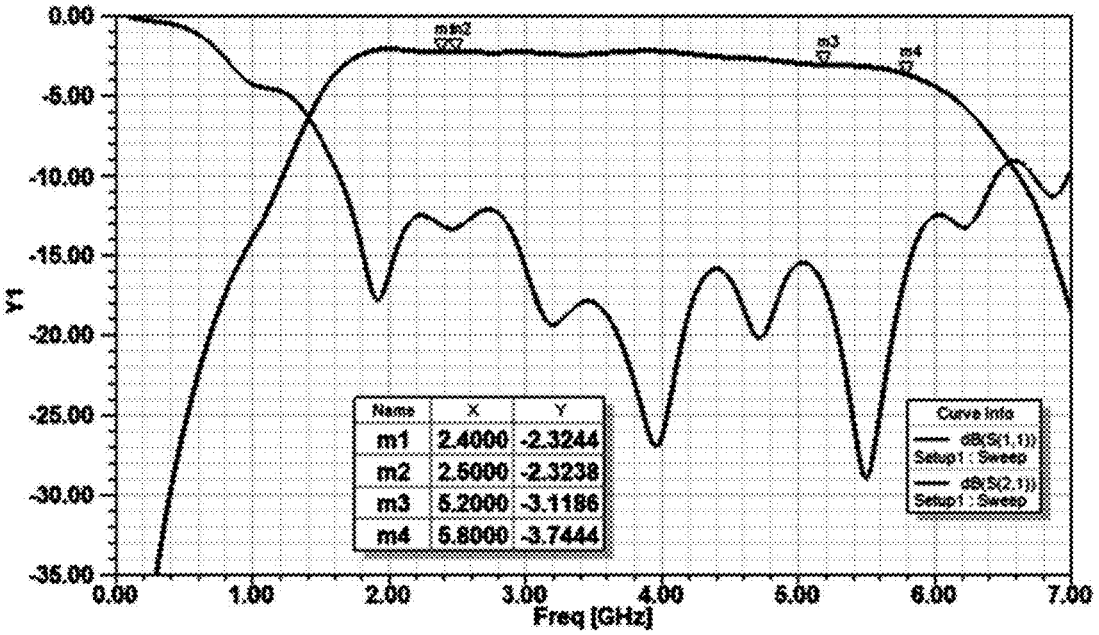
FIG. 44B illustrates simulation results of FIG. 44A.

As shown in FIG. 44A, one polyline narrow slot SL (width=0.2 mm) is disposed on a 128.6 mm*20 mm defected ground plane (Type 5) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 44B illustrates simulation results of FIG. 44A.

Figure 45A:
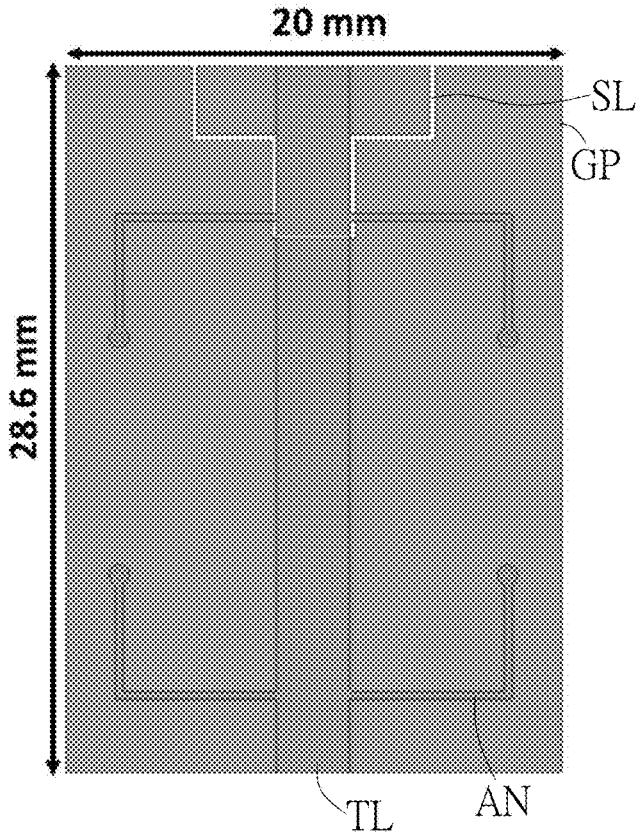
FIG. 45A illustrates a schematic view of 28.6 mm*20 mm non-common-ground bandpass filter circuit with a defected ground plane (Type 6) having one polyline narrow (0.2 mm) slot, wherein some parts of the narrow (0.2 mm) polyline slot disposed along the width direction and the other parts of the narrow (0.2 mm) polyline slot disposed along the length direction.
Figure 45B:
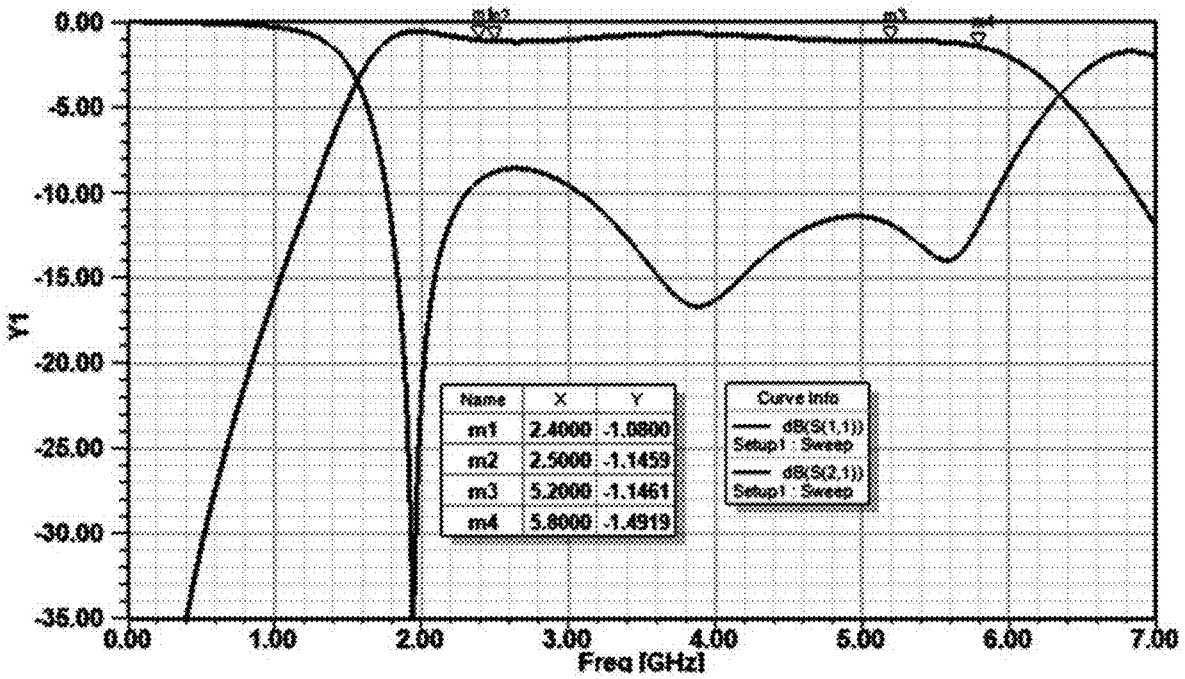
FIG. 45B illustrates simulation results of FIG. 45A.

As shown in FIG. 45A, one polyline narrow slot SL (width=0.2 mm) is disposed on a 28.6 mm*20 mm defected ground plane (Type 6) GP, wherein some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 45B illustrates simulation results of FIG. 45A.

Figure 46A:
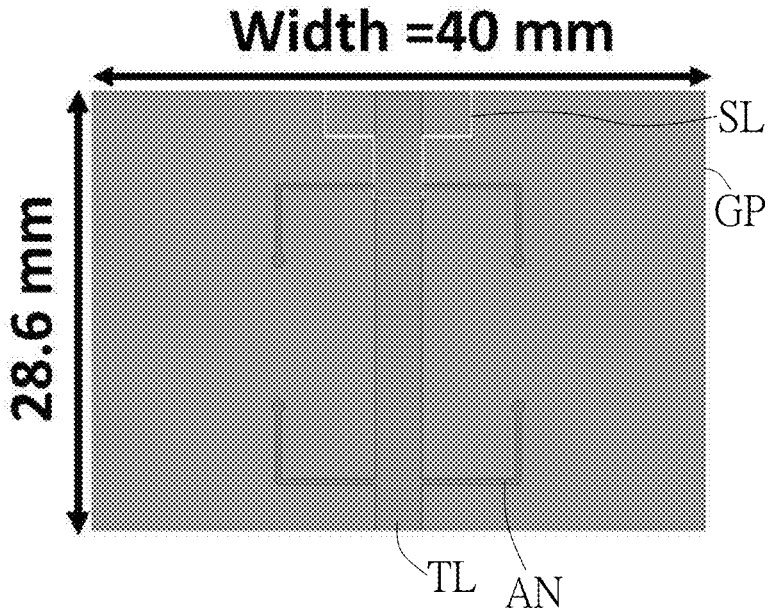
FIG. 46A illustrates a schematic view of 28.6 mm*40 mm non-common-ground bandpass filter circuit with a defected ground plane (Type 6) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 46B:
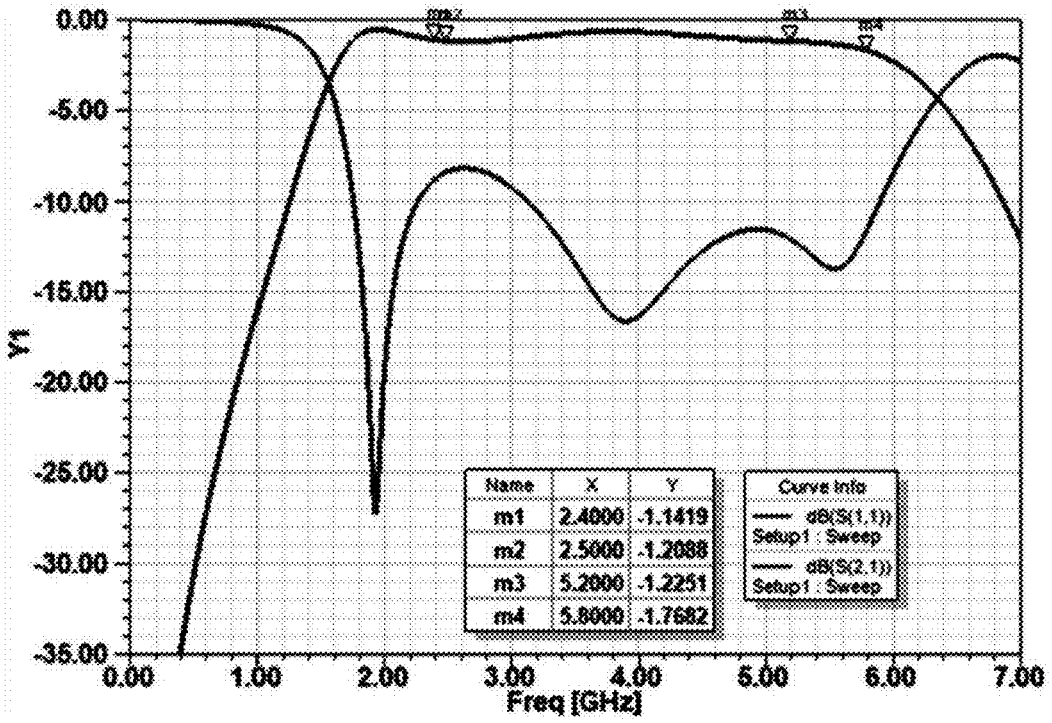
FIG. 46B illustrates simulation results of FIG. 46A.

As shown in FIG. 46A, one polyline narrow slot SL (width=0.2 mm) is disposed on a 28.6 mm*40 mm defected ground plane (Type 6) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 46B illustrates simulation results of FIG. 46A.

Figure 46C:
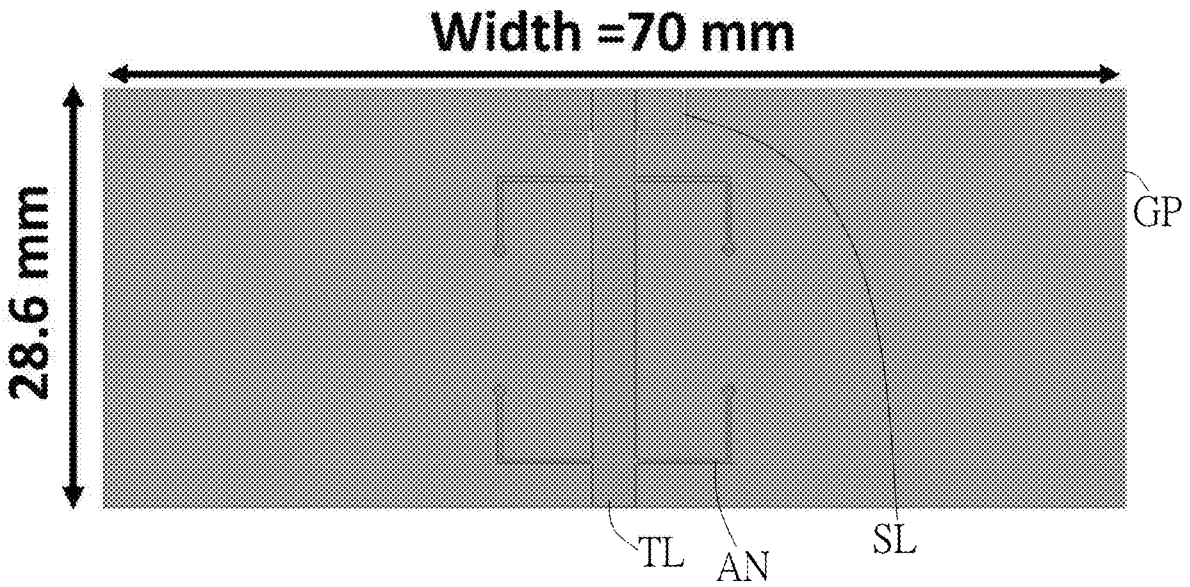
FIG. 46C illustrates a schematic view of 28.6 mm*70 mm non-common-ground bandpass filter circuit with a defected ground plane (Type 6) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 46D:
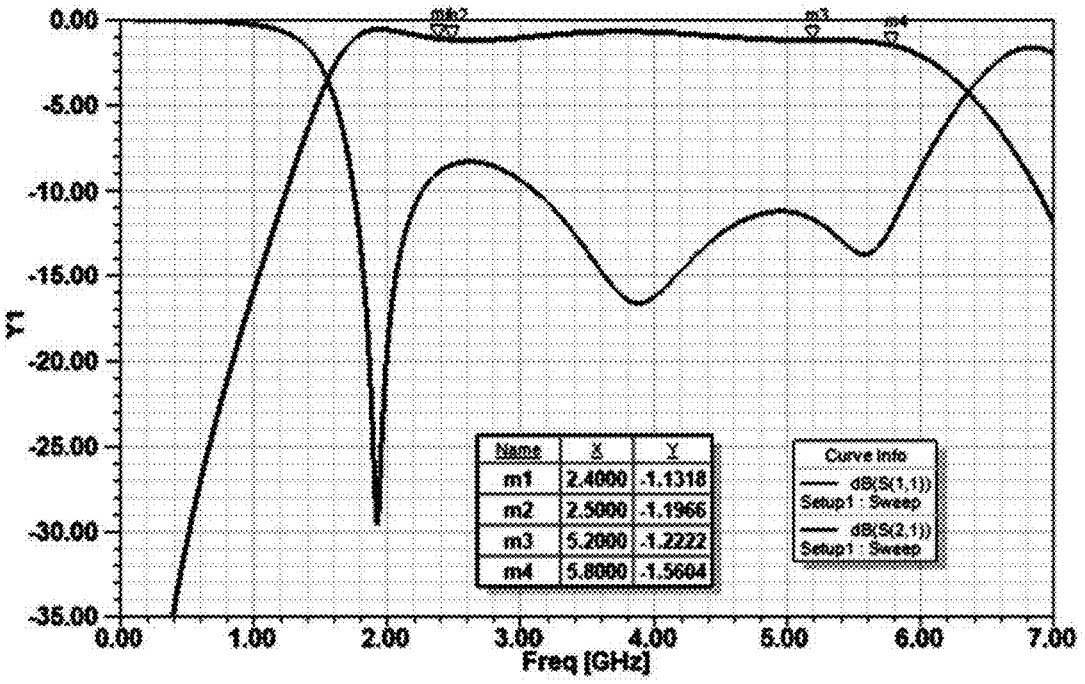
FIG. 46D illustrates simulation results of FIG. 46C.

As shown in FIG. 46C, one polyline narrow slot SL (width=0.2 mm) is disposed on a 28.6 mm*70 mm defected ground plane (Type 6) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 46D illustrates simulation results of FIG. 46C.

Figure 47A:
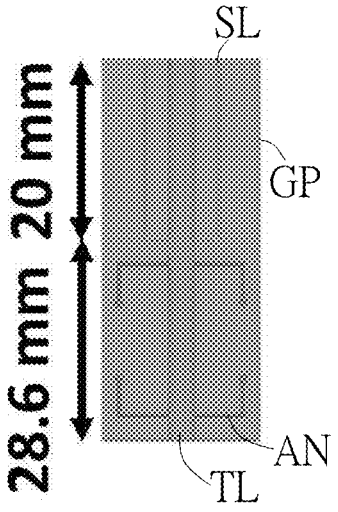
FIG. 47A illustrates a schematic view of 48.6 mm*20 mm non-common-ground bandpass filter circuit with a defected ground plane (Type 6) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 47B:
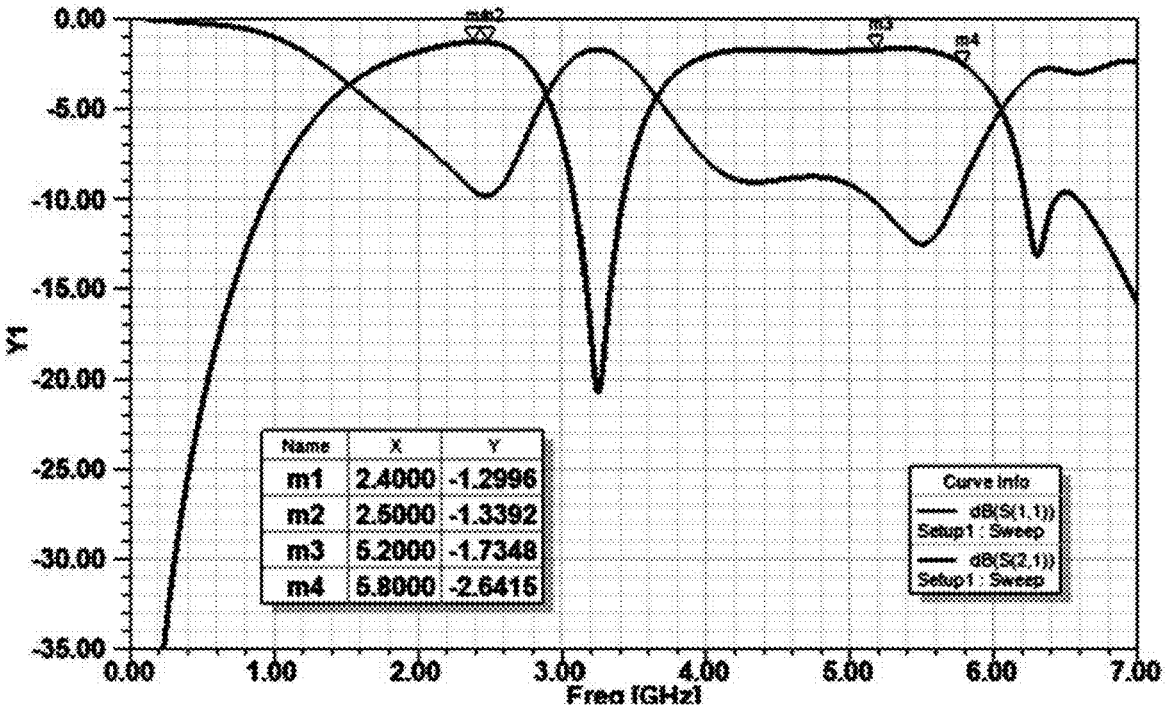
FIG. 47B illustrates simulation results of FIG. 47A.

As shown in FIG. 47A, one polyline narrow slot SL (width=0.2 mm) is disposed on a 48.6 mm*20 mm defected ground plane (Type 6) GP, wherein the size of the ground plane is changed, and some parts of the narrow polyline slot PL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 47B illustrates simulation results of FIG. 47A.

Figure 47C:
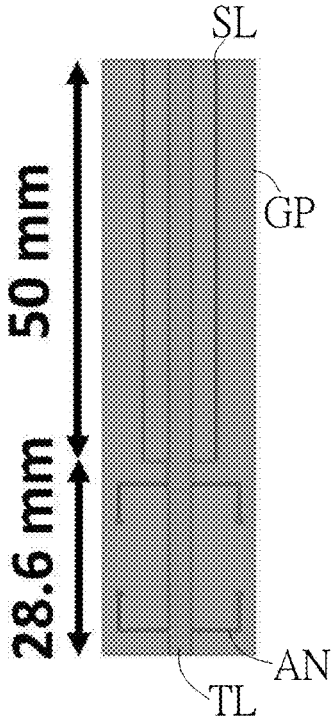
FIG. 47C illustrates a schematic view of 78.6 mm*20 mm non-common-ground bandpass filter circuit with a defected ground plane (Type 6) having one polyline narrow (0.2 mm) slot, wherein the size of the ground plane is changed, and some parts of the narrow (0.2 mm) polyline slot disposed along the width direction and the other parts of the narrow (0.2 mm) polyline slot disposed along the length direction.
Figure 47D:
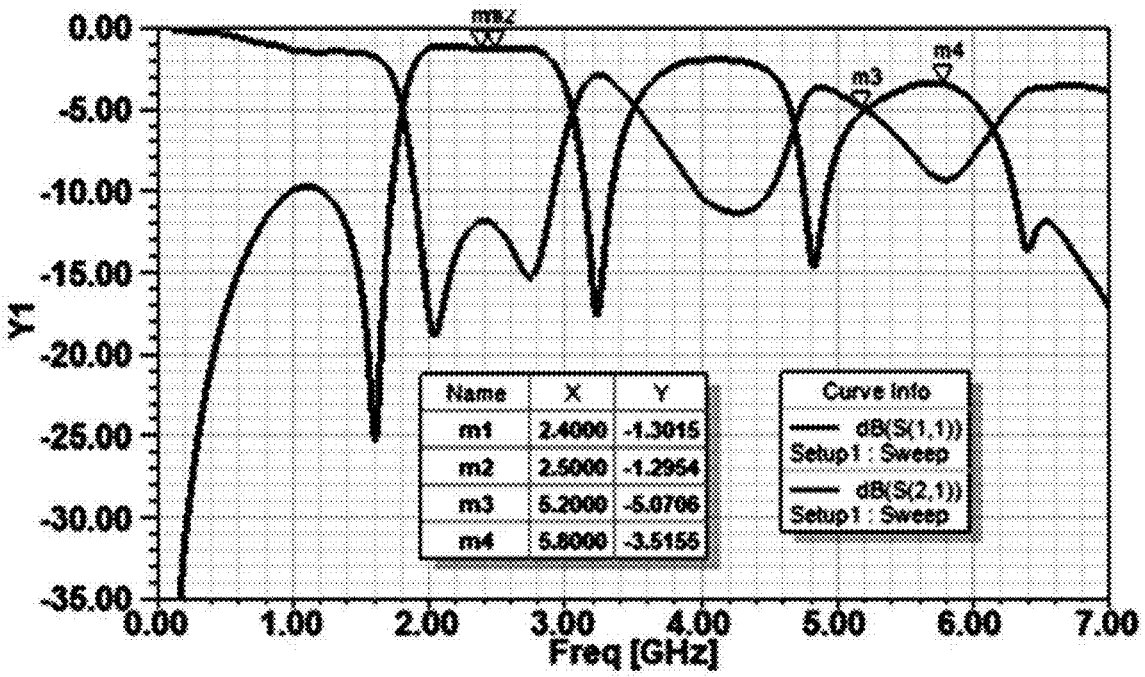
FIG. 47D illustrates simulation results of FIG. 47C.

As shown in 47C, one polyline narrow slot SL (width=0.2 mm) is disposed on a 78.6 mm*20 mm defected ground plane (Type 6) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 47D illustrates simulation results of FIG. 47C.

Figure 48A:
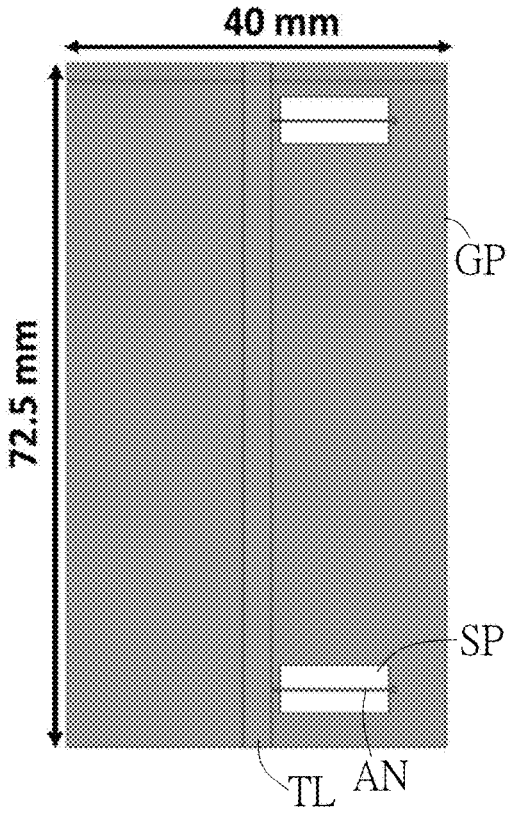
FIG. 48A illustrates a schematic view of 72.5 mm*40 mm non-common-ground bandpass filter circuit with a defected ground plane (Type 1) having one linear narrow (0.2 mm) slot disposed near the upper side along the length direction.
Figure 48B:
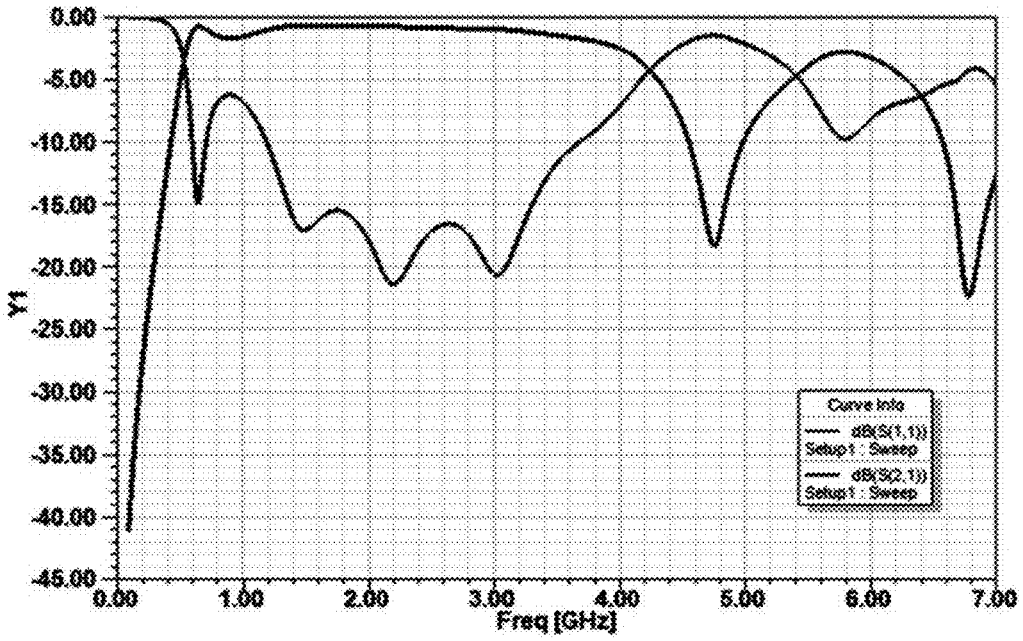
FIG. 48B illustrates simulation results of FIG. 48A.

As shown in FIG. 48A, one linear narrow slot SL (width=0.2 mm) is disposed near the upper side of a 72.5 mm*40 mm defected ground plane (Type 1) GP along the length direction of the defected ground plane GP. The antenna AN can be coupled to the ground through the via, but not limited to this. And, FIG. 48B illustrates simulation results of FIG. 48A.

Figure 49A:
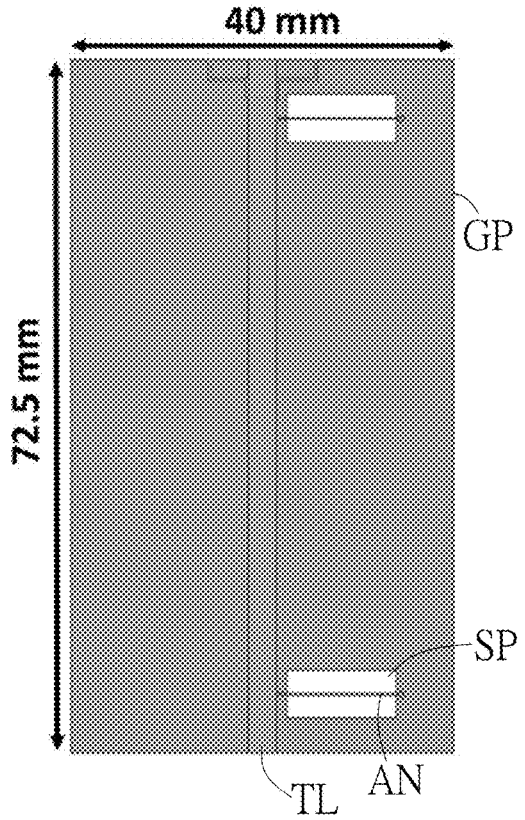
FIG. 49A illustrates a schematic view of 72.5 mm*40 mm non-common-ground bandpass filter circuit with a defected ground plane (Type 2) having one polyline narrow (0.2 mm) slot disposed near the upper side, wherein the size of the ground plane is changed, and some parts of the narrow (0.2 mm) polyline slot disposed along the width direction and the other parts of the narrow (0.2 mm) polyline slot disposed along the length direction.
Figure 49B:
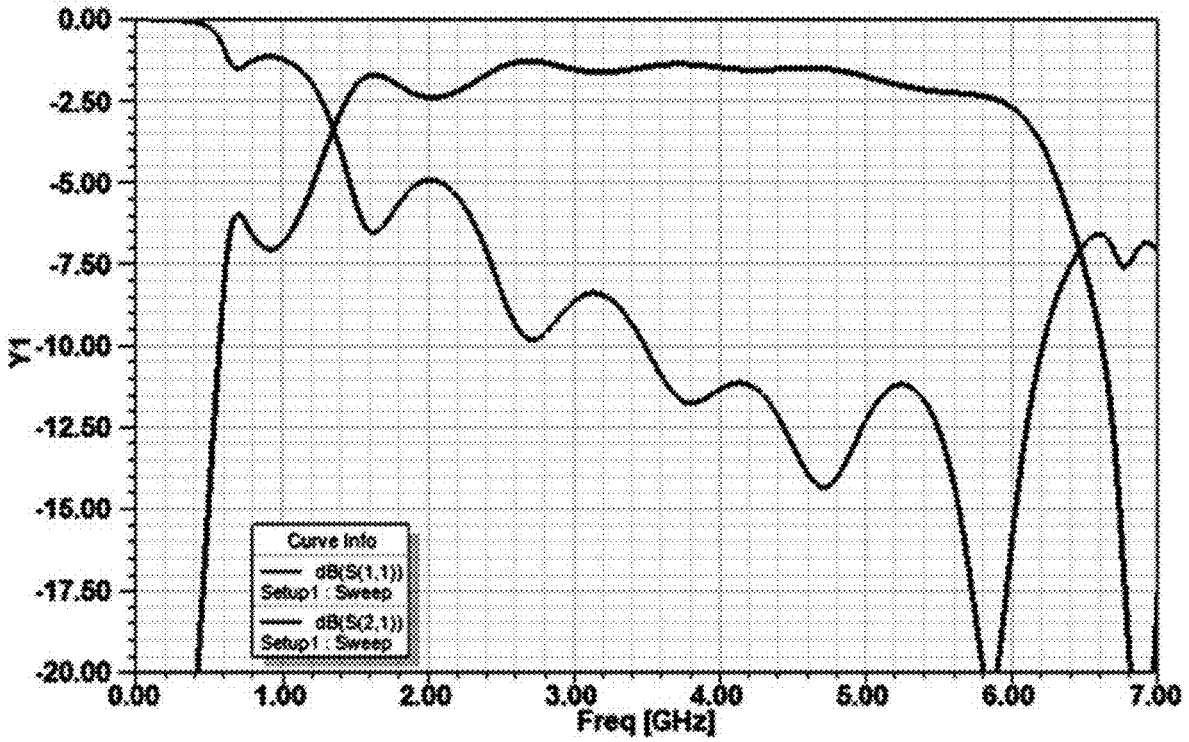
FIG. 49B illustrates simulation results of FIG. 49A.

As shown in FIG. 49A, one polyline narrow slot SL (width=0.2 mm) is disposed near the upper side of a 72.5 mm*40 mm defected ground plane (Type 2) GP, wherein the size of the ground plane is changed, and some parts of the narrow polyline slot SL are disposed along the width direction of the defected ground plane GP and the other parts of the narrow polyline slot SL are disposed along the length direction of the defected ground plane GP. The antenna AN can be coupled to the ground through the via, but not limited to this. And, FIG. 49B illustrates simulation results of FIG. 49A.

Compared to the prior art, the non-common-ground bandpass filter circuit with ESD protection of the invention has a non-common-ground plane including at least two ground regions separated and insulated from each other by a defect ground structure such as a slot or a space, so that when an ESD event occurs on one ground region, the other ground region(s) will not be damaged by the ESD event. Therefore, the non-common-ground bandpass filter circuit with ESD protection of the invention can provide better ESD protection function than the common-ground bandpass filter circuit of the prior art. In addition, the non-common-ground bandpass filter circuit of the invention can also provide good surge protection function.

The present invention has been described with reference to the above embodiments, but the above embodiments are merely examples for implementing the present invention. It should be noted that the disclosed embodiments are not intended to limit the scope of the present invention. On the contrary, any modification and equivalent configuration within the spirit and scope of the appended claims shall fall within the scope of the present invention.

What is claimed is:

1. A non-common-ground bandpass filter circuit with electrostatic discharge (ESD) protection, comprising:

a non-common-ground plane;

a conductor, disposed above the non-common-ground plane; and a dielectric substrate, disposed between the conductor and the non-common-ground plane;

wherein the non-common-ground plane at least has a first ground region and a second ground region separated and insulated from each other; the first ground region and the second ground region correspond to a first terminal and a second terminal of the conductor respectively; the non-common-ground plane has a defected ground structure (DGS) to form the first ground region and the second ground region separated and insulated from each other.

2. The non-common-ground bandpass filter circuit with ESD protection of claim 1, wherein when an ESD event occurs on one of the first ground region and the second ground region, the other of the first ground region and the second ground region is not damaged by the ESD event, and the non-common-ground bandpass filter circuit also provides surge protection.

3. The non-common-ground bandpass filter circuit with ESD protection of claim 1, wherein shapes of the first ground region and the second ground region are complementary to each other.

4. The non-common-ground bandpass filter circuit with ESD protection of claim 1, wherein the DGS comprises a slot disposed on the non-common-ground plane.

5. The non-common-ground bandpass filter circuit with ESD protection of claim 4, wherein the slot has a linear shape or a polyline shape.

6. The non-common-ground bandpass filter circuit with ESD protection of claim 4, wherein the slot is disposed along a length direction of the non-common-ground plane.

7. The non-common-ground bandpass filter circuit with ESD protection of claim 4, wherein the slot is disposed along a width direction of the non-common-ground plane.

8. The non-common-ground bandpass filter circuit with ESD protection of claim 4, wherein some parts of the slot are disposed along a length direction of the non-common-ground plane and the other parts of the slot are disposed along a width direction of the non-common-ground plane.

9. The non-common-ground bandpass filter circuit with ESD protection of claim 4, wherein the DGS further comprises at least one space disposed between the first ground region and the second ground region and connected to the slot.

10. The non-common-ground bandpass filter circuit with ESD protection of claim 9, wherein a width of the space is larger than a width of the slot.

11. The non-common-ground bandpass filter circuit with ESD protection of claim 1, wherein the non-common-ground plane has arbitrary geometry.

12. The non-common-ground bandpass filter circuit with ESD protection of claim 1, wherein a microstrip structure is formed by the conductor.

13. The non-common-ground bandpass filter circuit with ESD protection of claim 12, wherein the microstrip structure comprises a microstrip transmission line, a first terminal and a second terminal of the microstrip transmission line are disposed above the first ground region and the second ground region respectively.

14. The non-common-ground bandpass filter circuit with ESD protection of claim 13, wherein the microstrip structure further comprises at least one microstrip antenna electrically connected to the microstrip transmission line.

15. The non-common-ground bandpass filter circuit with ESD protection of claim 14, wherein the microstrip antenna has a first portion and a second portion electrically connected to each other.

16. The non-common-ground bandpass filter circuit with ESD protection of claim 15, wherein the first portion of the microstrip antenna is electrically connected to the microstrip transmission line and vertical to a length direction of the microstrip transmission line.

17. The non-common-ground bandpass filter circuit with ESD protection of claim 16, wherein the second portion of the microstrip antenna is electrically connected to the first portion and parallel to the length direction of the microstrip transmission line.

18. The non-common-ground bandpass filter circuit with ESD protection of claim 1, wherein a size of the non-common-ground plane is changed by adjusting a length of the first ground region or the second ground region.

19. The non-common-ground bandpass filter circuit with ESD protection of claim 1, wherein a size of the non-common-ground plane is changed by adjusting a width of the first ground region or the second ground region.

20. A non-common-ground bandpass filter circuit with ESD protection, comprising:

a non-common-ground plane;

a conductor, disposed above the non-common-ground plane; and a dielectric substrate, disposed between the conductor and the non-common-ground plane;

wherein the non-common-ground plane at least has a first ground region and a second ground region separated and insulated from each other; the first ground region and the second ground region correspond to a first terminal and a second terminal of the conductor respectively; a microstrip structure is formed by the conductor; the microstrip structure comprises a microstrip transmission line, a first terminal and a second terminal of the microstrip transmission line are disposed above the first ground region and the second ground region respectively.

* * * * *